US006060225A

United States Patent [19]

Makuta

[11] Patent Number: 6,060,225

[45] Date of Patent: May 9, 2000

[54] COLOR-IMAGE FORMING METHOD USING A SILVER HALIDE COLOR PHOTOGRAPHIC LIGHT-SENSITIVE MATERIAL

[75] Inventor: Toshiyuki Makuta, Minami-ashigara, Japan

[73] Assignee: Fuji Photo Film Co., Ltd., Kanagawa-ken, Japan

[21] Appl. No.: 09/262,855

[22] Filed: Mar. 4, 1999

[30] Foreign Application Priority Data

| | | | |
|---|---|---|---|
| Mar. 6, 1998 | [JP] | Japan | 10-071220 |
| Mar. 6, 1998 | [JP] | Japan | 10-071221 |
| Mar. 31, 1998 | [JP] | Japan | 10-101886 |

[51] Int. Cl.[7] ..... G03C 7/413

[52] U.S. Cl. ..... 430/405; 430/414; 430/415; 430/566; 430/943

[58] Field of Search ..... 430/405, 414, 430/415, 566, 943; 396/604, 609, 627

[56] References Cited

U.S. PATENT DOCUMENTS

| | | | |
|---|---|---|---|
| 4,021,240 | 5/1977 | Cerquone et al. . | |
| 5,477,301 | 12/1995 | Earle et al. | 354/325 |
| 5,695,913 | 12/1997 | Nakamura et al. | 430/415 |
| 5,766,831 | 6/1998 | Wildman | 430/414 |
| 5,874,203 | 2/1999 | Morita et al. | 430/566 |

FOREIGN PATENT DOCUMENTS

| | | |
|---|---|---|
| 0 545 491 A1 | 6/1993 | European Pat. Off. . |
| 2612205 | 2/1997 | Japan . |
| 9-179272 | 7/1997 | Japan . |

*Primary Examiner*—Hoa Van Le
*Attorney, Agent, or Firm*—Sughrue, Mion, Zinn, Macpeak & Seas, PLLC

[57] ABSTRACT

There is disclosed a method for forming a color-image, which method comprises ① containing, in a light-sensitive material, a dye-forming coupler, and a compound or its precursor, that is oxidized by a silver halide, to form an oxidation product thereof, that is coupled with the coupler, to form a dye having an absorption in a visible wavelength region; ② having a given coating silver amount; and ③ applying a peroxide-containing solution onto the light-sensitive material, by a coating method by droplet-spraying. The method can achieve both "a lowered amount of a waste solution" and "reduction in a change of the processing."

14 Claims, 5 Drawing Sheets

COLOR-IMAGE FORMING METHOD USING A SILVER HALIDE COLOR PHOTOGRAPHIC LIGHT-SENSITIVE MATERIAL

FIELD OF THE INVENTION

The present invention relates to a color photographic art. More specifically, the present invention relates to a method for forming a color image, including the steps of providing a silver halide color photographic light-sensitive material having excellent coloring property, storage stability, dye image stability, and hue, and also being suitable for a simple/rapid processing free of desilvering; and processing the above-said light-sensitive material by a processing solution-coating method in which a small amount of a processing solution can be coated thereon uniformly and stably, to thereby achieve both "a lowered amount of a waste solution" and "reduction in a change of the processing."

BACKGROUND OF THE INVENTION

Generally in a color photographic light-sensitive material, when the said light-sensitive material is exposed to light imagewise and then subjected to color-development, an oxidized p-phenylenediamine derivative reacts with a coupler to form an image. In this system, color reproduction by the subtractive color technique is used, and, to reproduce blue, green, and red colors, dye images of yellow, magenta, and cyan in color, respectively complementary to blue, green, and red, are formed.

Color development is accomplished by immersing (dipping) an exposed color photographic light-sensitive material in an alkaline aqueous solution containing a p-phenylenediamine derivative (a color-developing solution).

Generally, when such a processing is performed, it is necessary to use a tank for dipping a color photographic light-sensitive material in a color-developing solution, and a replenisher tank for stocking a replenisher to replenish an exhausted color-developing solution, which results in large-size processing equipment.

For a minilab and the like, in which dispersion processing is carried out in particular, the equipment is preferred to be of small size. Consequently, it is required to reduce the above-mentioned tanks for the equipment of small size.

To reduce the tanks, a first consideration is to eliminate the processing tank. A method for achieving this is to coat a processing solution on the surface of a light-sensitive material, instead of stocking a tank with the processing solution, as described in, for example, Japanese registered patent No. 2612205. However, in this method, when a p-phenylenediamine derivative necessary for forming color is incorporated in a processing solution, a large amount of the processing solution must be coated, or alternatively the concentration of the p-phenylenediamine derivative in a processing solution must be increased. In the former case, a large amount of the processing solution is used, so that a stock tank must be large-sized. According to this method, drawbacks arise in that a large amount of a processing waste solution is discharged. On the other hand, in the latter case, because the solubility of the p-phenylenediamine derivative in water is limited, a high concentration of the p-phenylenediamine derivative causes such a problem as its precipitation.

In the meantime, oxidation of the p-phenylenediamine derivative is performed by a silver halide incorporated in a light-sensitive material. The silver in the light-sensitive material, after development, remains therein as a metallic silver. The metallic silver is preferably removed from the light-sensitive material, because it turns black and therefore deteriorates a purity of the color image. Conventionally, the metallic silver was bleached into silver ions, so that they were removed with an undeveloped silver halide from a light-sensitive material by fixing. Because a large amount of an inorganic salt, such as an iron salt, a chelating agent, and the like, is contained in a bleach-fix solution having such a bleach-fixing capacity, a serious problem has been caused by the waste solution processing of bleach-fix solutions. Further, in a minilab or the like, in which dispersion processing is conducted, a device is preferably of small size. In order to conduct bleaching and fixing, a processing tank and a tank for stocking a bleach-fix solution, or the like, are needed. These are one obstacle to miniaturization of the device. A method to remove such a bleach-fixing step from a processing is to conduct intensification processing with hydrogen peroxide, as described in, for example, the Journal of the Society of Photographic Science and Technology of Japan, Vol. 51, No. 3, p. 191 (1988), JP-B-61-48148 ("JP-B" means examined Japanese patent publication), JP-B-63-20330, JP-B-63-20332, and JP-A-3-111844 ("JP-All means unexamined published Japanese patent application"). Because an image amplified on a developed silver is formed by the intensification processing, a sufficient image density can be obtained, even though a light-sensitive material having a sharply reduced amount of silver is used. Therefore, color stain due to a metallic silver can be made a negligibly small, so that bleaching and fixing are not needed.

When such an intensification processing is carried out, a color-developing solution contains as an essential element: a p-phenylenediamine derivative, which is oxidized by a silver halide, to produce its oxidation product, which couples with a coupler, to form a dye; a peroxide, such as hydrogen peroxide, that intensifies silver; and an alkali, that dissociates the coupler and the p-phenylenediamine derivative, to accelerate the reaction. However, when a p-phenylenediamine derivative and a peroxide, such as hydrogen peroxide, coexist, they react with each other, in an oxidation-reduction reaction, such that a problem arises in that a processing solution becomes deteriorated. Further, the alkaline state causes a problem in that the peroxide, such as hydrogen peroxide, tends to be decomposed by itself.

To stabilize such a color-developing solution for intensification, it is conceivable that the p-phenylenediamine derivative should be removed from the color-developing solution.

When a p-phenylenediamine derivative is removed from the color-developing solution, no coloring occurs.

One method conceivable for solving the above problems is to incorporate a p-phenylenediamine derivative, or another compound having the same function, in a light-sensitive material. If the p-phenylenediamine derivative, or the another compound having the same function, is incorporated in a light-sensitive material, there is no need to incorporate a p-phenylenediamine derivative in the processing solution. An example of a method proposed in which a p-phenylenediamine derivative, or another compound having the same function, is incorporated in a light-sensitive material, is to built-in an aromatic primary amine, or its precursor, in a light-sensitive material. Examples of the aromatic primary amine developing agent or its precursor, each of which can be built-in the light-sensitive material, include those as described in, for example, U.S. Pat. Nos.

2,507,114, 3,764,328, and 4,060,418, JP-A-56-6235, JP-A-58-192031, and Japanese Patent Application Nos. 266793/1997, 265568/1997, and 265569/1997. of these compounds, a compound that releases an aromatic primary amine upon a rearrangement reaction due to a peroxide, as described in Japanese Patent Application Nos. 266793/1997, 265568/1997, and 265569/1997, is excellent in the compatibility of storage stability and coloring property. Another example of an effective means proposed is a method in which a stable, color-forming reducing agent is built in a hydrophilic colloid layer, with examples including hydrazine compounds as described in, for example, European Patent Nos. 0545491A1 and 0565165A1, JP-A-8-286340, JP-A-8-292529, JP-A-8-297354, JP-A-8-320542, and JP-A-8-292531; and sulfonamidophenol compounds as described in, for example, U.S. Pat. No. 4,021,240 and Research Disclosure No. 15108 (November 1976). These color-forming reducing agents have characteristics of excellent storage stability and high coloring property.

An alkaline solution becomes necessary to color a compound incorporated in a light-sensitive material, such as an aromatic primary amine or its precursor, or a color-forming reducing agent, as mentioned above. As a method for providing a small amount of the alkaline solution on the surface of a light-sensitive material, first, a method in which a light-sensitive material is passed through a slit, as described in Japanese registered patent No. 2612205, is conceivable. However, in such a method, a large amount of an alkaline solution must be used. In contrast, if a method in which an alkaline solution is coated in the form of a thin layer on the surface of a light-sensitive material by a roller coater, a felt-type coater (a felt cloth), a sponge coater, or the like, as described in a specification of the above-mentioned Japanese registered patent, is used, the amount of the alkaline solution to be used can be reduced sharply. However, in these methods, the coating portion of the coating apparatus is gradually stained with a material that flows out of a light-sensitive material, which can result in a change of processing. Therefore, preferably the coating portion of the coating apparatus is kept out of contact with a light-sensitive material. Further, occurrence of unevenness in coating causes non-uniformity in coloring. Consequently, it is necessary to uniformly coat a processing solution at the time of a coating processing. As a method for uniformly coating a processing solution on the surface of a light-sensitive material without contact with a coating apparatus, there is a method in which a processing solution is atomized from a narrow nozzle and blown onto a light-sensitive material, as described in JP-A-9-179272 and JP-A-6-324455.

As a method for uniformly coating a processing solution without contact with a light-sensitive material, a method for coating a processing solution using a processing solution-coating apparatus as described in JP-A-9-179272, is especially effective.

Further, as another measure to make small a processing apparatus, a consideration is to remove the bleach-fixing step from the processing steps that are usually performed in a so-called conventional image formation, including a color-developing step, a bleach-fixing step, and a washing step, to thereby make small the processing apparatus.

As mentioned above, a drastic miniaturization of the processing apparatus can be achieved by coating an alkaline solution containing a peroxide, such as hydrogen peroxide, on a light-sensitive material containing an aromatic primary amine or its precursor, or a color-forming reducing agent, by means of a processing solution-coating apparatus, as described in JP-A-9-179272. However, an alkaline condition is necessary for oxidation of an aromatic primary amine or its precursor, or a color-forming reducing agent, and moreover nozzle holes of the processing solution-coating apparatus as described in JP-A-9-179272, from which a processing solution is sprayed, are preferably made of a metal, from a viewpoint of easy production. However, such a metallic part functions as a catalyst of the decomposition of hydrogen peroxide or the like under such a high pH condition, to thereby release oxygen. The thus-generated oxygen gas forms bubbles, which block the above-described nozzle holes, and a processing solution cannot be sprayed from such blocked nozzle holes. Consequently, a problem arises in that undeveloped portions, i.e. so-called "white spots", are generated in the processed light-sensitive material.

In the meantime, even though a p-phenylenediamine derivative has been removed from a color-developing solution for intensification, an alkali and a peroxide, such as hydrogen peroxide, still coexists in the color-developing solution for intensification, so that it is difficult to maintain the stability of the peroxide, such as hydrogen peroxide. In order to solve this problem, it is conceivable that the alkali and hydrogen peroxide may be separately applied to a light-sensitive material. When an alkali solution and a peroxide-containing solution are supplied according to an ordinary tank processing, a problem still arises in that the alkali solution that is initially supplied is gradually taken into the peroxide-containing solution, whereby stability of the peroxide-containing solution is deteriorated. Accordingly, the peroxide-containing solution at the latter part, when contacted with a light-sensitive material, cannot be used for a long time. Therefore, it is necessary to use up the peroxide-containing solution. However, a drawback arises in that a large amount of a waste solution is discharged by the tank processing.

In order to reduce such an amount of the waste solution, a slit development is proposed, as described in, for example, JP-A-63-235940, JP-A-64-26855, JP-A-2-118633, and JP-A-2-137843. If this method is used, a single use of the processing solution is possible, even in a small amount of the solution. However, a slit having the width of several tens of $\mu$m must be used in order to attain the same effect as in replenishment processing, in which a tank is used. Therefore, it is very difficult to pass the light-sensitive material through such a slit.

Different from the above-mentioned methods is one conceivable in which a processing solution is coated in a small amount and uniformly on the surface of a light-sensitive material. A known coating method is to coat a processing solution by a roller coater, a felt coater (a felt cloth), a sponge coater, or the like, as described in, for example, Japanese Registered Pat. No. 2612205, and a coating method by spraying a processing solution from a narrow nozzle, as described in JP-A-6-324455 and JP-A-9-17927. Even when a processing solution is coated onto the surface of a light-sensitive material, when a coating part of the coating device is in contact with the light-sensitive material, the coating part becomes gradually contaminated with alkali, so that a peroxide decomposes by itself at the coating part. Consequently, a problem arises in that a processing solution is coated unevenly due to bubbles generated therein. Accordingly, in order to coat a peroxide-containing solution onto the surface of a light-sensitive material, it is necessary to use a method for coating the same on the light-sensitive material without contact with a coating device. Particularly effective is a method for coating a processing solution by means of a processing solution-coating device, as described in JP-A-9-179272.

As a method for coating a water on a material without contact, the use of coating device, described in JP-A-9-179272, is known. The coating device described in this specification is used to supply a water for generating an alkali from an alkali-generating agent, when heat development is performed. One of the characteristics of the coating method described in this specification is to spray a liquid, like a water, from a nozzle of very small size, so as to coat the same. There is no problem with a liquid that contains substantially no solute, like a water. However, such a problem as "blockage of the nozzle" arises in a solution in which a lot of solutes are dissolved, when a solvent is evaporated from the solution. Further, if an amount of an organic compound dissolved in a processing solution becomes large, inclination occurs in spray from a nozzle, which results in non-uniformity of coating. Accordingly, when a processing solution is coated by such a coating method, it is necessary to reduce the solute content in the processing solution as much as possible.

In such a situation, it has been desired to materialize a method for forming an image in which both a color developer for intensification and a light-sensitive material are stable and are not deteriorated with the passage of time, and further an even and uniform image can be formed by a processing method in which a simple intensification development that does not need a bleaching is used.

SUMMARY OF THE INVENTION

An object of the present invention is to provide a method for forming a color image, which comprises the steps of providing a silver halide color photographic light-sensitive material having excellent coloring property (color-forming property), storage stability, dye image stability (fastness of a dye image), and hue of the resulting dye, and being suitable for a simple and rapid processing free from desilvering, and processing the above light-sensitive material by a processing solution-coating method in which a small amount of a processing solution can be coated thereon uniformly and stably, to thereby achieve both a lowered amount of a waste solution and reduction in a change of the processing.

Another object of the present invention is to provide a method for forming a color image, by which deterioration of a development processing solution can be prevented, and a color image having a uniform and even high color density can be obtained.

Still another object of the present invention is to provide a method for forming a color image, in which a silver halide color photographic light-sensitive material can be processed with a processing solution in a small amount, and further coloring occurs uniformly and sufficiently up to the end edge part of the light-sensitive material that is repeatedly coated with a processing solution, so that uniform coloring can be achieved over the entire surface of the thus-processed light-sensitive material.

Other and further objects, features, and advantages of the invention will appear more fully from the following description, taken in connection with the accompanying drawings.

DETAILED DESCRIPTION OF THE INVENTION

Figure 1:
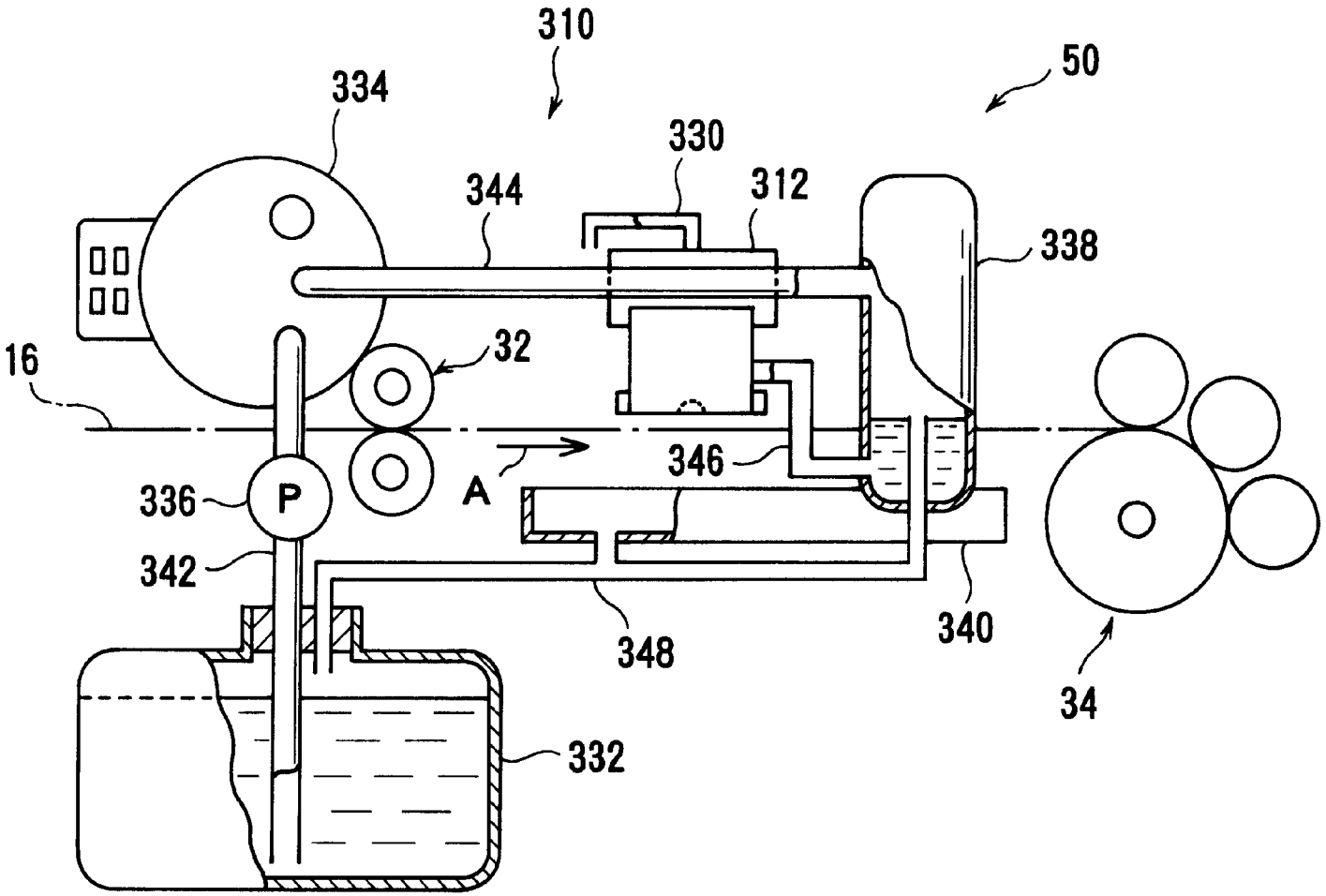
FIG. 1 is a diagrammatic structural view of the entire structure of a coating apparatus used in practice of the present invention.

The present inventor has found that the above-described objects of the present invention can be attained by the following methods:

(1) A method for forming a color image that comprises subjecting to color-development a silver halide color photographic light-sensitive material having at least one photographic constitutional layer on a support, with an alkaline processing solution substantially free from a color-developing agent, wherein ① the said silver halide light-sensitive material contains, in at least one of the photographic constitutional layer, at least one dye-forming coupler and at least one compound or its precursor, that is oxidized by a silver halide, to form an oxidation product thereof, that is coupled with the said coupler, to form a dye having an absorption in a visible wavelength region; ② a coating silver amount, in terms of the total amount of silver in all coating layers of the said light-sensitive material, is 0.003 to 0.3 g/m$^2$, in terms of silver; and ③ subsequent to the application of the said alkaline processing solution onto the said light-sensitive material, application of a peroxide-containing solution onto the said light-sensitive material is performed, by a method in which droplets of the processing solution are sprayed from a plurality of nozzle holes, and three droplets that have been sprayed from these nozzle holes and have attached onto the said light-sensitive material in contact with each other, are attached onto the said light-sensitive material, so that they are adjacent to each other with no interval between them.

(2) A method for forming a color image that comprises subjecting to color-development a silver halide color photographic light-sensitive material having at least one photographic constitutional layer on a support, with an alkaline processing solution substantially free from a color-developing agent, wherein ① the said silver halide light-sensitive material contains, in at least one of the photographic constitutional layer, at least one dye-forming coupler and at least one compound or its precursor, that is oxidized by a silver halide, to form an oxidation product thereof, that is coupled with the said coupler, to form a dye having an absorption in a visible wavelength region; ② a coating silver amount, in terms of the total amount of silver in all coating layers of the said light-sensitive material, is 0.003 to 0.3 g/m$^2$, in terms of silver; ③ application of the said alkaline processing solution onto the said light-sensitive material is performed, by a method in which droplets of the processing solution are sprayed from a plurality of nozzle holes, so as to be coated thereon, and three droplets, which have been sprayed from these nozzle holes and then have attached onto the said light-sensitive material in contact with each other, are attached to the said light-sensitive material, so that they are adjacent to each other with no interval between them; and ④ subsequent to the coating of the said alkaline processing solution, a peroxide-containing solution is applied to the said light-sensitive material in the same manner as in the said alkaline processing solution.

(3) A method for forming a color image that comprises subjecting to color-development a silver halide color photographic light-sensitive material having at least one photographic constitutional layer on a support, with an alkaline processing solution substantially free from a color-developing agent, wherein ① the said silver halide light-sensitive material contains, in at least one of the photographic constitutional layer, at least one dye-forming coupler and at least one compound or its precursor, that is oxidized by a silver halide, to form an oxidation product thereof, that is coupled with the said coupler, to form a dye having an absorption in a visible wavelength region; ② a coating silver amount, in terms of the total mount of silver in all coating layers of the said light-sensitive material, is 0.003 to 0.3 g/m$^2$, in terms of silver; ③ application of the said alkaline processing solution onto the said light-sensitive material is performed by dipping the light-sensitive material in the alkaline processing solution, or by contact-coating the alkaline processing solution onto the light-sensitive material; and ④ subsequent to the application of the said alkaline processing solution, application of a peroxide-containing solution onto the said light-sensitive material is performed, by a method in which droplets of the processing solution are sprayed from a plurality of nozzle holes, so as to be coated thereon, and three droplets that have been sprayed from these nozzle holes and then have attached onto the said light-sensitive material in contact with each other, are attached to the said light-sensitive material, so that they are adjacent to each other with no interval between them.

(4) A method for forming a color image that comprises subjecting to color-development a silver halide color photographic light-sensitive material having at least one photographic constitutional layer on a support, with an alkaline processing solution substantially free from a color-developing agent, wherein ① the said silver halide light-sensitive material contains, in at least one of the photographic constitutional layer, at least one dye-forming coupler and at least one compound or its precursor, that is oxidized by a silver halide, to form an oxidation product thereof, that is coupled with the said coupler, to form a dye having an absorption in a visible wavelength region; ② a coating silver amount, in terms of the total amount of silver in all coating layers of the said light-sensitive material, is 0.003 to 0.3 g/m$^2$, in terms of silver; ③ subsequent to the application of the said alkaline processing solution onto the said light-sensitive material, application of a peroxide-containing solution onto the said light-sensitive material is performed, by a method in which droplets of the processing solution are sprayed from a plurality of nozzle holes, and three droplets that have been sprayed from these nozzle holes and have attached onto the said light-sensitive material in contact with each other, are attached onto the said light-sensitive material, so that they are adjacent to each other with no interval between them; and ④ the value of surface tension of the said peroxide-containing solution is not larger than that of the said alkaline processing solution by 10 dyn/cm.

(5) The method for forming a color image as stated in (1), (2), (3), or (4), wherein the compound whose oxidation product, formed by oxidation due to the said silver halide, is coupled with a coupler, to form a dye having an absorption in a visible wavelength region, is represented by the following formula (I) or (II):

formula (I)

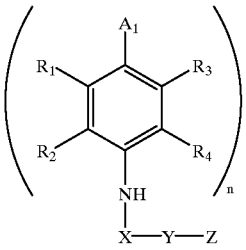

formula (II)

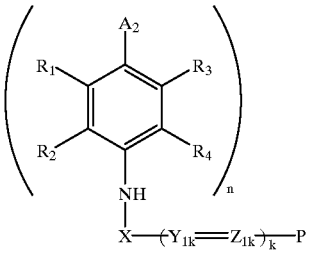

wherein $R_1$, $R_2$, $R_3$, and $R_4$ each represent a hydrogen atom, or a substituent; $A_1$ and $A_2$ each represent a hydroxyl group, or a substituted amino group; X represents a divalent or more multivalent linking group selected from —CO—, —SO—, —$SO_2$, and —PO<; $Y_{1k}$ and $Z_{1k}$ each represent a nitrogen atom, or a group represented by —$CR_5$═ (in which $R_5$ represents a hydrogen atom, or a substituent); k represents 0 (zero), or a positive integer; P represents a proton-dissociating group, or a group that can be a cation, and it has a function to form a dye by breakage of an N—X bond and removal of a substituent bonded to a coupling site of a coupler, caused by transfer of an electron from P after the coupling reaction of the coupler with an oxidized product produced by a redox reaction of the above-said compound with silver halide exposed to light; Y represents a divalent linking group; Z is a nucleophilic group, and it is able to attack the X, when the above-said compound is oxidized; n is 1 or 2, when X is —PO<, or n is 1, when X is another group; $R_1$ and $R_2$, or $R_3$ and $R_4$, or at least two kinds of atoms or substituents arbitrarily selected from $Y_{1k}$, $Z_{1k}$, and P may be independently linked each other to form a ring, respectively. (6) The method for forming a color image as stated in (1), (2), (3), or (4), wherein the compound whose oxidation product, formed by oxidation due to the said silver halide, is coupled with a coupler, to form a dye having an absorption in a visible wavelength region, is represented by the following formula (III):

$$R^{11}—NHNH—X^0—R^{12}$$ formula (III)

wherein $R^{11}$ represents an aryl or heterocyclic group, which may be substituted with a substituent; $R^{12}$ represents an alkyl, alkenyl, alkinyl, aryl, or heterocyclic group, which may be substituted with a substituent; $X^0$ represents —$SO_2$—, —CO—, —COCO—, —CO—O—, —CONH($R^{13}$)—, —COCO—O—, —COCO—N($R^{13}$)—, or —$SO_2$—NH($R^{13}$)—, in which $R^{13}$ is a hydrogen atom, or a group mentioned for $R^{12}$. (7) The method for forming a color image as stated in (6), wherein the compound represented by formula (III) is a compound represented by formula (IV) or (V):

formula (IV)

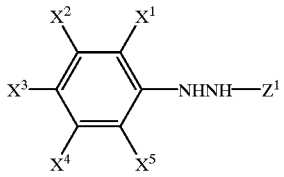

formula (V)

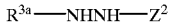

wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$ each represent a hydrogen atom, or a substituent, with the proviso that the total of Hammett substituent constant σp values of $X^1$, $X^3$, and $X^5$, and Hammett substituent constant σm values of $X^2$ and $X^4$, is from 0.08 to 3.80; and $R^{3a}$ represents a heterocyclic group.

(8) The method for forming a color image as stated in (7), wherein the compound represented by formula (IV) or (V) is a compound represented by formula (VI) or (VII):

formula (VI)

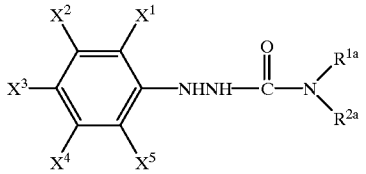

formula (VII)

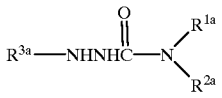

wherein $R^{1a}$ and $R^{2a}$ each represent a hydrogen atom, or a substituent; $X^1$, $X^2$, $X^3$, $X^4$, and $X^5$ each represent a hydrogen atom, or a substituent, with the proviso that the total of Hammett substituent constant σp values of $X^1$, $X^3$, and $X^5$, and Hammett substituent constant σm values of $X^2$ and $X^4$, is from 0.80 to 3.80; and $R^{3a}$ represents a heterocyclic group.

(9) The method for forming a color image as stated in (8), wherein the compound represented by formula (VI) or (VII) is a compound represented by formula (VIII) or (IX):

formula (VIII)

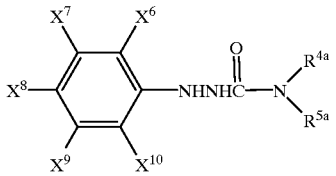

-continued formula (IX)

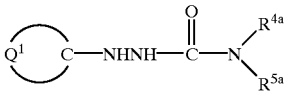

wherein $R^{4a}$ and $R^{5a}$ each represent a hydrogen atom, or a substituent, at least one of $R^{4a}$ and $R^{5a}$ being a hydrogen atom; $X^6$, $X^7$, $X^8$, $X^9$, and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, with the proviso that the total of Hammett substituent constant σp values of $X^6$, $X^8$, and $X^{10}$, and Hammett substituent constant σm values of $X^7$ and $X^9$, is from 1.20 to 3.80; and $Q^1$ represents a group of nonmetallic atoms necessary to form a nitrogen-containing five- to eight-membered heterocyclic ring together with the C.

(10) The method for forming a color image as stated in (1), (2), (3), or (4), wherein the precursor of the compound whose oxidation product, formed by oxidation due to the said silver halide, is coupled with a coupler, to form a dye having an absorption in a visible wavelength region, is represented by the following formula (X):

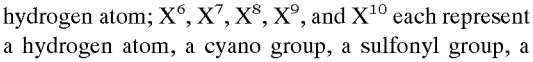

formula (X)

wherein Ar represents an aryl group, or a heterocyclic group; X represents a methylene group substituted at the position where a color-developing agent can be released subsequent to oxidization of the formyl group; L represents a linking group; m represents an integer of 0 to 3; and PPD represents a group to give a color-developing agent.

(11) The method for forming a color image as stated in (10), wherein the compound represented by formula (X) is a compound represented by formula (XI):

formula (XI)

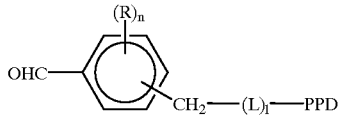

wherein R represents a hydrogen atom, a hydroxyl group, a halogen atom, an alkyl group, a cycloalkyl group, an aryl group, a heterocyclic group, an alkoxy group, an aryloxy group, an acyloxy group, an acylamino group, a sulfonylamino group, or another amino group, or Rs may be connected to each other to form a ring, depending on the case; —$CH_2$— represents a methylene group bonded at the ortho or para position to the formyl group; L represents a linking group; PPD represents a group to give a color-developing agent; l represents an integer; and n represents an integer of 1 to 4.

(12) The method for forming a color image as stated in (11), wherein the compound represented by formula (XI) is a compound represented by formula (XII):

formula (XII)

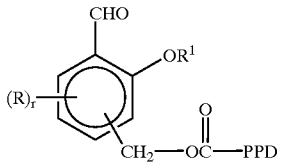

wherein $R^1$ represents a hydrogen atom, an alkyl group, an aryl group, or an acyl group; R has the same meaning as in formula (XI); —$CH_2$— represents a methylene group bonded at the ortho or para position to the formyl group; PPD represents a group to give a color-developing agent; and r represents an integer of 0 to 3.

(13) The method for forming a color image as stated in (1), (2), (5), (6), (7), (8), (9), (10), (11), or (12), in which coating, onto the light-sensitive material, of both the said alkaline processing solution and the said peroxide-containing solution is carried out by spraying (injection) from a plurality of nozzle holes (openings), wherein the volume of one droplet of the said alkaline processing solution injected from these nozzle openings is designated as V, and the contact angle of the said alkaline processing solution, when attached on the light-sensitive material, is designated as θ, and the diameter D of one droplet of the alkaline processing solution attached on the light-sensitive material is calculated according to equation:

$$D = 2 \cdot \mathrm{Sin}\theta\left(\frac{3 \cdot V}{\pi \cdot \{2^{-3} \cdot \cos\theta + (\cos\theta)^3\}}\right)^{1/3}$$

and a pitch P between the nozzle holes adjacent to each other is adjusted to the value not more than $(\sqrt{3})\cdot D/2$.

(14) The method for forming a color image as stated in (1), (2), (5), (6), (7), (8), (9), (10), (11), (12), or (13), wherein the total of the thickness of a liquid membrane of both the alkaline processing solution and the peroxide-containing solution coated on the light-sensitive material, is not more than 100 μm.

(15) The method for forming a color image as stated in (1), (4), (5), (6), (7), (8), (9), (10), (11), or (12), wherein application of the said alkaline processing solution onto the light-sensitive material is performed, by a coating method.

(16) The method for forming a color image as stated in (15), wherein application of the said alkaline processing solution onto the said light-sensitive material is performed, by a method in which droplets of the processing solution are sprayed from a plurality of nozzle holes, and three droplets that have been sprayed from these nozzle holes and then have attached onto the said light-sensitive material in contact with each other, are attached to the said light-sensitive material, so that they are adjacent to each other with no interval between them.

(17) The method for forming a color image as stated in (16), wherein the value of surface tension of the said alkaline processing solution is 60 dyn/cm or less.

(18) The method for forming a color image as stated in (1), (3), (4), (5), (6), (7), (8), (9), (10), (11), (12), (15), (16), or (17), wherein the total of the amount of both the alkaline processing solution and the peroxide-containing solution coated on the light-sensitive material is 100 $ml/m^2$ or less.

(19) The method for forming a color image as stated in (1), (2), (3), (4), (5), (6), (7), (8), (9), (10), (11), 12), (13), (14), (15), (16), (17), or (18), wherein the interval between coatings of the said alkaline processing solution followed by the said peroxide-containing solution is not more than 10 seconds.

(20) The method for forming a color image as stated in (1), (2), (3), (4), (5), (6), (7), (8), (9), (10), (11), (12), (13), (14), (15), (16), (17), (18), or (19), wherein the said peroxide-containing solution is a hydrogen peroxide aqueous solution.

(21) The method for forming a color image as stated in (1), (2), (3), (4), (5), (6), (7), (8), (9), (10), (11), (12), (13), (14), (15), (16), (17), (18), (19), or (20), which comprises exposing the light-sensitive material to light by a scanning exposure system, wherein the exposure time per picture element is $10^{-8}$ to $10^{-4}$ seconds, and there is an overlapping between rasters adjacent to each other.

Herein, the methods for forming a color image as stated in the above (2), (5) to (14), and (19) to (21) with the proviso that the methods are limited to those in the above (2) and dependent thereon, are referred to as the first embodiment of the present invention.

Further, the methods for forming a color image as stated in the above (3), (5) to (12), and (18) to (21) with the proviso that the methods are limited to those in the above (3) and dependent thereon, are referred to as the second embodiment of the present invention.

Further, the methods for forming a color image as stated in the above (4), (5) to (12), and (15) to (21) with the proviso that the methods are limited to those in the above (4) and dependent thereon, are referred to as the third embodiment of the present invention.

In the description hereinbelow, the present invention means to include all of the above first, second, and third embodiments including the method as stated in the above (1), unless otherwise specified.

The method for forming a color-image in the above (1) of the present invention can achieve both "a lowered amount of a waste solution" and "reduction in a change of the processing," by ① containing, in a light-sensitive material, a dye-forming coupler and, a compound or its precursor, that is oxidized by a silver halide, to form an oxidation product thereof, that is coupled with the coupler, to form a dye having an absorption in a visible wavelength region; ② having a given coating silver amount; and ③ applying a peroxide-containing solution onto the light-sensitive material, by a coating method by droplet-spraying. That method for forming a color-image has the above first, second, and third embodiments.

The method for forming a color-image in the above (1) can further form an image without unevenness, such as white spot, by carrying out application of an alkaline processing solution onto the light-sensitive material with the coating method by droplet-spraying (the first embodiment).

The method for forming a color-image in the above (1) can further form an image without unevenness even when processed continuously, by carrying out application of an alkaline processing solution onto the light-sensitive material with a dipping method or a contact-coating method (the second embodiment).

The method for forming a color-image in the above (1) can further form color without unevenness up to an edge part of the processed light-sensitive material, by making the difference of the values of surface tension between a peroxide-containing solution and an alkaline processing solution to be within a given range (the third embodiment).

According to the present invention, preferably the first embodiment, white spots in the processed sample due to the formation of bubbles peculiarly generated when intensification processing that does not require desilvering is carried out, can be improved by a processing solution-coating method that enables uniform coating of a small amount of a processing solution onto the surface of a light-sensitive material not in contact with a coating apparatus.

The present invention, preferably the first embodiment can provide, for the first time, an image-forming method, that provides the following advantages:

1. Miniaturization of a processing apparatus is achieved,
2. A light-sensitive material can be processed with a processing solution that only slightly affects the environment,
3. An amount of a waste solution is small, and
4. An even and uniform image can be formed.

Further, the present invention, preferably the second and third embodiments has materialized an intensification processing that does not need bleaching.

According to the present invention, preferably the second and third embodiments, an image-forming method providing the following advantages can be achieved, for the first time:

1. A processing system in which bleaching is not needed can be constructed.
2. Miniaturization of the processor is made possible.
3. Processing can be performed with a processing solution that has little influence on the environment.
4. The amount of a waste solution is small.
5. An even and uniform image can be formed.

"The compound or its precursor, whose oxidation product, formed by oxidation due to a silver halide, is coupled with a coupler, to form a dye having an absorption in a visible wavelength region" (hereinafter occasionally referred to as a color-developing compound) for use in the present invention may be any compounds including known ones, as long as the compound has the above-mentioned function. Further, a sulfonamidephenol-type color-forming reducing agent (reducing agent for coloring), a hydrazine-type reducing agent for coloring, and a precursor of a color-developing agent that releases an aromatic primary amine (color-developing agent) by rearrangement reaction due to hydrogen peroxide, as described below, are preferred from the viewpoints of coexistence of storage stability and coloring property.

The present invention is explained below in detail.

The compounds represented by formula (I) or (II) are described in detail.

In this specification and claims, the terms "an alkyl group (alkyl moiety)," "an aryl group (aryl moiety)," "an amino group (amino moiety)," and the like, as described below, each mean that these groups (moieties) include those further substituted with a substituent.

The compounds represented by formula (I) or (II) are developing agents that are classified into aminophenol derivatives and phenylenediamine derivatives. In these formulae, $R_1$ to $R_4$ each represent a hydrogen atom, or a substituent. Examples of the substituent include a halogen atom (e.g., chloro, bromo), an alkyl group (e.g., methyl, ethyl, isopropyl, n-butyl, t-butyl), an aryl group (e.g., phenyl, tolyl, xylyl), a carbonamide group (e.g., acetylaminc, propionylamino, butyroylamino, benzoylamino), a sulfonamide group (e.g., methanesulfonylamino, ethanesulfonylamino, benzenesulfonylamino, toluenesulfonylamino), an alkoxy group (e.g., methoxy, ethoxy), an aryloxy group (e.g., phenoxy), an alkylthio group (e.g., methylthio, ethylthio, butylthio), an arylthio group (e.g., phenylthio, tolylthio), a carbamoyl group (e.g., methylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl, ethylphenylcarbamoyl, benzylphenylcarbamoyl), a sulfamoyl group (e.g., methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl, benzylphenylsulfamoyl), a cyano group, a sulfonyl group (e.g., methanesulfonyl, ethanesulfonyl, phenylsulfonyl, 4-chlorophenylsulfonyl, p-toluenesulfonyl), an alkoxycarbonyl group (e.g., methoxycarbonyl, ethoxycarbonyl, butoxycarbonyl), an aryloxycarbonyl group (e.g., phenoxycarbonyl), an acyl group (e.g., acetyl, propionyl, butyroyl, benzoyl, alkylbenzoyl), a ureido group (e.g., methylaminocarbonamide, diethylaminocarbonamide), a urethane group (e.g., methoxycarbonamido, butoxycarbonamido), and an acyloxy group (e.g., acetyloxy group, propionyloxy, butyroyloxy). Of $R_1$ to $R_4$, $R_2$ and/or $R_4$ is (are) preferably a hydrogen atom. Further, when $A_1$ or $A_2$ is a hydroxyl group, the total of Hammett's constant op values of $R_1$ to $R_4$ is preferably not less than 0, and on the other hand when $A_1$ or $A_2$ is a substituted amino group, the total of Hammett's constant op values of $R_1$ to $R_4$ is preferably not more than 0.

$A_1$ and $A_2$ each represent a hydroxyl group, or a substituted amino group (e.g. dimethylamino, diethylamino, ethylhydroxyethylamino). $A_2$ is preferably a hydroxyl group. X represents a divalent or more multivalent linking group selected from —CO—, —SO—, —$SO_2$, and —PO<. $Y_{1k}$ and $Z_{1k}$ each represent a nitrogen atom, or a group represented by —$CR_5$= (in which $R_5$ represents a hydrogen atom, or a substituent). Examples of $R_5$ are the same as those mentioned as substituents of $R_1$ to $R_4$. P represents a proton-dissociating group, or a group that can be a cation, and it has a function to form a dye by breakage of an N—X bond and removal of a substituent bonded to a coupling site of a coupler, caused by transfer of an electron from P after the coupling reaction of the coupler with an oxidized product produced by a redox reaction of the said compound with exposed silver halide. Specifically, after the coupling reaction, an electron transfers toward the coupling site from an unshared electron pair of an atom, which can be an anion or cation, formed by proton dissociation on P; consequently, a double bond is formed between X and $Y_{1k}$ (between X and P when K=0), to cause breakage of an N—X bond, and further, a double bond is formed between the coupling site of a coupler and an N atom, and a substituent on the coupler is simultaneously removed as an anion. An electron transfer mechanism series causes formation of a dye and removal of a substituent. Examples of the proton-dissociating atom, as an atom having such a function in P, include an oxygen atom, a sulfur atom, a selenium atom, and a nitrogen or carbon atom substituted with an electron attracting group. As the atom that can be a cation, a nitrogen atom, a sulfur atom, and the like can be mentioned.

P is one of a group of substituents bonded to the above-described atom. Examples of the substituent bonded to the atom include an alkyl group (e.g., methyl, ethyl, isopropyl, n-butyl, t-butyl), an aryl group (e.g., phenyl, tolyl, xylyl), a carbonamide (e.g., acetylamino, propionylamino, butyroylamino, benzoylamino), a sulfonamide group (e.g., methanesulfonylamino, ethanesulfonylamino, benzenesulfonylamino, toluenesulfonylamino), an alkoxy group (e.g., methoxy, ethoxy), an aryloxy group (e.g., phenoxy), an alkylthio group (e.g., methylthio, ethylthio, butylthio), an arylthio group (e.g. phenylthio, tolylthio), a carbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl, phenylcarbamoyl, methylphenylcarbamoyl, ethylphenylcarbamoyl, benzylphenylcarbamoyl), a sulfamoyl group (e.g., methylsulfamoyl, dimethylsulfamoyl, ethylsulfamoyl, diethylsulfamoyl, dibutylsulfamoyl, piperidylsulfamoyl, morpholylsulfamoyl, phenylsulfamoyl, methylphenylsulfamoyl, ethylphenylsulfamoyl, benzylphenylsulfamoyl), a cyano group, a sulfonyl group (e.g. methanesulfonyl, ethanesulfonyl, phenylsulfonyl, 4-chlorophenylsulfonyl, p-toluenesulfonyl), an alkoxycarbonyl group (e.g., methoxycarbonyl, ethoxycarbonyl, butoxycarbonyl), an aryloxycarbonyl group (e.g., phenoxycarbonyl), an acyl group (e.g., acetyl, propionyl, butyroyl, benzoyl, alkylbenzoyl), an acyloxy group (e.g., acetyloxy, propionyloxy, butyroyloxy), a ureido group, and a urethane group. Of these groups, an alkyl group, an aryl group, and a heterocyclic group are preferred.

Z represents a nucleophilic group, and it has a function to form a dye by nucleophilic attack by the said nucleophilic group against a carbon atom, a sulfur atom, or a phosphorus atom of X, after the present compound has reduced an exposed silver halide, to form an oxidation product thereof, which coupled with a coupler. In this nucleophilic group, the nucleophilicity is revealed by an atom (e.g. a nitrogen atom, a phosphorus atom, an oxygen atom, a sulfur atom, and a selenium atom) or an anion series (e.g. a nitrogen anion, an oxygen anion, a carbon anion, and a sulfur anion), each of which has an unshared electron pair, as is general in the field of organic chemistry. Examples of the nucleophilic group include those having a partial structure or its dissociated structure, as illustrated by the following specific examples:

Examples of a partial structure having nucleophilicity included in Z (The atom attached with "═" as underlines has nucleophilicity.)

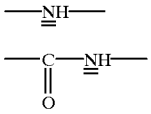

-continued

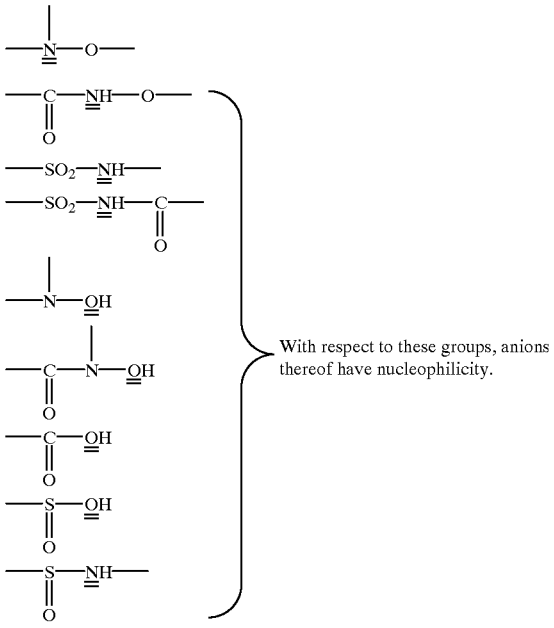

Specific examples of Z include atomic groups wherein a hydrogen atom, or the group mentioned above as a substituent of P, is bonded to one end of the above-described group.

Y represents a divalent linking (connecting) group. The linking group has a function to connect X and Z via Y, at the position that Z is able to effectively achieve an intramolecular nucleophilic attack on X. Practically, atoms are preferably connected so that the transition state in which a nucleophilic group conducts a nucleophilic attack on X, can constitute a 5- or 6-atom membered ring.

Preferable examples of such a linking group Y include a 1,2- or 1,3-alkylene group, a 1,2-cycloalkylene group, a 2-vinylene group, a 1,2-arylene group, and a 1,8-naphthalene group.

k is preferably an integer of 0 to 5, and more preferably 0 to 2. $R_1$ and $R_2$, $R_3$ and $R_4$, and at least two atoms or substituents arbitrarily selected from $Y_{1k}$, $Z_{1k}$, and P may each independently bond together, to form a ring.

Specific examples of the compounds represented by formula (I) or (II) are illustrated below. However, the compounds for use in the present invention is not limited to these compounds.

D-1
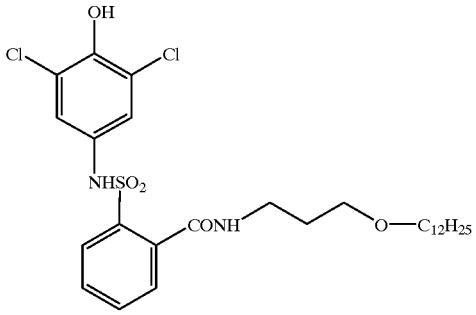
D-2
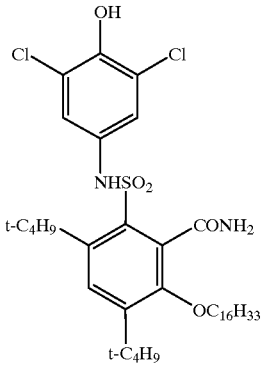
D-3
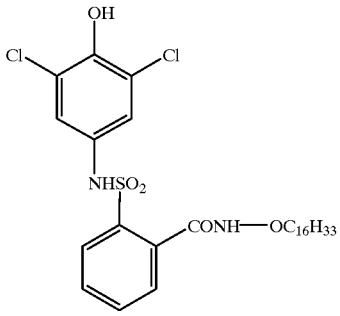
D-4
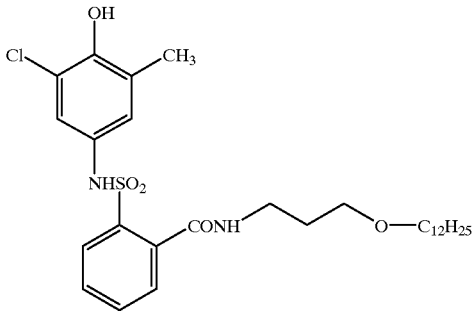
D-5
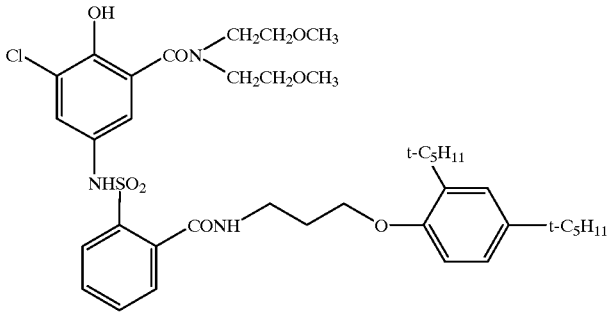
D-6
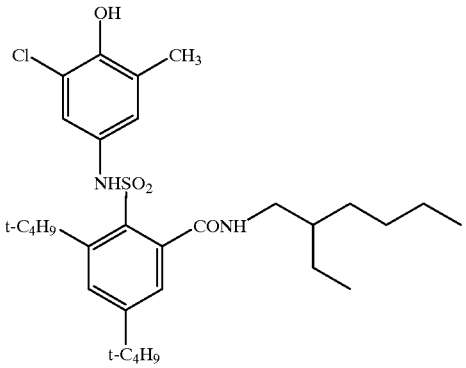
D-7
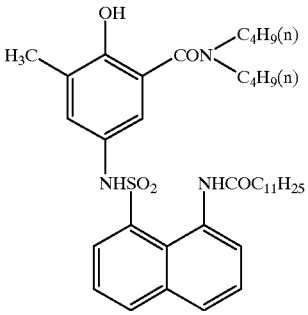

-continued
D-8
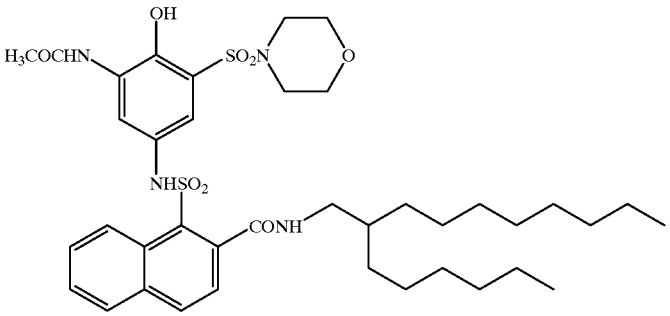
D-9
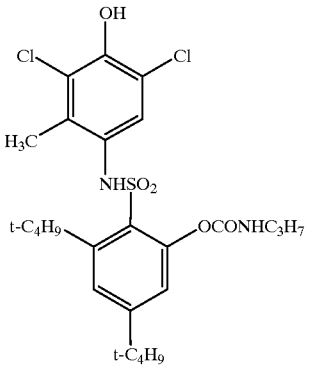
D-10
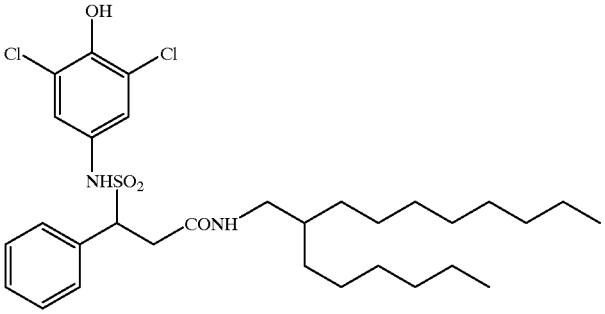
D-11
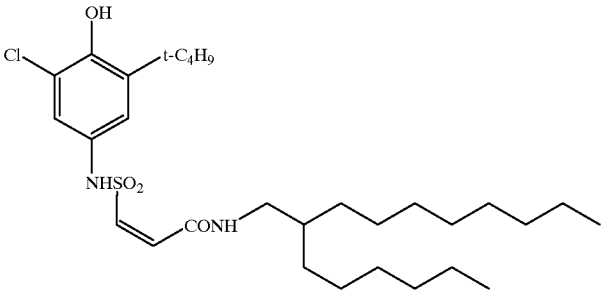

-continued
D-12
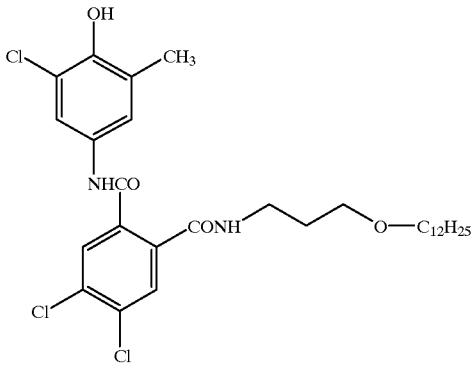
D-13
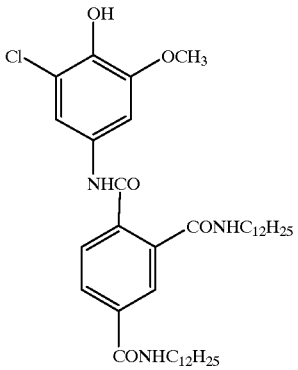
D-14
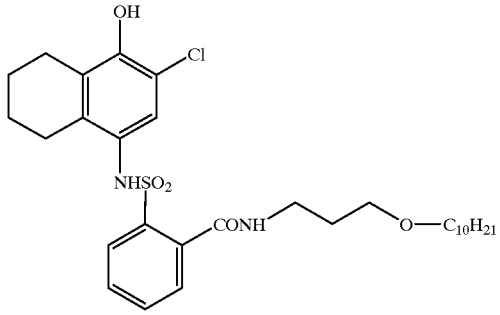
D-15
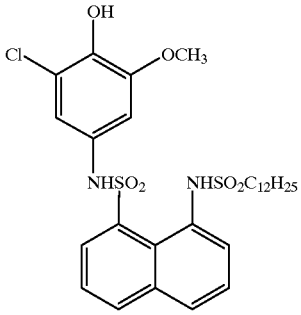
D-16
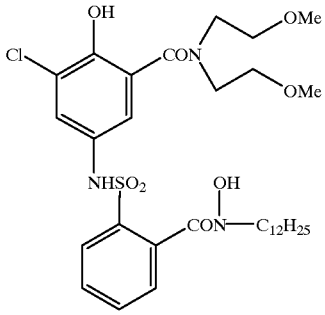
D-17
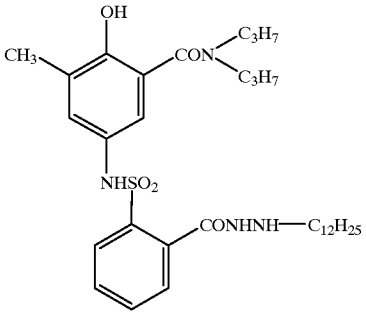
D-18
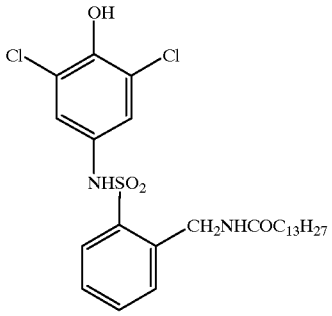
D-19
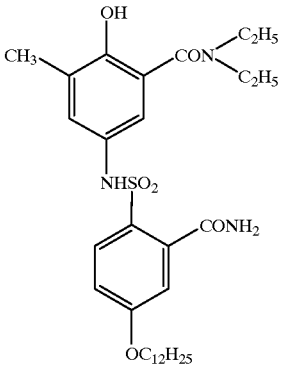

-continued
D-20
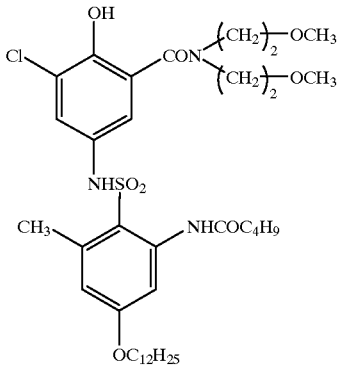
D-21
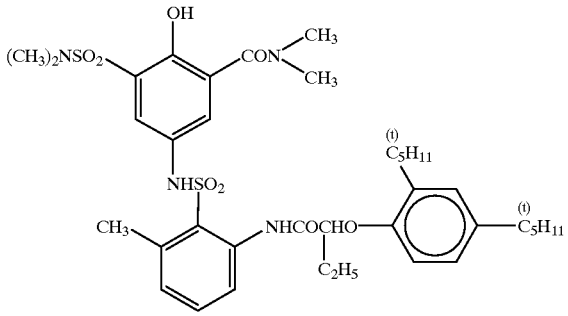
D-101
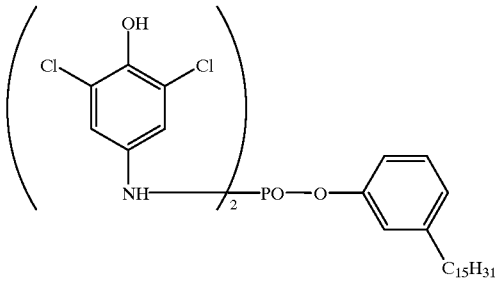
D-102
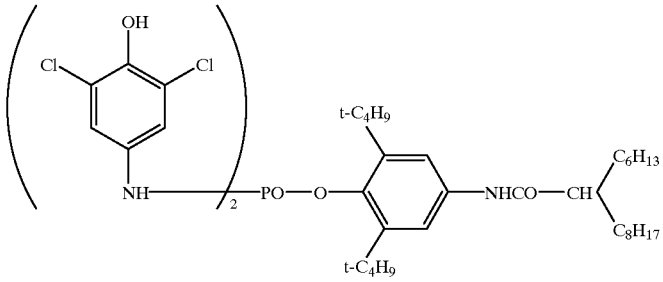
D-103
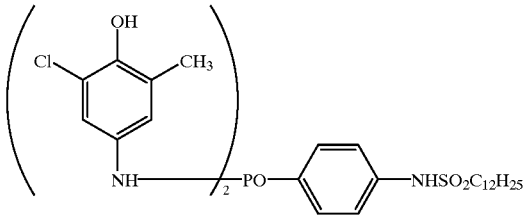
D-104
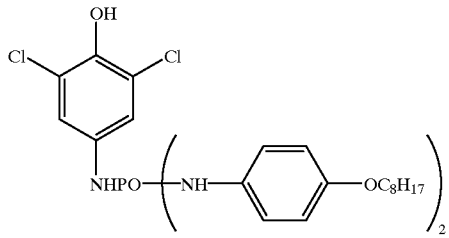
D-105
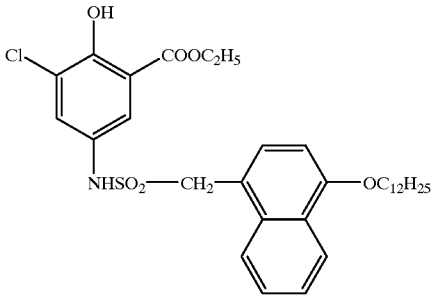
D-106
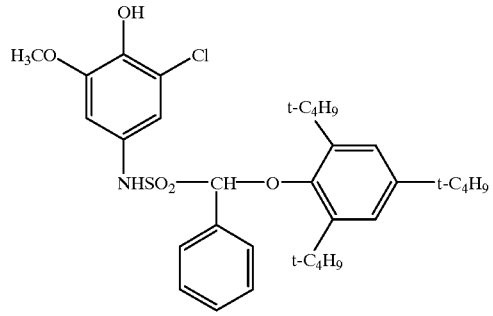

-continued
D-107
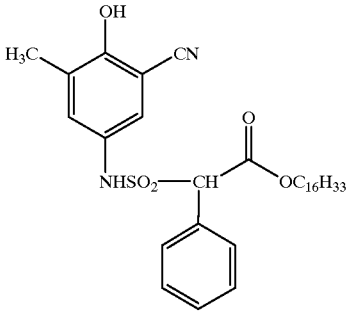
D-108
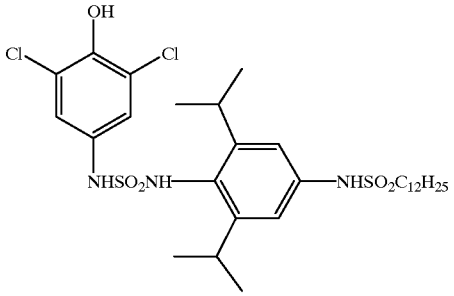
D-109
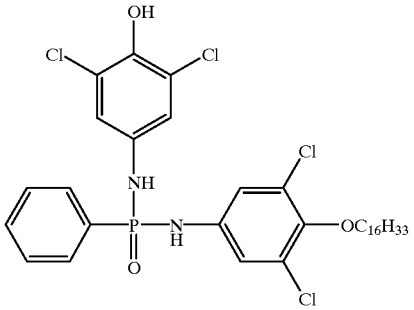
D-110
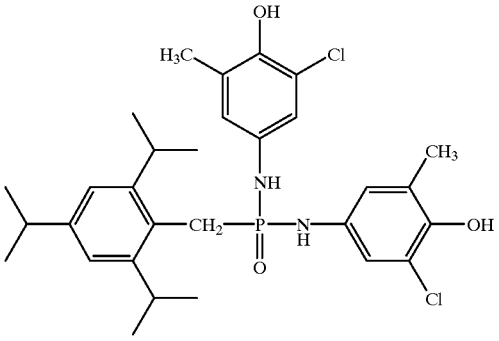
D-111
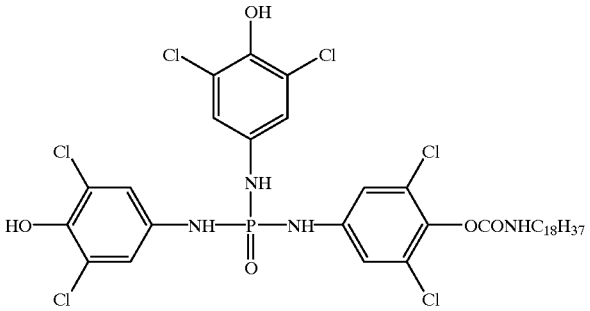

-continued

D-112

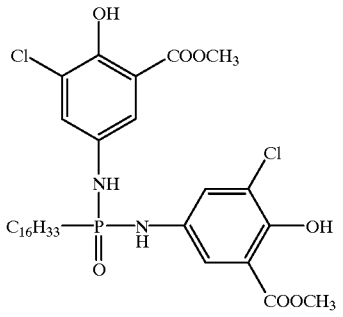

D-113

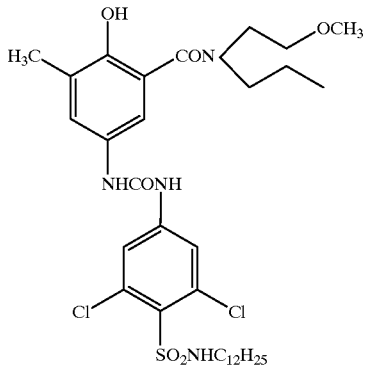

The structure of the color-forming reducing agent represented by formula (III) is described in detail below.

In formula (III), $R^{11}$ represents an aryl group or heterocyclic group, which may be substituted. The aryl group represented by $R^{11}$ has preferably 6 to 14 carbon atoms, and examples include phenyl and naphthyl. The heterocyclic group represented by $R^{11}$ is preferably a saturated or unsaturated, 5-membered, 6-membered, or 7-membered heterocyclic ring containing at least one of nitrogen, oxygen, sulfur, and selenium, to which a benzene ring or a heterocyclic ring may be condensed. Examples of the heterocyclic ring represented by $R^{11}$ include furanyl, thienyl, oxazolyl, thiazolyl, imidazolyl, triazolyl, pyrrolidinyl, benzoxazolyl, benzothiazolyl, pyridyl, pyridazyl, pyrimidinyl, pyrazinyl, triazinyl, quinolinyl, isoquinolinyl, phthalazinyl, quinoxalinyl, quinazolinyl, purinyl, pteridinyl, azepinyl, and benzooxepinyl.

Examples of the substituent possessed by $R^{11}$ include an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group, and an azo group.

$R^{12}$ represents an alkyl group, an alkenyl group, an alkynyl group, an aryl group, or a heterocyclic group, each of which may be substituted.

The alkyl group represented by $R^{12}$ is preferably a straight-chain, branched, or cyclic alkyl group having 1 to 16 carbon atoms, such as methyl, ethyl, hexyl, dodecyl, 2-octyl, t-butyl, cyclopentyl, and cyclooctyl. The akenyl group represented by $R^{12}$ is preferably a chain or cyclic alkenyl group having 2 to 16 carbon atoms, such as vinyl, 1-octenyl, and cyclohexenyl.

The alkynyl group represented by $R^{12}$ is preferably an alkynyl group having 2 to 16 carbon atoms, such as 1-butynyl and phenylethynyl. The aryl group and the heterocyclic group represented by $R^{12}$ include those mentioned for $R^{11}$. The substituent possessed by $R^{12}$ includes those mentioned for the substituent of $R^{11}$.

$X^0$ represents —$SO_2$—, —CO—, —COCO—, —CO—O—, CON($R^{13}$)—, —COCO—O—, —COCO—N($R^{13}$)— or —$SO_2$—N($R^{13}$)—, in which $R^{13}$ represents a hydrogen atom or a group represented by $R^{12}$ that is defined above.

Among those groups, —CO—, —CON($R^{13}$)—, and —CO—O— are preferable, and —CON($R^{13}$)— is particularly preferable for giving the particularly excellent color-forming property.

Out of the compounds represented by formula (III), the compounds represented by formula (IV) or (V) are preferable, the compounds represented by formula (VI) or (VII) are more preferable, the compounds represented by formula (VIII) or (IX) are further more preferable.

Compounds represented by formulae (IV) to (IX) are described in detail below.

In formulae (IV) and (V), $Z^1$ represents an acyl group, a carbamoyl group, an alkoxycarbonyl group, or an aryloxycarbonyl group, and $Z^2$ represents a carbamoyl group, an alkoxycarbonyl group, or an aryloxycarbonyl group. Preferably the acyl group has 1 to 50 carbon atoms, and more preferably 2 to 40 carbon atoms. Specific examples include an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl)propanoyl group.

With respect to the case wherein $Z^1$ and $Z^2$ each represent a carbamoyl group, a description is made in detail in formulas (VIII) to (IX).

Preferably the alkoxycarbonyl group and the aryloxycarbonyl group each have 2 to 50 carbon atoms, and more preferably 2 to 40 carbon atoms. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 2-dodecyloxyphenoxycarbonyl group.

$X^1$, $X^2$, $X^3$, $X^4$, and $X^5$ each represent a hydrogen atom or a substituent. Examples of the substituent include a straight-chain or branched, chain or cyclic alkyl group having 1 to 50 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl, and dodecyl); a straight-chain or branched, chain or cyclic alkenyl group having 2 to 50 carbon atoms (e.g. vinyl, 1-methylvinyl, and cyclohexen-1-yl); an alkynyl group having 2 to 50 carbon atoms in all (e.g. ethynyl and 1-propinyl), an aryl group having 6 to 50 carbon atoms (e.g. phenyl, naphthyl, and anthryl), an acyloxy group having 1 to 50 carbon atoms (e.g. acetoxy, tetradecanoyloxy, and benzoyloxy), a carbamoyloxy group having 1 to 50 carbon atoms (e.g. N,N-dimethylcarbamoyloxy), a carbonamido group having 1 to 50 carbon atoms (e.g. formamido, N-methylacetamido, acetamido, N-methylformamido, and benzamido), a sulfonamido group having 1 to 50 carbon atoms (e.g. methanesulfonamido, dodecansulfonamido, benzenesulfonamido, and p-toluenesulfonamido), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl, N,N-diethylsulfamoyl, and N-methyl-N-(4-methoxyphenyl) sulfamoyl), an alkoxy group having 1 to 50 carbon atoms (e.g. methoxy, propoxy, isopropoxy, octyloxy, t-octyloxy, dodecyloxy, and 2-(2,4-di-t-pentylphenoxy)ethoxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and naphthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), an alkylsulfonyl group having 1 to 50 carbon atoms (e.g. methanesulfonyl, octylsulfonyl, 2-methoxyethylsulfonyl, and 2-hexyldecylsulfonyl), an arylsulfonyl group having 6 to 50 carbon atoms (e.g. benzenesulfonyl, p-toluenesulfonyl, and 4-phenylsulfonylphenylsulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, anilino, and morpholino), a cyano group, a nitro group, a carboxyl group, a hydroxyl group, a sulfo group, a mercapto group, an alkylsulfinyl group having 1 to 50 carbon atoms (e.g. methanesulfinyl and octanesulfinyl), an arylsulfinyl having 6 to 50 carbon atoms (e.g. benzenesulfinyl, 4-chlorophenylsulfinyl, and p-toluenesulfinyl), an alkylthio group having 1 to 50 carbon atoms (e.g. methylthio, octylthio, and cyclohexylthio), an arylthio group having 6 to 50 carbon atoms (e.g. phenylthio and naphthylthio), a ureido group having 1 to 50 carbon atoms (e.g. 3-methylureido, 3,3-dimethylureido, and 1,3-diphenylureido), a heterocyclic group having 2 to 50 carbon atoms (e.g. a 3-membered to 12-membered monocyclic ring or condensed ring having at least one hetero atom(s), such as nitrogen, oxygen, and sulfur, for example, 2-furyl, 2-pyranyl, 2-pyridyl, 2-thienyl, 2-imidazolyl, morpholino, 2-quinolyl, 2-benzimidazolyl, 2-benzothiazolyl, and 2-benzoxazolyl), an acyl group having 1 to 50 carbon atoms (e.g. acetyl, benzoyl, and trifluoroacetyl), a sulfamoylamino group having 0 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl, and triphenylsilyl), and a halogen atom (e.g. a fluorine atom, a chlorine atom, and a bromine atom). The above substituents may further have a substituent, and examples of such a substituent include those mentioned above. Further, $X^1$, $X^2$, $X^3$, $X^4$, and $X^5$ may bond together to form a condensed ring. As a condensed ring, a 5- to 7-membered ring is preferable, and a 5- or 6- membered ring is more preferable.

The number of carbon atoms of the substituent is preferably 50 or below, more preferably 42 or below, and most preferably 34 or below, and there is preferably 1 or more carbon atom(s).

With respect to $X^1$, $X^2$, $X^3$, $X^4$, and $X^5$ in formulae (IV), the sum of the Hammett substituent constant σp values of $X^1$, $X^3$, and $X^5$ and the Hammett substituent constant σm values of $X^2$ and $X^4$ is 0.80 or more but 3.80 or below. $X^6$, $X^7$, $X^8$, $X^9$, and $X^{10}$ in formula (VIII) each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, which may have a substituent and may bond together to form a condensed ring. Specific examples of $X^6$ through $X^{10}$ are the same as those described for $X^1$, $X^2$, $X^3$, $X^4$, and $X^5$. However, in formula (VIII), the sum of the Hammett substituent constant σp values of $X^6$, $X^8$, and $X^{10}$ and the Hammett substituent constant σm values of $X^7$ and $X^9$ is 1.20 or more but 3.80 or below, more preferably 1.50 or more but 3.80 or below, and further more preferably 1.70 or more but 3.80 or below.

Herein, if the sum of the σp values and the σm values is less than 0.80, the problem arises that the color formation is unsatisfactory, while if the sum of the σp values and the σm values is over 3.80, the synthesis and availability of the compounds themselves become difficult.

Parenthetically, Hammett substituent constants σp and σm are described in detail in such books as "Hammett no Hosoku/Kozo to Hannousei," written by Naoki Inamoto (Maruzen); "Shin-jikken Kagaku-koza 14/Yukikagoubutsu no Gosei to Hanno V," page 2605 (edited by Nihonkagakukai, Maruzen); "Riron Yukikagaku Kaisetsu," written by Tadao Nakaya, page 217 (Tokyo Kagakudojin); and "Chemical Review" (Vol. 91), pages 165 to 195 (1991).

$R^{1a}$ and $R^{2a}$ in formulae (VI) and (VII), and $R^{4a}$ and $R^{5a}$ in formulae (VIII) and (IX), each represent a hydrogen atom or a substituent, and specific examples of the substituent are the same as those described for $X^1$, $X^2$, $X^3$, $X^4$, and $X^5$; preferably each represents a hydrogen atom, a substituted or unsubstituted alkyl group having 1 to 50 carbon atoms, a substituted or unsubstituted aryl group having 6 to 50 carbon atoms, or a substituted or unsubstituted heterocyclic group having 1 to 50 carbon atoms, and more preferably at least one of $R^{1a}$ and $R^{2a}$, and at least one of $R^{4a}$ and $R^{5a}$, are each a hydrogen atom.

In formulae (V) and (VII), R represents a heterocyclic group. Herein, a preferable heterocyclic group has 1 to 50 carbon atoms, and the heterocyclic group contains at least one hetero atom, such as a nitrogen atom, an oxygen atom, and a sulfur atom, and further the heterocyclic group is a saturated or unsaturated 3-membered to 12-membered (preferably 3-membered to 8-membered) monocyclic or condensed ring. Specific examples of the heterocyclic ring include furan, pyran, pyridine, thiophene, imidazole, quinoline, benzimidazole, benzothiazole, benzoxazole, pyrimidine, pyrazine, 1,2,4-thiadiazole, pyrrole, oxazole, thiazole, quinazoline, isothiazole, pyridazine, indole, pyrazole, triazole, and quinoxaline. These heterocyclic groups may have a substituent, and preferably they have one or more electron-attracting groups. Herein, the term "an electron-attracting group" means one wherein the Hammett σp value is a positive value. When the color-forming reducing agent for use in the present invention is built in a light-sensitive material, preferably at least one of $Z^1$, $Z^2$, $R^{1a}$ to $R^{5a}$, and $X^1$ to $X^{10}$, has a ballasting group.

Examples of a heterocycle completed with $Q_1$ can be found in the specific compound examples I-16 to I-74.

Next, specific examples of the color-forming reducing agent represented by formula (III) are shown, but the scope of the present invention is not limited to these.

I-1

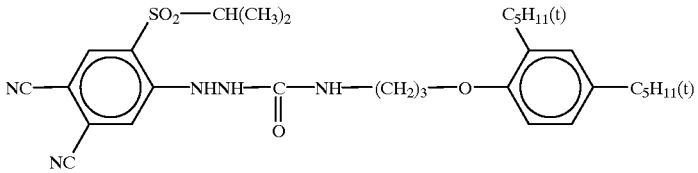

I-2

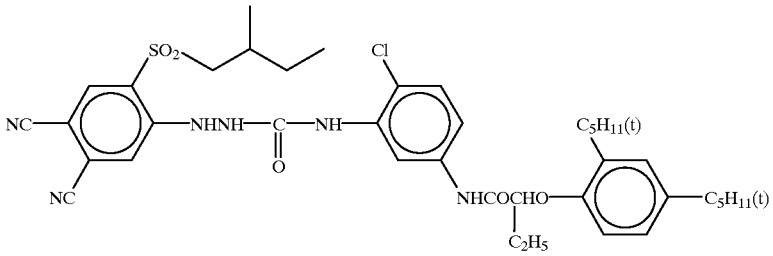

I-3

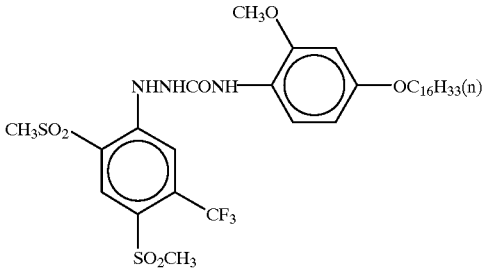

I-4

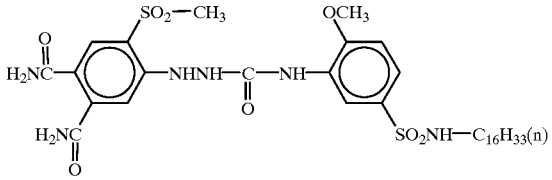

I-5

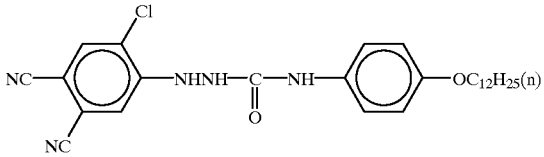

I-6

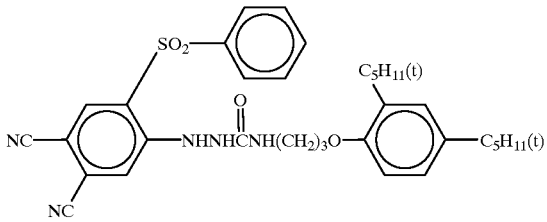

I-7

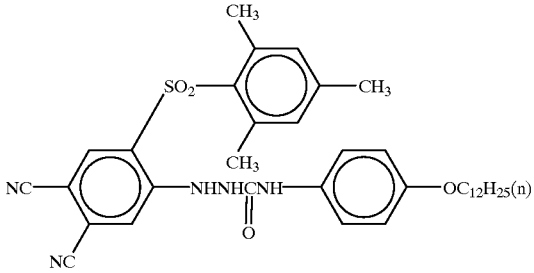

I-8

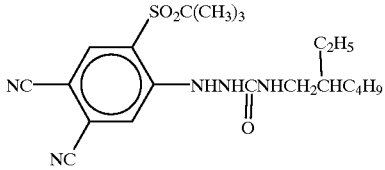

-continued
I-9
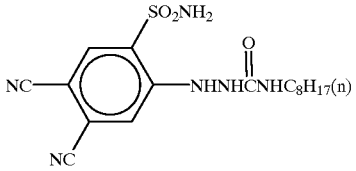
I-10
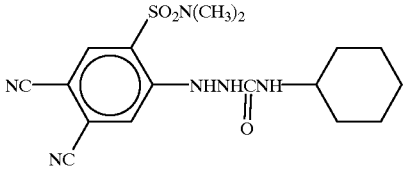
I-11
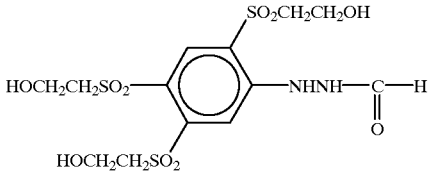
I-12
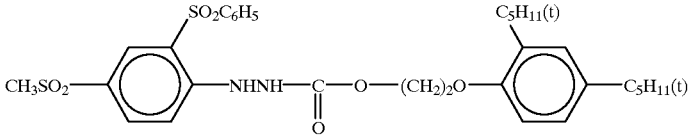
I-13
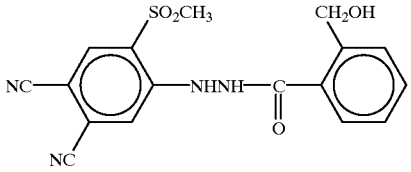
I-14
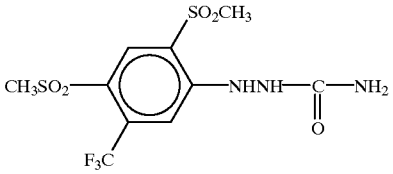
I-15
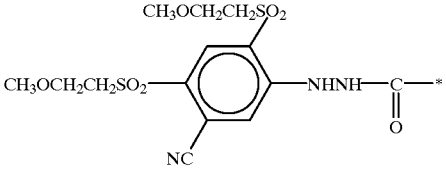
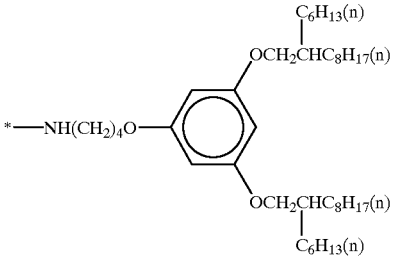
I-16
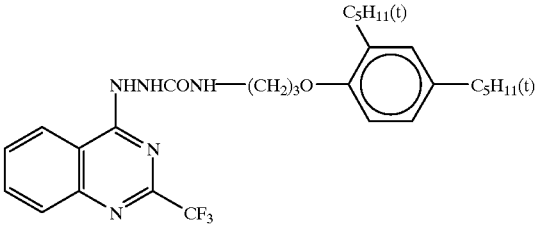
I-17
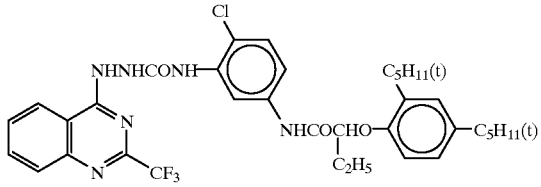
I-18
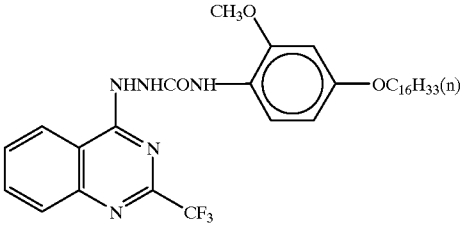

-continued
I-19
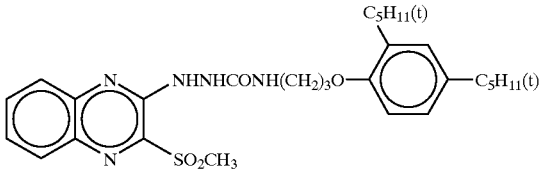
I-20
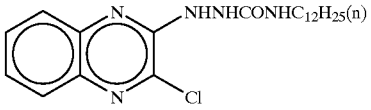
I-21
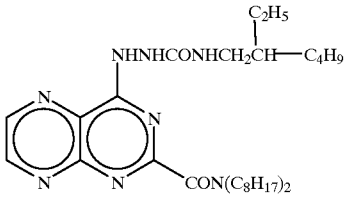
I-22
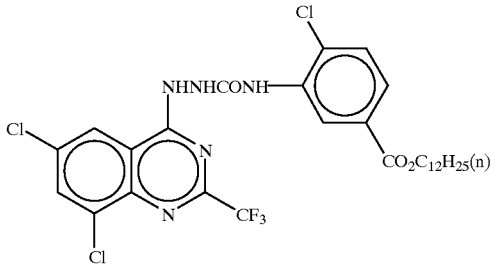
I-23
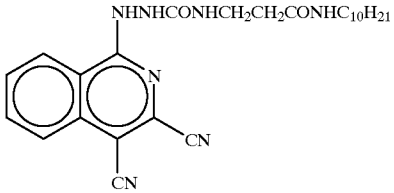
I-24
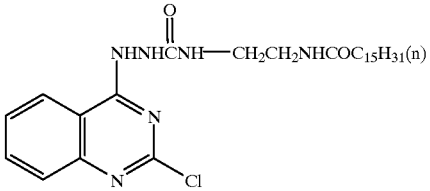
I-25
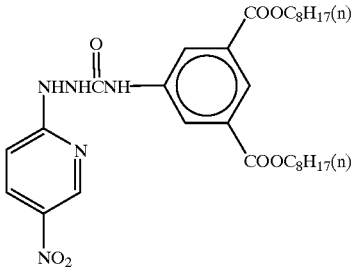
I-26
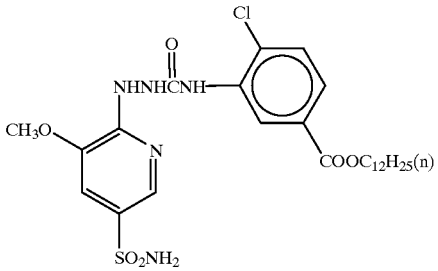
I-27
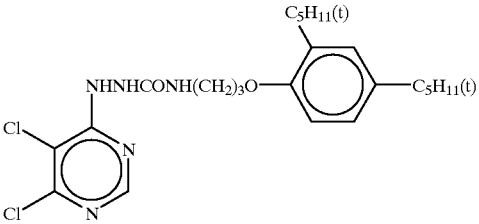
I-28
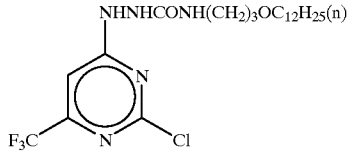
I-29
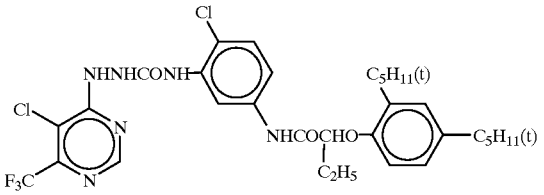
I-30
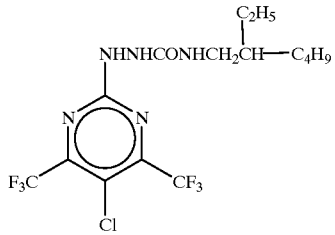

-continued
I-31
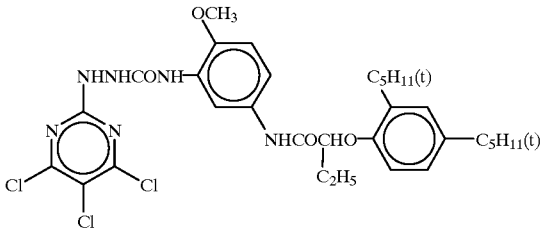
I-32
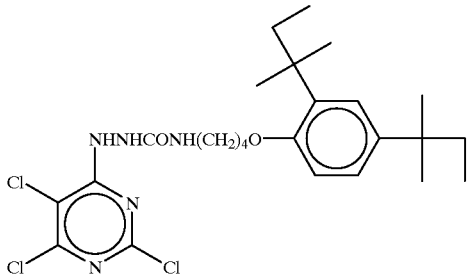
I-33
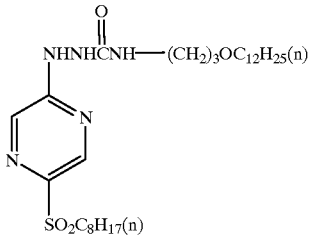
I-34
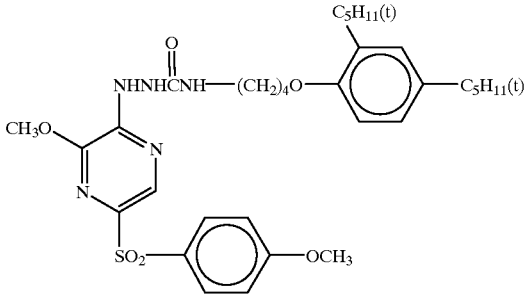
I-35
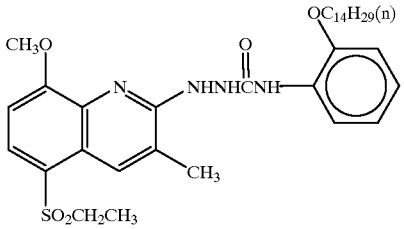
I-36
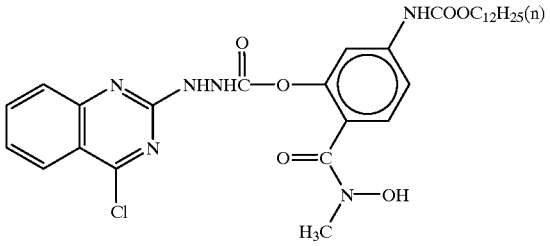
I-37
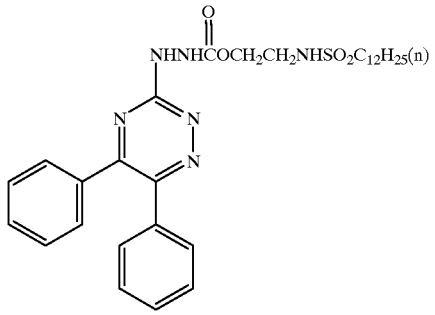
I-38
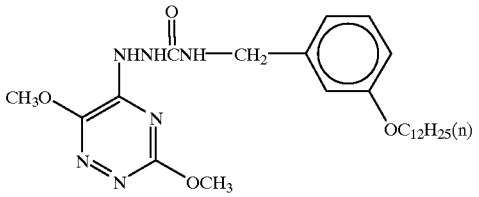
I-39
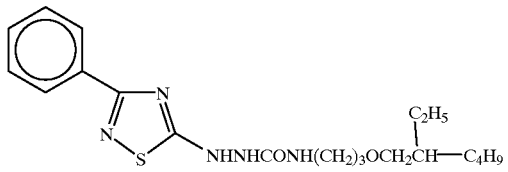
I-40
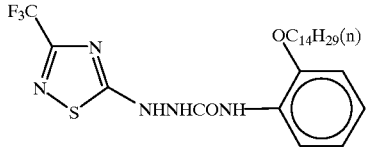
I-41
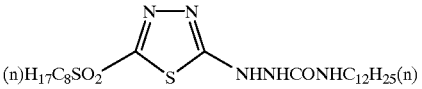
I-42
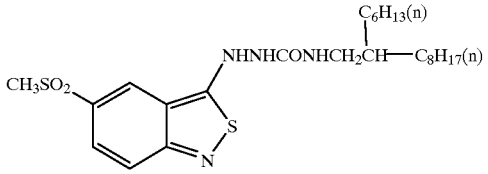

-continued
I-43
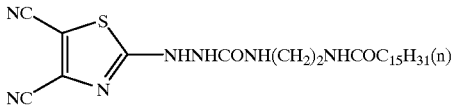
I-44
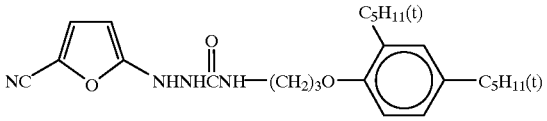
I-45
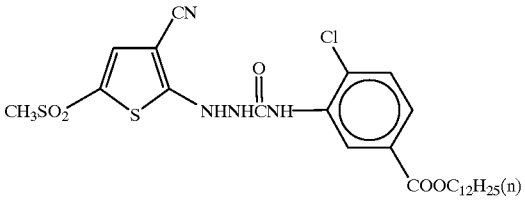
I-46
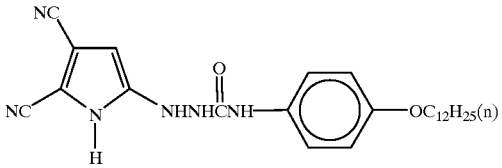
I-47
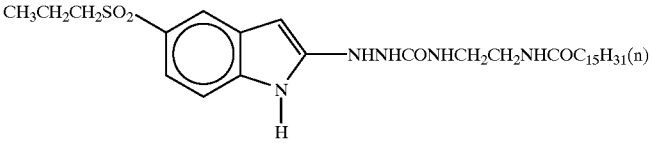
I-48
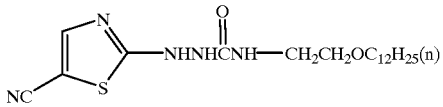
I-49
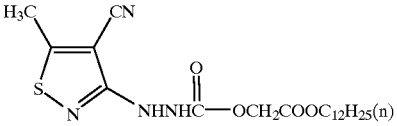
I-50
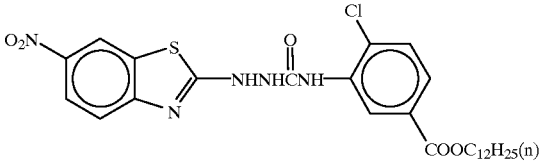
I-51
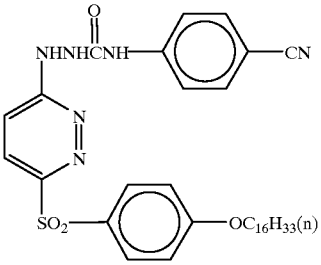
I-52
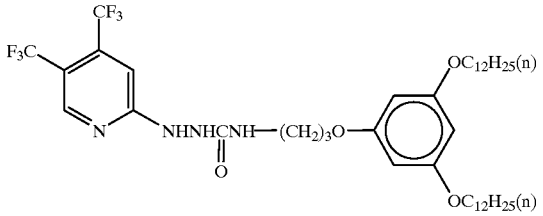
I-53
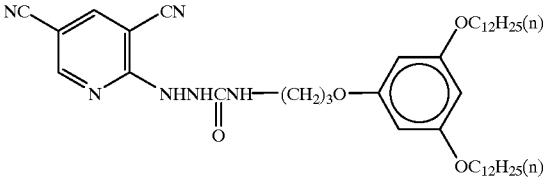
I-54
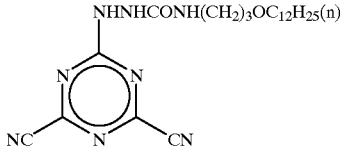
I-55
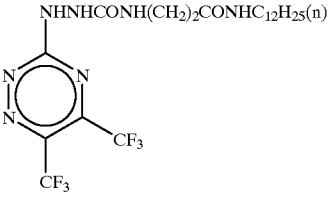

-continued
I-56
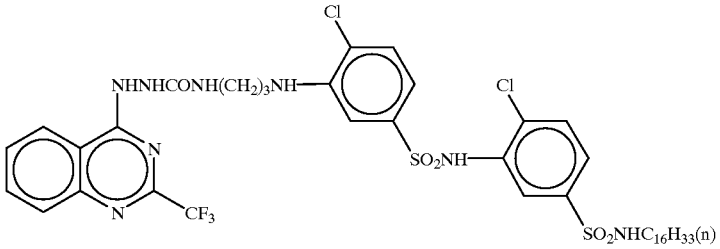
I-57
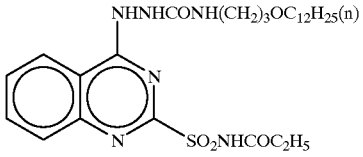
I-58
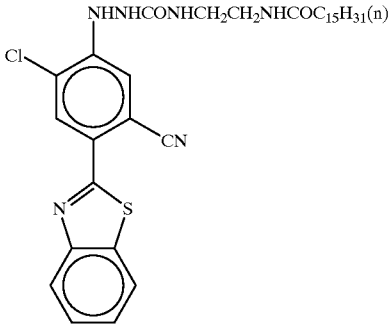
I-59
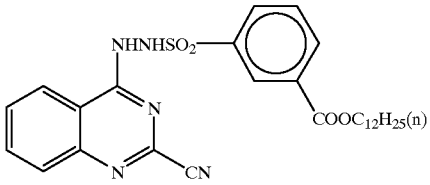
I-60
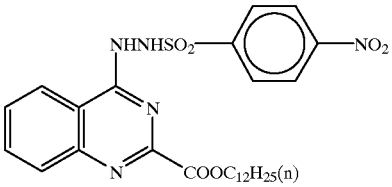
I-61
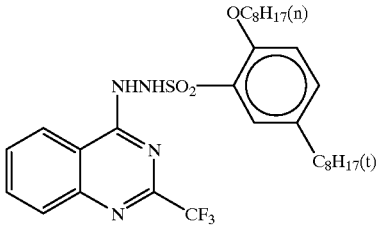
I-62
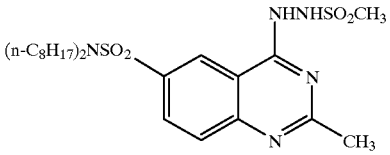
I-63
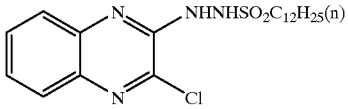
I-64
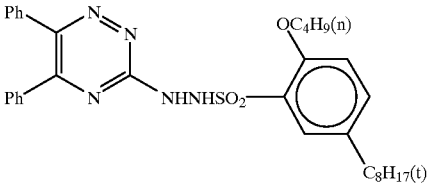
I-65
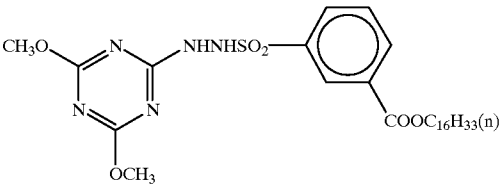
I-66
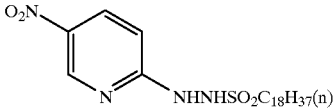

-continued
I-67
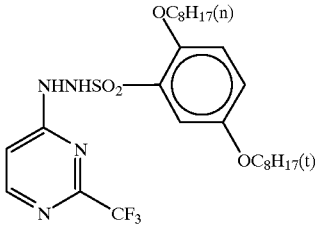
I-68
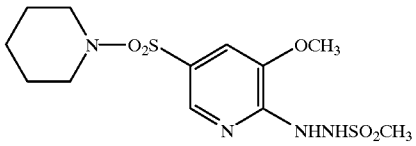
I-69
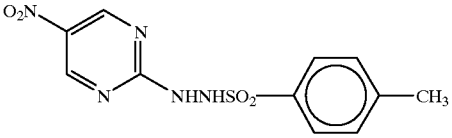
I-70
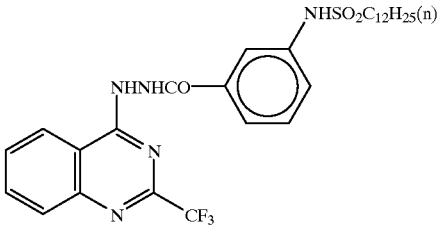
I-71
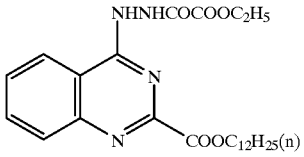
I-72
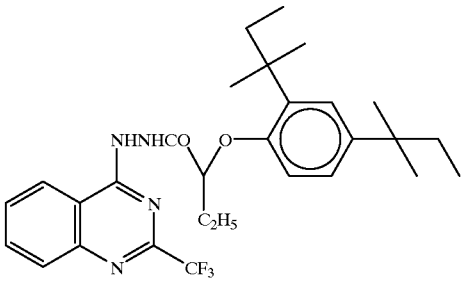
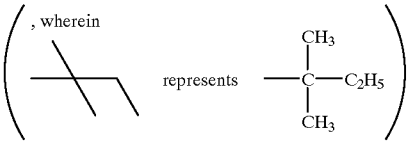
I-73
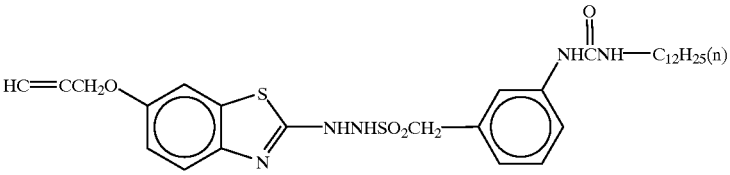
I-74
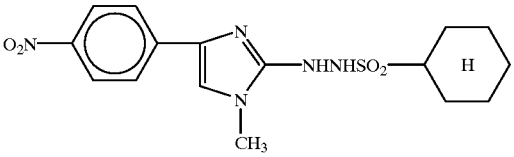
I-75
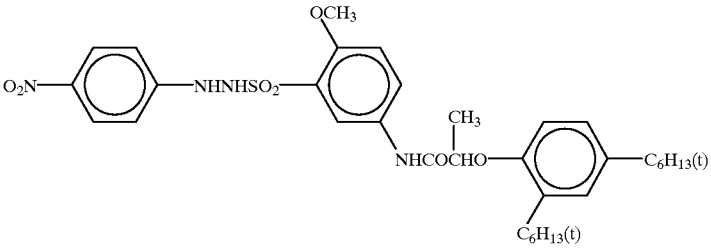

-continued

I-76

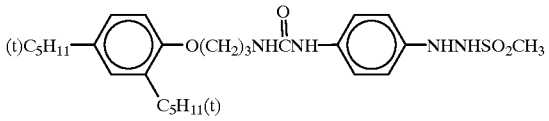

I-77

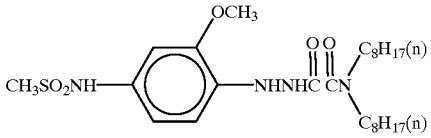

I-78

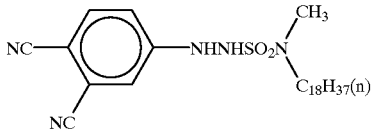

I-79

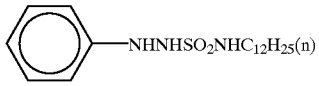

I-80

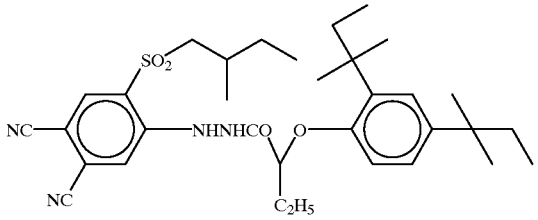

I-81

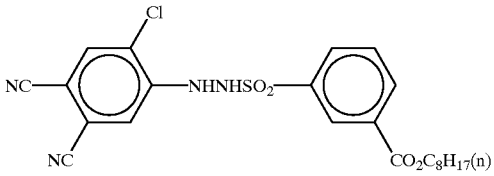

I-82

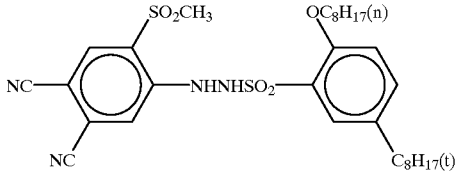

I-83

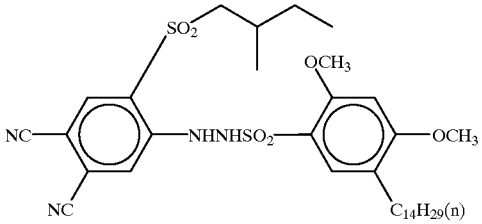

I-84

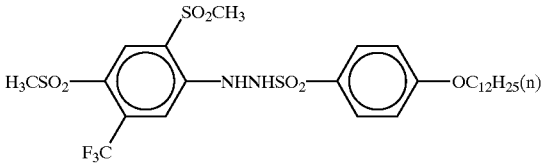

In the present invention, the compound(s) represented by formula (I) or (II), and the compound(s) represented by formula (III), may be incorporated in the same light-sensitive material.

In this case, these compound may be added to separate layers, or to the same layer. Further, the ratio of these compounds to be used is not limited.

Next, the compound represented by formula (X) is explained in detail.

In formula (X), Ar is a substituted or unsubstituted aryl group, or a substituted or unsubstituted heterocyclic group. As the aryl group, preferably those having 6 to 30 carbon atoms and specifically a phenyl group, a naphthyl group, and the like, can be mentioned. Further, as the heterocyclic group, preferably those that are 3- to 8-membered and have at least one oxygen atom, nitrogen atom, or sulfur atom as the hetero atom in the atoms constituting the ring, can be mentioned. The heterocyclic group may form a condensed ring with another aromatic ring, and specifically a 2-pyridyl group, a 2-furyl group, a 2-benzoxazolyl group, a 2-thienyl group, and the like can be mentioned. As Ar, a phenyl group is particularly preferable.

Examples of the substituent processed in Ar include a hydroxyl group, a cyano group, a carboxyl group, a halogen atom (e.g., fluorine, chlorine, and bromine), a straight-chain or branched alkyl group preferably having 1 to 60 carbon atoms (e.g., methyl, ethyl, propyl, isopropyl, t-butyl, 2-ethylhexyl, nonyl, undecyl, pentadecyl, n-hexadecyl, and 3-decaneamidopropyl), a cycloalkyl group preferably having 3 to 60 carbon atoms (e.g., cyclopropyl, 1-ethylcyclopropyl, cyclopentyl, and cyclohexyl), an aryl group preferably having 6 to 30 carbon atoms (e.g., phenyl and naphthyl), a heterocyclic group preferably having 2 to 60 carbon atoms (a 3- to 8-membered monocyclic ring or condensed ring, which has at least one oxygen atom, nitrogen atom, or sulfur atom as the hetero atom, e.g., 2-pyridyl, 2-furyl, 2-benzoxazolyl, and 2-thienyl), an alkoxy group preferably having 1 to 60 carbon atoms (e.g., methoxy, ethoxy, butoxy, n-octyloxy, hexadecyloxy, and 2-methoxyethoxy), an aryloxy group preferably having 6 to 60 carbon atoms (e.g., phenoxy, 2,4-t-amylphenoxy, 4-t-butylphenoxy, and naphthoxy), an acyloxy group preferably having 6 to 60 carbon atoms (e.g., benzoyloxy, octanoyloxy, 2-hexadecanoyloxy, and 2-(2',4'-di-t-amylphenoxy) butanoyloxy), an acylamino group preferably having 2 to 60 carbon atoms (e.g., acetylamino, n-butanoylamino, octanoylamino, 2-hexadecanoylamino, 2-(2',4'-di-t-amylphenoxy)butanoylamino, benzoylamino, and nicotinoylamino), a sulfonylamino group preferably having 1 to 60 carbon atoms (e.g., methanesulfonylamino and phenylsulfonylamino), another amino group preferably having 0 to 60 carbon atoms (e.g., an unsubstituted amino group, a monoalkylamino group, a dialkylamino group, an arylamino group, and an alkylarylamino group, and specifically unsubstituted amino, diethylamino, n-octylamino, 3-(2',4'-di-t-amylphenoxy)propylamino, and morpholino), an alkylthio group preferably having 1 to 60 carbon atoms (e.g, methylthio, ethylthio, butylthio, and hexadecylthio), an arylthio group preferably having 6 to 60 carbon atoms (e.g., phenylthio and 4-dodecyloxyphenylthio), an acyl group preferably having 1 to 60 carbon atoms (e.g., acetyl, benzoyl, butanoyl, and dodecanoyl), a sulfonyl group preferably having 1 to 60 carbon atoms (e.g., methanesulfonyl, butanesulfonyl, and toluenesulfonyl), an alkoxycarbonyl group preferably having 2 to 60 carbon atoms (e.g., ethoxycarbonyl, hexyloxycarbonyl, and dodecyloxycarbonyl), an aryloxycarbonyl group preferably having 7 to 30 carbon atoms (e.g., phenoxycarbonyl and naphthyloxycarbonyl), a carbamoyl group preferably having 1 to 60 carbon atoms (e.g., N,N-dicyclohexylcarbamoyl), and a sulfamoyl group preferably having 0 to 60 carbon atoms (e.g., N,N-dimethylsulfamoyl).

Among these substituents, preferable ones are a hydroxyl group, an alkyl group, an alkoxy group, an aryloxy group, an acylamino group, and a sulfonylamino group, particular preferable ones are a hydroxyl group, an alkoxy group, and a sulfonylamino group.

If possible, these substituents may bond together to form a ring. Further, if possible, these substituents may have further a substituent, and examples of the substituent includes those enumerated as a substituent on the above Ar group, and it is preferably an alkyl group, an alkoxy group, an aryloxy group, an acyl group, an alkoxycarbonyl group, an aryloxycarbonyl group, a carbamoyl group, a sulfonyl group, a sulfamoyl group, a cyano group, a carboxyl group, or a hydroxyl group, and particularly preferably an alkyl group, an alkoxy group, or an alkoxycarbonyl group.

Preferably at least one of substituents on the Ar group has a ballasting group built therein, which ballasting group is usually used in a nondiffusing photographic additive, such as a coupler. The ballasting group is a group inactive on photographic property. Examples of the ballasting group include an alkyl group, an alkoxy group, an aryl group, and an aryloxy group, each of which has 8 or more carbon atoms; or alternatively, it can be chosen among the combination of the above groups and an amido group, a ureido group, a sulfonamido group, an ester group, a sulfonyl group, an acyl group, and the like, or a combination of these, or a combination thereof with a hydroxyl group or the like.

In formula (X), X is a substituted or unsubstituted methylene group, and the substituent thereof includes those on the Ar group described above. With respect to the position where X is bonded to Ar, when the Ar group is an aryl ring, the position is the ortho position or the para position with respect to the formyl group, while when the Ar group is a heterocyclic ring, the position is the 2-position or the 4-position with it being assumed that the position of the formyl group is the 1-position; and the positional relationship of X on the Ar group is such that after the formyl group is converted to a hydroxyl group, the color-developing agent (PPD) may be released by electron transfer.

L represents a linking group, examples of which include a known timing group, such as the group

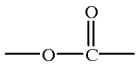

described in DE-A-2 803 145. In the case of this group, the (—O) atom bonds to the releasable compound (OHC—Ar—X—), and the carbon atom bonds to the hetero atom in the color-developing agent (PPD), to link the releasable compound to the color-developing agent. Further, there can be mentioned, for example, a group as described in DE-A-2 855 697 that, when released from the color-developing agent precursor of formula (X), undergoes an intramolecular nucleophilic reaction, to release the color-developing agent; and a group as described in DE-A-3 105 026 that, after being released from the color-developing agent precursor of formula (X), allows electron transfer to take place along the conjugated system, to release the color-developing agent. Further, L may represent a group that, when released from the compound of formula (X), itself can take part in a coupling reaction or a redox reaction, to release PPD, imagewise, by a coupling reaction with a nucleophilic agent released imagewise as a result of the reaction, or by an imagewise redox reaction with a silver halide.

m is an integer of 0 to 3, with preference given to 1 or 2.

PPD represents a group to give a color-developing agent, and as the color-developing agent, a p-phenylenediamine derivative is preferable. Preferable examples include p-phenylenediamine derivatives described in JP-A-4-249244, from page 7, left column, line 23, to right column, line 16, and in JP-A-4-443, from page 4, right lower column, line 7, to page 6, line 20, and preferable specific examples include N,N-diethyl-p-phenylenediamine, 4-amino-N,N-diethyl-3-methylaniline, 4-amino-N-(β-hydroxyethyl)-N-methylaniline, 4-amino-N-ethyl-N-(β-hydroxyethyl ) aniline, 4-amino-N-ethyl-N-(β-hydroxyethyl)-3-methylaniline, 4-amino-N-ethyl-N-(3-hydroxypropyl)-3-methylaniline, 4-amino-N-ethyl-N-(4-hydroxybutyl)-3-methylaniline, 4-amino-N-ethyl-N-(β-methanesulfonamidoethyl)-3-methylaniline, 4-amino-N,N-diethyl-3-(β-hydroxyethyl)aniline, 4-amino-N-ethyl-N-(β-methoxyethyl)-3-methylaniline, 4-amino-N-(β-ethoxyethyl)-N-ethyl-3-methylaniline, 4-amino-N-(3-carbamoylpropyl)-N-n-propyl-3-methylaniline, 4-amino-N-(3-carbamoylbutyl)-N-n-propyl-3-methylaniline, N-(4-amino-3-methylphenyl)-3-hydroxypyrrolidine, N-(4-amino-3-methylphenyl)-3-(hydroxymethyl)pyrrolidine, and N-(4-amino-3-methylphenyl)-3-pyrrolidinecarboxamide; among the above p-phenylenediamine derivatives, preferable ones are 4-amino-N-ethyl-N-(β-methanesulfonamidoethyl)-aniline, 4-amino-N-ethyl-N(β-hydroxyethyl)-3-methylaniline, 4-amino-N-ethyl-N-(3-hydroxylpropyl)-3-methylaniline and 4-amino-N-ethyl-N-(4-hydroxybutyl)-3-methylaniline.

Among the compounds represented by formula (X), preferable compounds are ones represented by formula (XI).

In formula (XI), L and PPD have the same meanings to those of formula (X). As a group represented by R, substituents mentioned for the substituent in formula (X) can be applied. Preferably, R represents a hydroxyl group, an alkyl group, an aryl group, an alkoxy group, an aryloxy group, an acyloxy group, an acylamino group, a sulfonylamino group, or another amino group, and particularly preferably, R represents a hydroxyl group, an alkyl group, an alkoxy group, an acylamino group, or another amino group. —$CH_2$— represents a methylene group positioned at the ortho or para position with respect to the formyl group. l is an integer, and preferably, l is 0 or 1. n is an integer of 1 to 4, and preferably n is 1 or 2.

Among the compounds represented by formula (XI), preferable compounds are ones represented by formula (XII).

In formula (XII), $R^1$ represents an alkyl group, an aryl group, or an acyl group, R and PPD have the same meanings to those of formula (XI), and r is an integer of 0 to 2. —$CH_2$— represents a methylene group positioned at the ortho or para position with respect to the formyl group.

Specific examples of the compound included in formula (X) for use in the present invention are shown below, but the present invention is not limited to them.

(P-1)

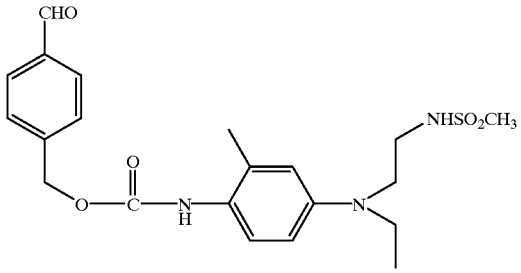

(P-2)

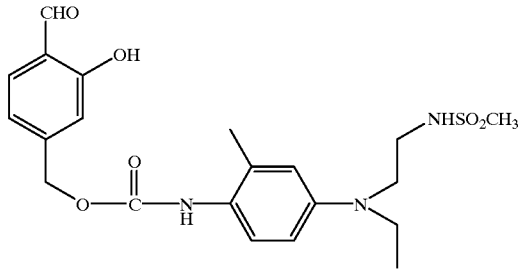

(P-3)

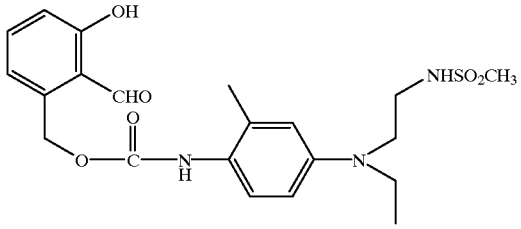

(P-4)

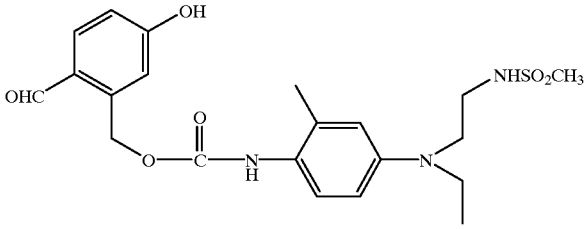

(P-5)

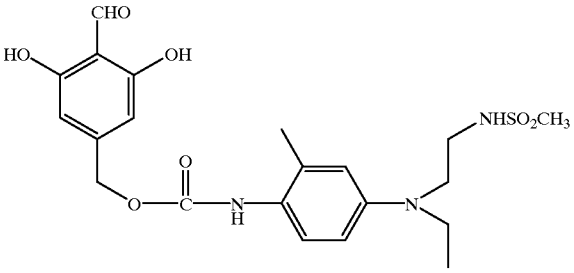

(P-6)

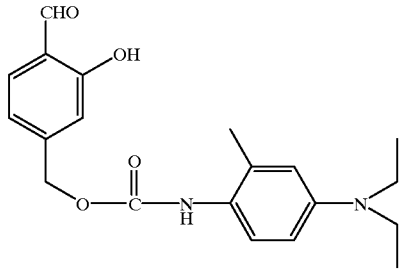

(P-7)

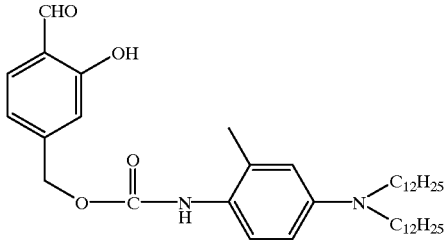

(P-8)

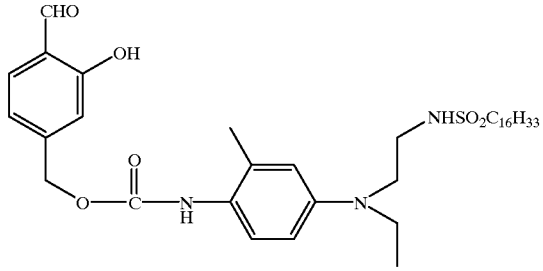

-continued
(P-9)
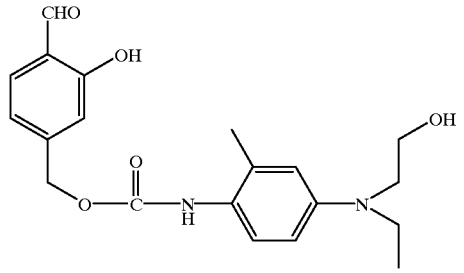
(P-10)
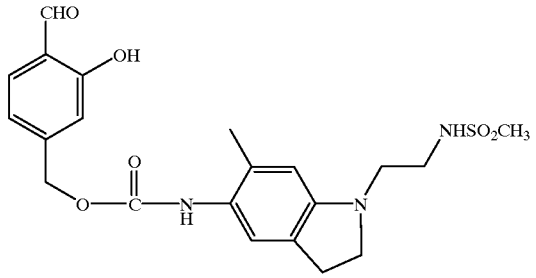
(P-11)
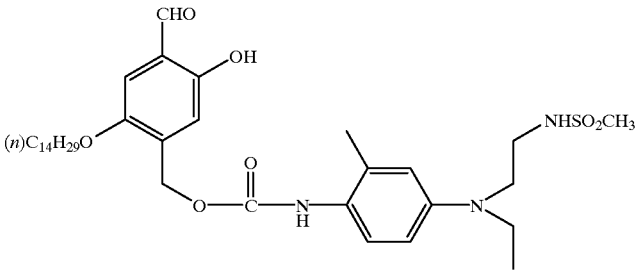
(P-12)
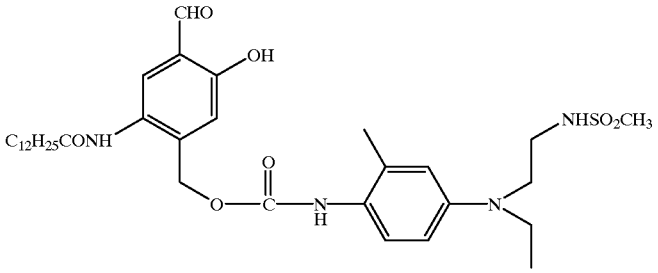
(P-13)
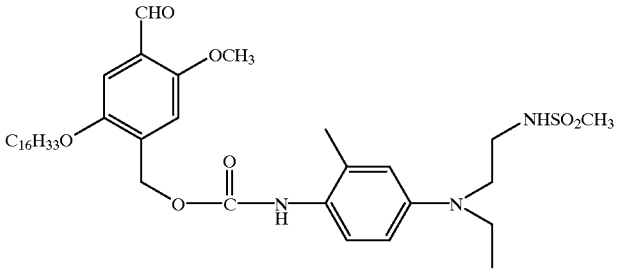
(P-14)
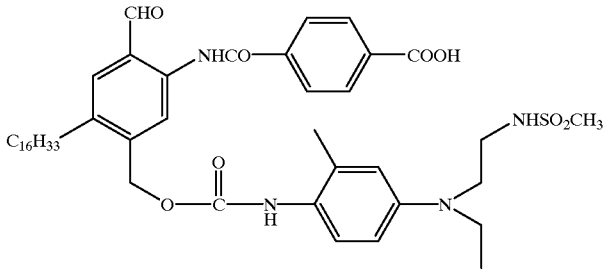

-continued
(P-15)
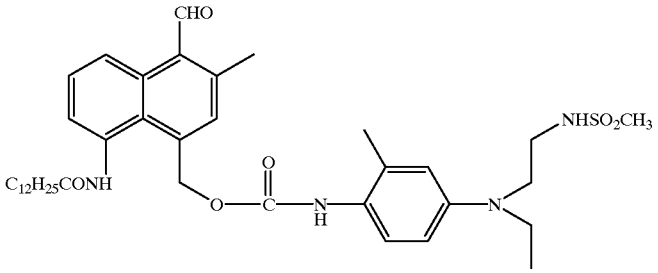
(P-16)
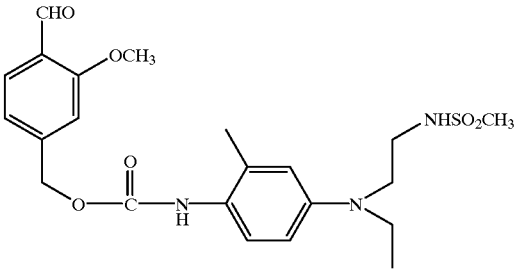
(P-17)
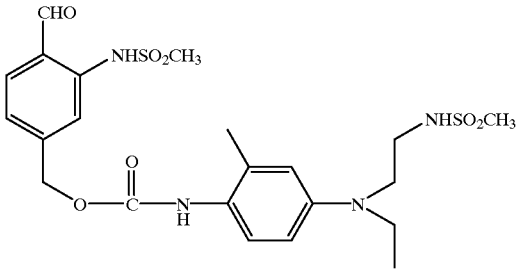
(P-18)
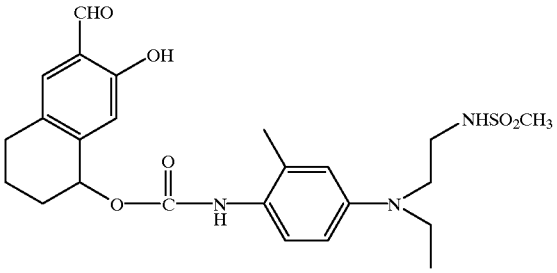
(P-19)
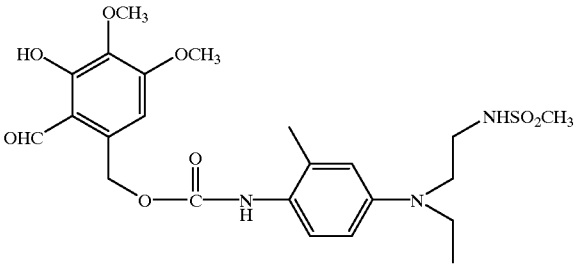
(P-20)
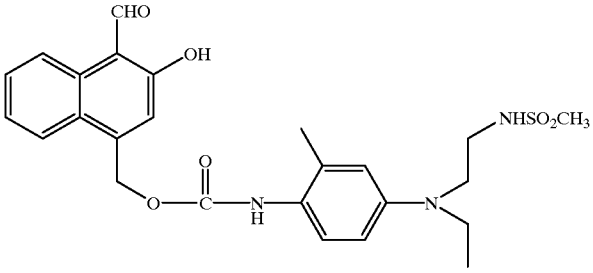
(P-21)
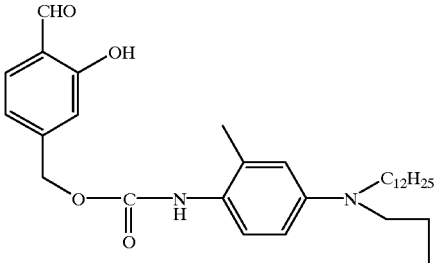
(P-22)
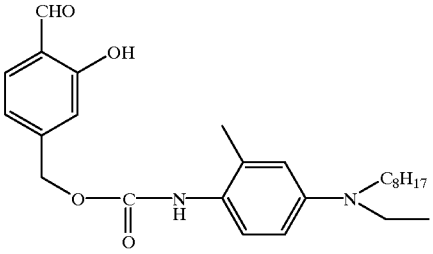

-continued (P-23)

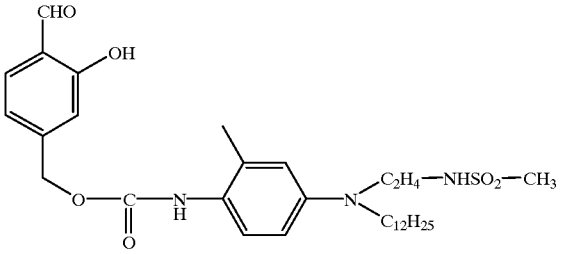

(P-24)

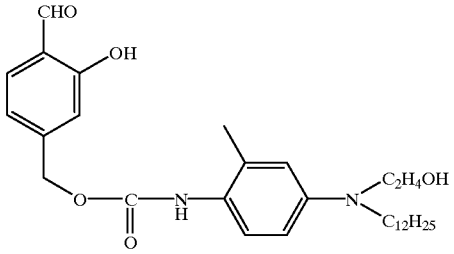

(P-25)

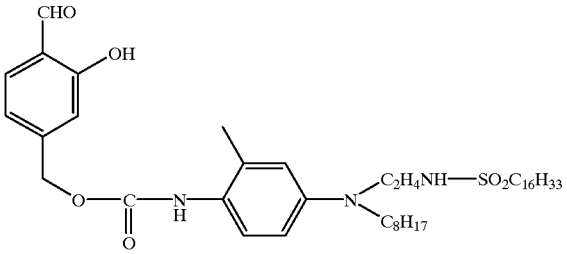

(P-26)

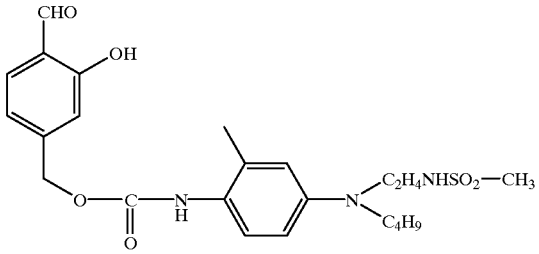

As couplers that are preferably used in the present invention, compounds having structures described by the following formulae (1) to (12) are mentioned. They are compounds collectively generally referred to as active methylenes, pyrazolones, pyrazoloazoles, phenols, naphthols, and pyrrolotriazoles, respectively, which are compounds known in the art.

(1)

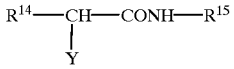

(2)

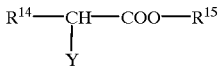

(3)

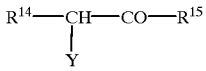

(4)

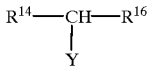

(5)

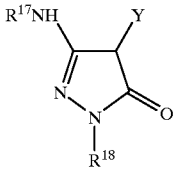

(6)

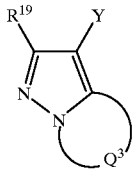

-continued (7)

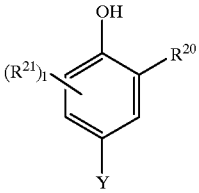

(8)

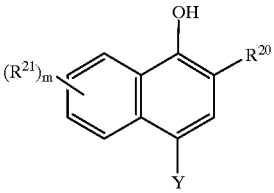

(9)

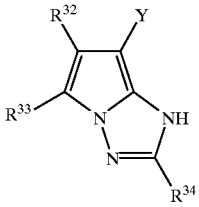

(10)

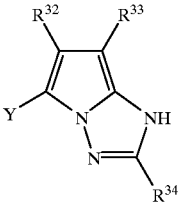

-continued (11)

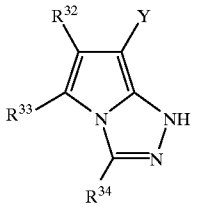

(12)

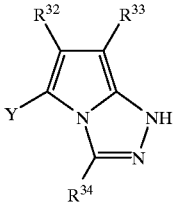

Formulae (1) to (4) represent couplers that are called active methylene couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, optionally substituted.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$, and $R^{16}$ include those mentioned for the above $X^1$ to $X^5$.

In formulae (1) to (4), Y represents a hydrogen atom or a group capable of coupling split-off by coupling reaction with the oxidation product of the color-forming reducing agent. Examples of Y include a heterocyclic group (a saturated or unsaturated 5-membered to 7-membered monocyclic or condensed ring having as a hetero atom at least one nitrogen atom, oxygen atom, sulfur atom, or the like, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzthiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyoxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenoxylcarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamide group (e.g. methanesulfonamido and benzenesulfonamido), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), an arylazo group (e.g. phenylazo and naphthylazo), and a carbamoylamino group (e.g. N-methylcarbamoylamino).

Y may be substituted with a substituent, and examples of the substituent that may be possessed by Y include those mentioned for $X^1$ to $X^5$.

Preferably Y represents a halogen atom, an aryloxy group, a heterocyclic oxy group, an acyloxy group, an aryloxycarbonyloxy group, an alkoxycarbonyloxy group, or a carbamoyloxy group.

In formulae (1) to (4), $R^{14}$ and $R^{15}$, and $R^{14}$ and $R^{16}$, may bond together to form a ring.

Formula (5) represents a coupler that is called a 5-pyrazolone coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R^{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom. Y has the same meaning as defined above.

Preferably $R^{18}$ represents a substituted phenyl group, such as a 2,4,6-trichlorophenyl group, a 2,5-dichlorophenyl group, and a 2-chlorophenyl group.

Formula (6) represents a coupler that is called a pyrazoloazole coupler, and, in the formula, $R^{19}$ represents a hydrogen atom or a substituent. $Q^3$ represents a group of nonmetal atoms required to form a 5-membered azole ring containing 2 to 4 nitrogen atoms, which azole ring may have a substituent (including a condensed ring).

Preferable pyrazoloazole couplers represented by formula (6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituents of the azole rings represented by the substituents $R^{19}$ and $Q^3$ are described, for example, in U.S. Pat. No. 4,540,654, the second column, line 41, to the eighth column, line 27. Preferable pyrazoloazole couplers are pyrazoloazole couplers having a branched alkyl group directly bonded to the 2-, 3-, or 6-position of the pyrazolotriazole group, as described in JP-A-61-65245; pyrazoloazole couplers containing a sulfonamide group in the molecule, as described in JP-A-61-65245; pyrazoloazole couplers having an alkoxyphenylsulfonamido ballasting group, as described in JP-A-61-147254; pyrazolotriazole couplers having an alkoxy group or an aryloxy group at the 6-position, as described in JP-A-62-209457 or 63-307453; and pyrazolotriazole couplers having a carbonamido group in the molecule, as described in JP-A-2-201443. Y has the same meaning as defined above.

Formulae (7) and (8) are respectively called phenol couplers and naphthol couplers, and in the formulae $R^{20}$ represents a hydrogen atom or a group selected from the group consisting of —$CONR^{22}R^{23}$, —$SO_2NR^{22}R^{23}$, —$NHCOR^{22}$, —$NHCONR^{22}R^{23}$, and —$NHSO_2NR^{22}R^{23}$. $R^{22}$ and $R^{23}$ each represent a hydrogen atom or a substituent. In formulae (7) and (8), $R^{21}$ represents a substituent, 1 is an integer selected from 0 to 2, and m is an integer selected from 0 to 4. When 1 and m are 2 or more, $R^{21}$'s may be different. The substituents of $R^{21}$ to $R^{23}$ include those mentioned above as examples for $X^1$ to $X^5$ in the formulae (II) and (IV) above. Y has the same meaning as defined above.

Preferable examples of the phenol couplers represented by formula (7) include 2-acylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Pat. Publication No. 3 329 729, and JP-A-59-166956; and 2-phenylureido-5-acylaminophenol couplers described, for example, in U.S. Pat. Nos. 3,446,622, 4,333,999, 4,451,559, and 4,427,767. Y has the same meaning as defined above.

Preferable examples of the naphthol couplers represented by formula (8) include 2-carbamoyl-1-naphthol couplers described, for example, in U.S. Pat. Nos. 2,474,293, 4,052,212, 4,146,396, 4,282,233, and 4,296,200; and 2-carbamoyl-5-amido-1-naphthol couplers described, for example, in U.S. Pat. No. 4,690,889. Y has the same meaning as defined above.

Formulas (9) to (12) are couplers called pyrrolotriazoles, and $R^{32}$, $R^{33}$, and $R^{34}$ each represent a hydrogen atom or a substituent. Y has the same meaning as defined above. Examples of the substituent of $R^{32}$, $R^{33}$, and $R^{34}$ include those mentioned for $X^1$ to $X^5$. Preferable examples of the pyrrolotriazole couplers represented by formulae (9) to (12) include those wherein at least one of $R^{32}$ and $R^{33}$ is an electron-attracting group, which specific couplers are described in EP-A-488 248 (A1), 491 197 (A1), and 545 300. Y has the same meaning as defined above.

Further, a fused-ring phenol, an imidazole, a pyrrole, a 3-hydroxypyridine, an active methylene other than the above, an active methine, a 5,5-ring-fused heterocyclic, and a 5,6-ring-fused heterocyclic coupler, can be used.

As the fused-ring phenol couplers, those described, for example, in U.S. Pat. Nos. 4,327,173, 4,564,586, and 4,904,575, can be used.

As the imidazole couplers, those described, for example, in U.S. Pat. Nos. 4,818,672 and 5,051,347, can be used.

As the 3-hydroxypyridine couplers, those described, for example, in JP-A-1-315736, can be used.

As the active methylene and active methine couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No. 5,164,289, and pyrroloimidazole couplers described in JP-A-4-174429, can be used.

As the 5,6-ring-fused heterocyclic couplers, for example, pyrazolopyrimidine couplers described in U.S. Pat. No. 4,950,585, pyrrolotriazine couplers described in JP-A-4-204730, and couplers described in EP-556 700, can be used.

In the present invention, in addition to the above couplers, use can be made of couplers described, for example, in West Germany Pat. Nos. 3 819 051A and 3 823 049, U.S. Pat. Nos. 4,840,883, 5,024,930, 5,051,347, and 4,481,268, EP-A-304 856 (A2), EP-329 036, EP-A-354 549 (A2), 374 781 (A2), 379 110 (A2), and 386 930 (Al), and JP-A-63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732.

Specific examples of the couplers that can be used in the present invention are shown below, but, of course, the present invention is not limited to them:

(C-1)

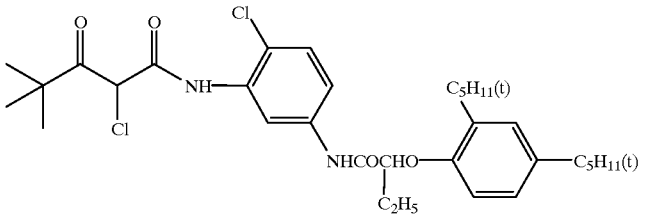

(C-2)

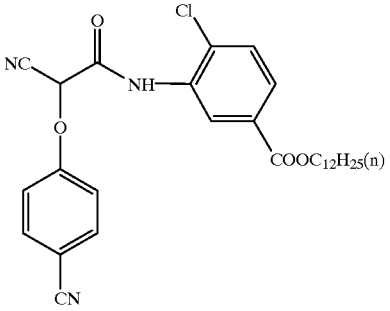

(C-3)

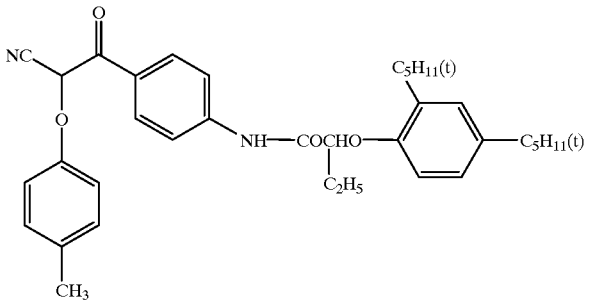

-continued
(C-4)
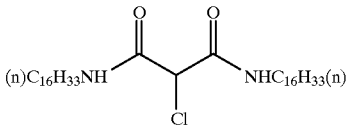
(C-5)
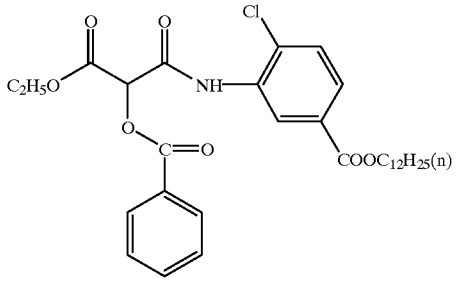
(C-6)
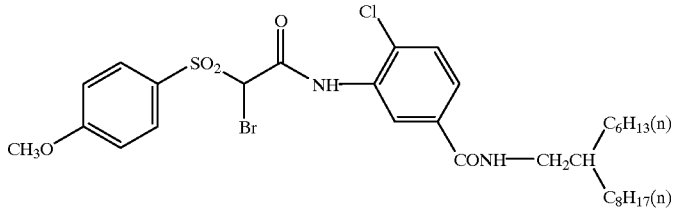
(C-7)
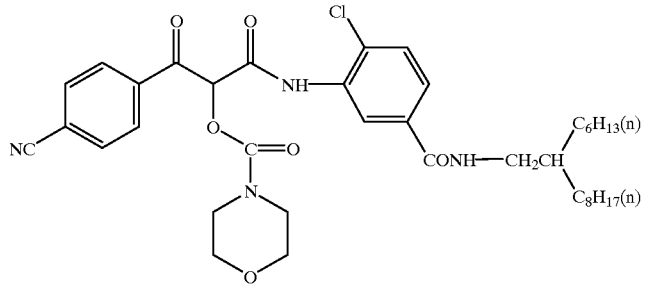
(C-8)
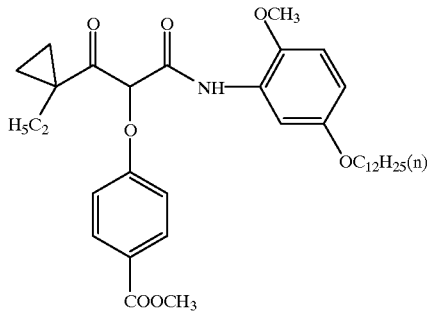
(C-9)
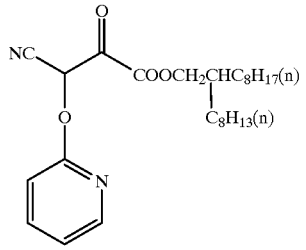
(C-10)
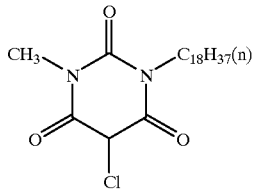
(C-11)
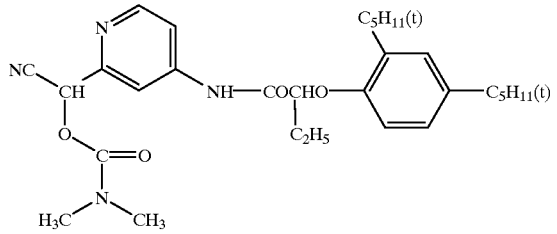

-continued
(C-12)
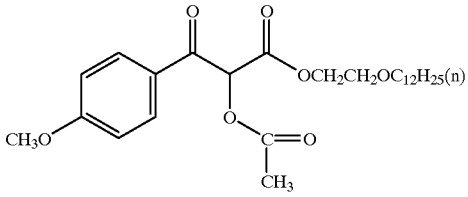
(C-13)
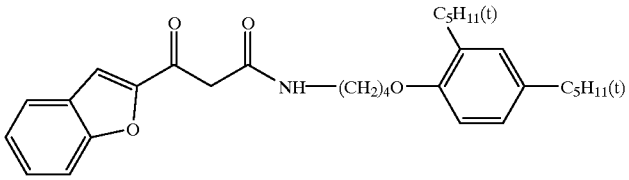
(C-14)
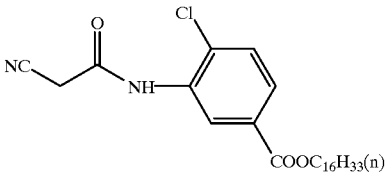
(C-15)
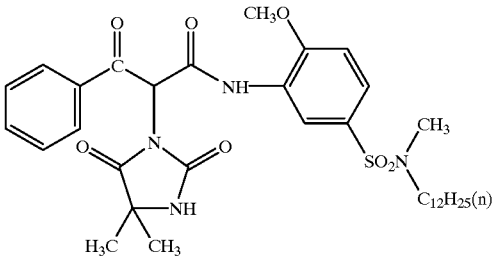
(C-16)
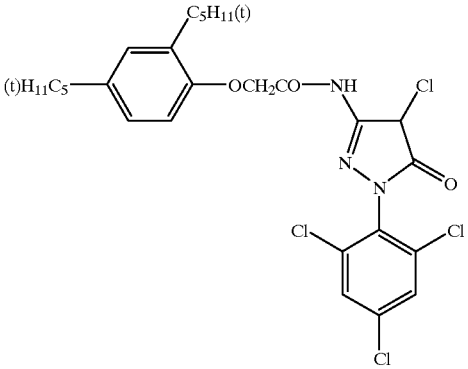
(C-17)
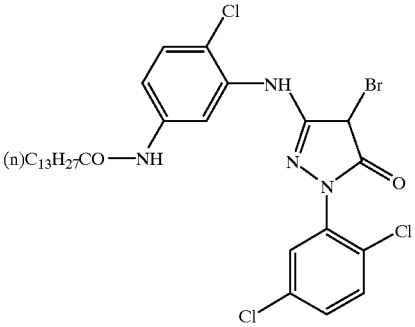
(C-18)
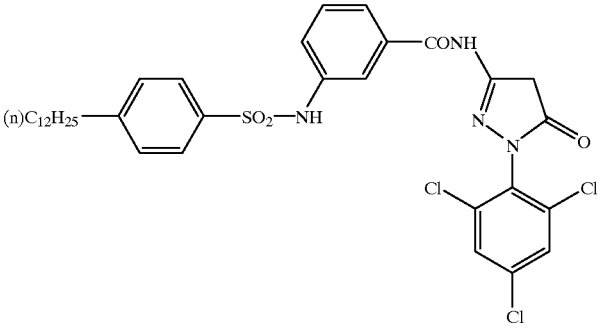

-continued
(C-19)
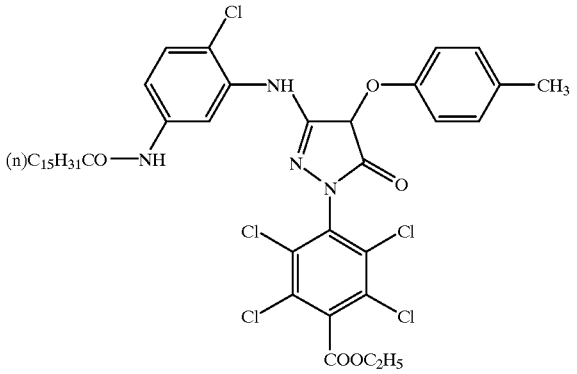
(C-20)
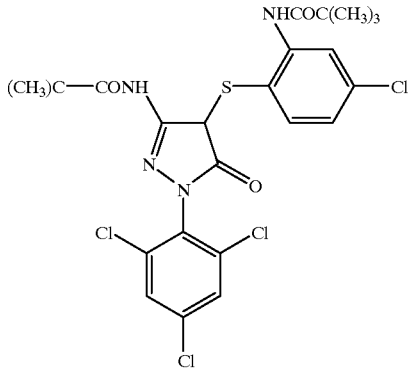
(C-21)
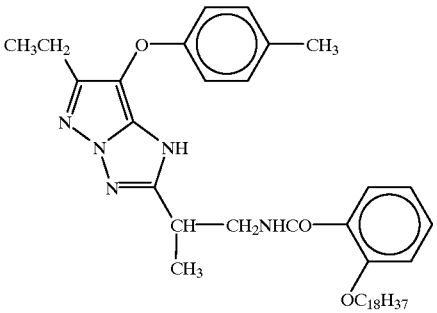
(C-22)
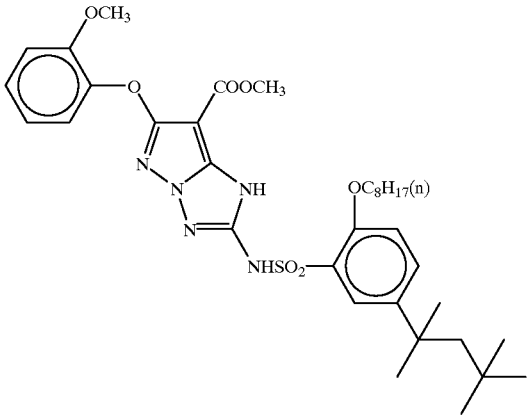

-continued
(C-23)
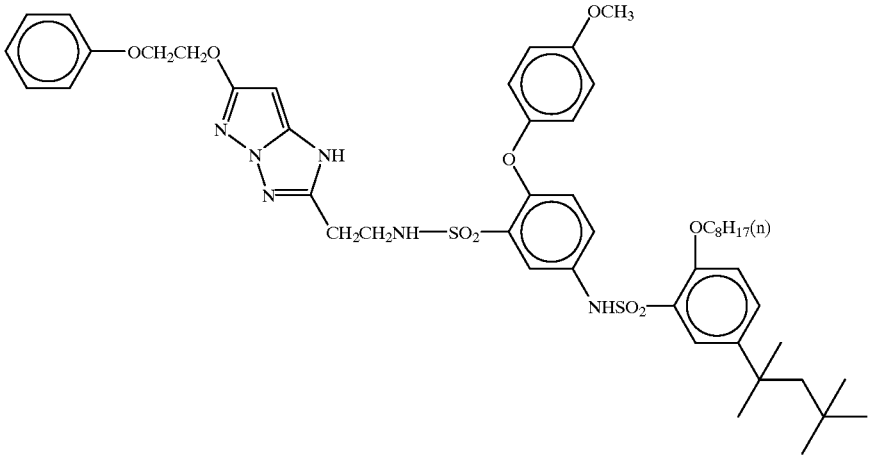
(C-24)
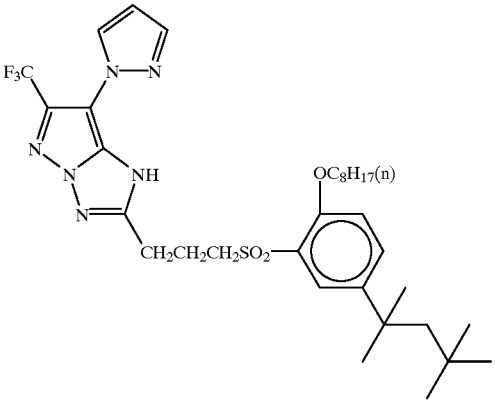
(C-25)
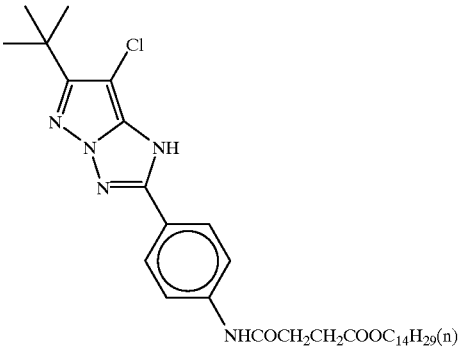
(C-26)
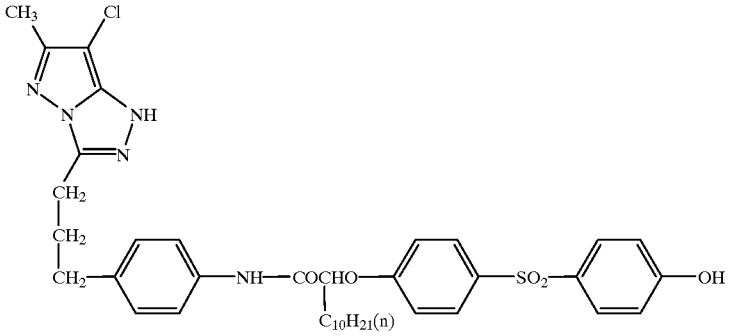

-continued
(C-27)
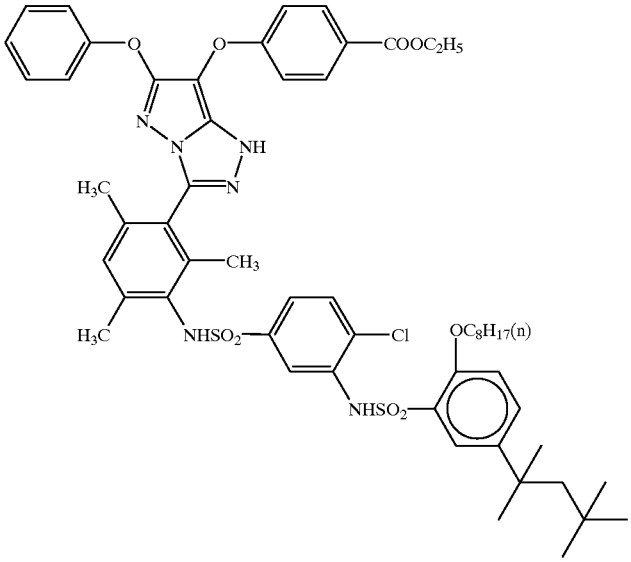
(C-28)
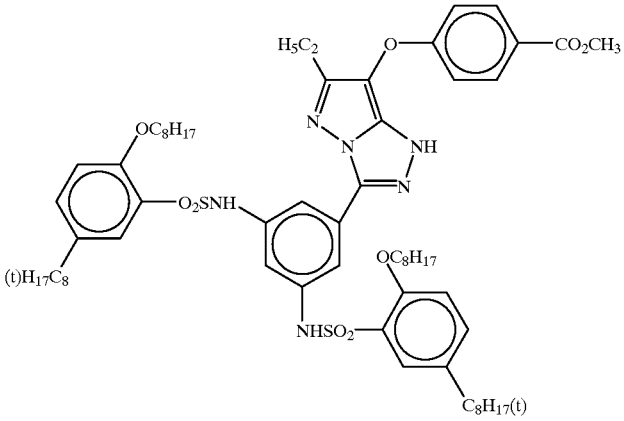
(C-29)
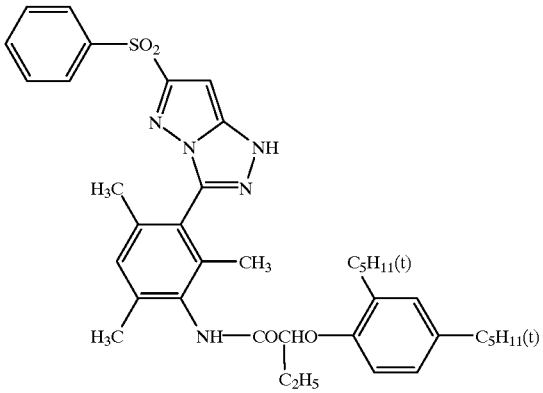

-continued
(C-30)
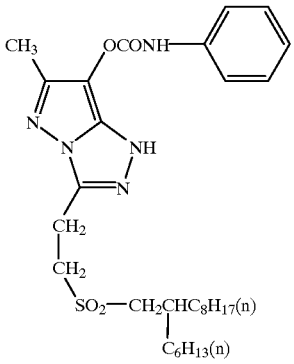
(C-31)
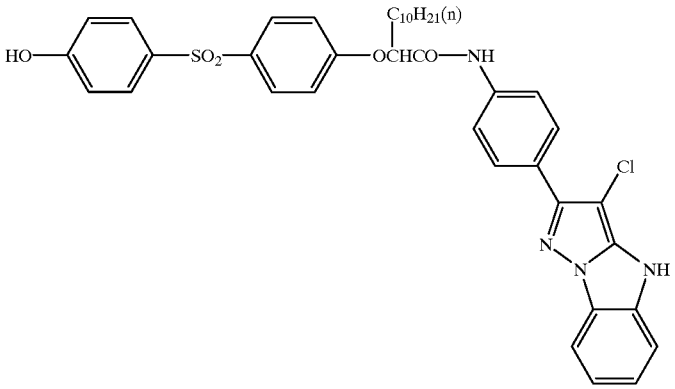
(C-32)
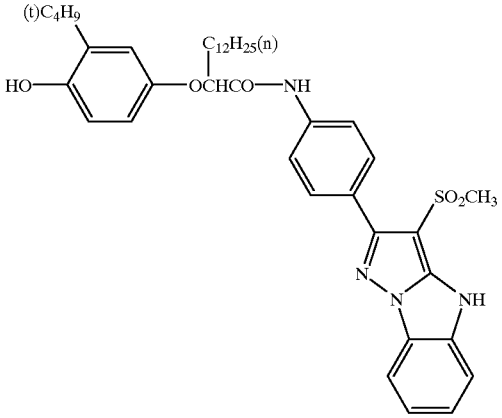
(C-33)
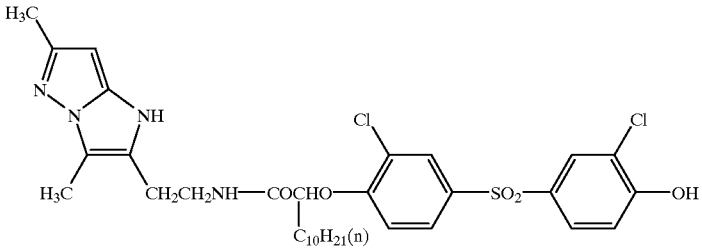

-continued
(C-34)
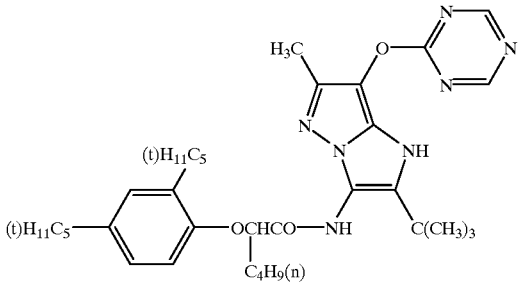
(C-35)
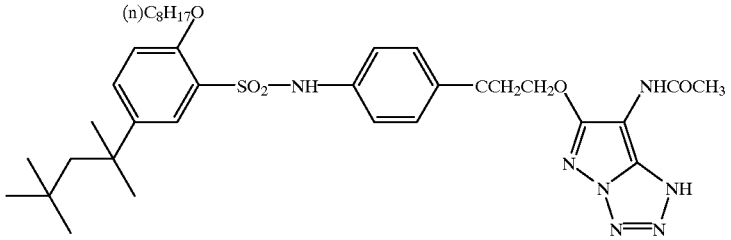
(C-36)
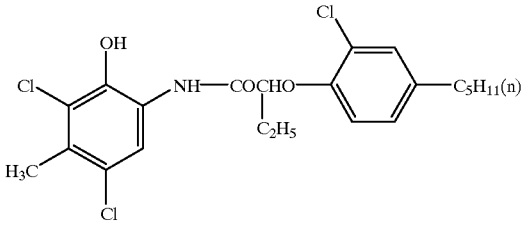
(C-37)
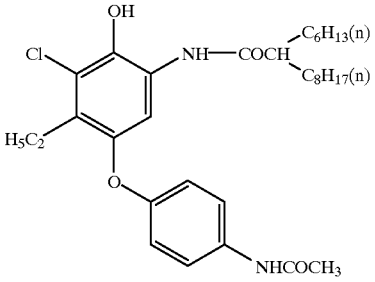
(C-38)
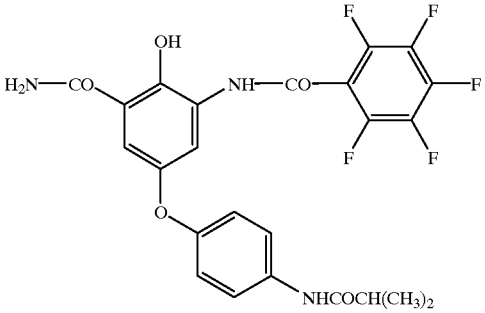
(C-39)
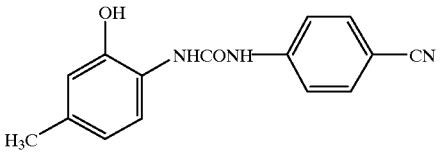
(C-40)
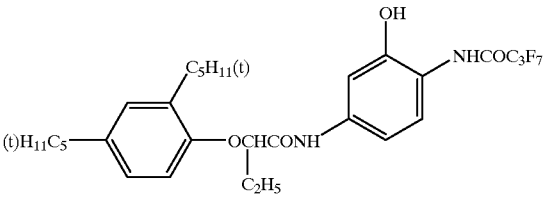

-continued
(C-41)
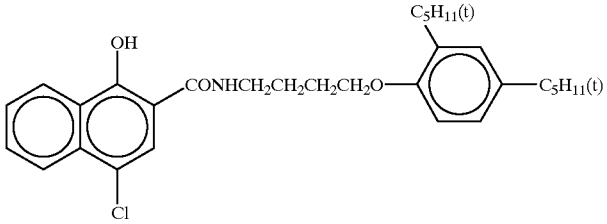
(C-42)
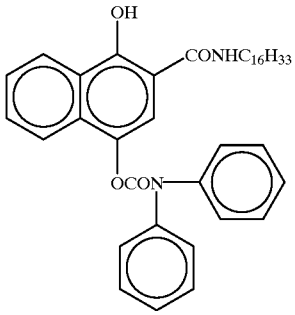
(C-43)
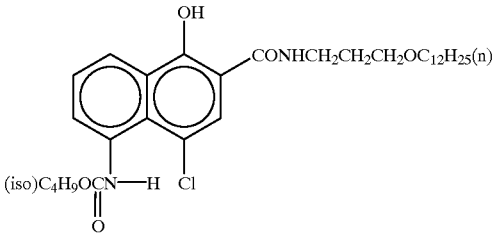
(C-44)
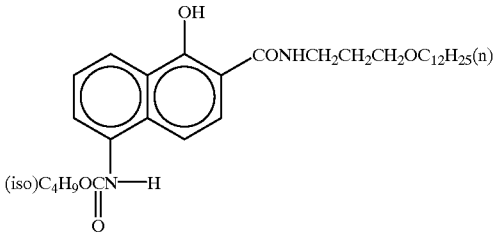
(C-45)
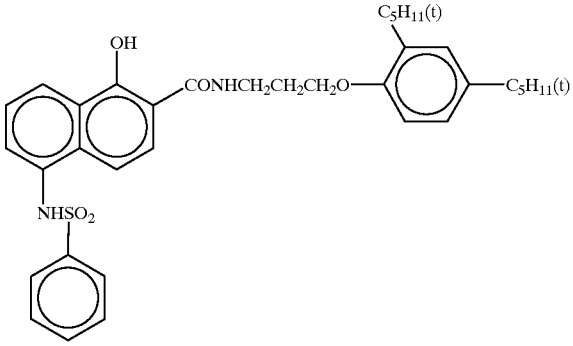
(C-46)
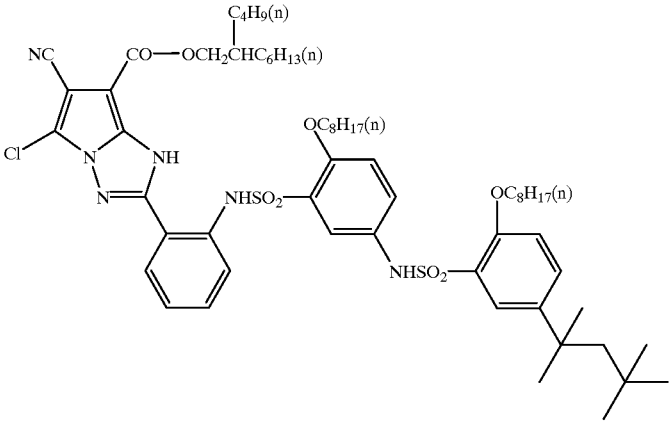

-continued
(C-47)
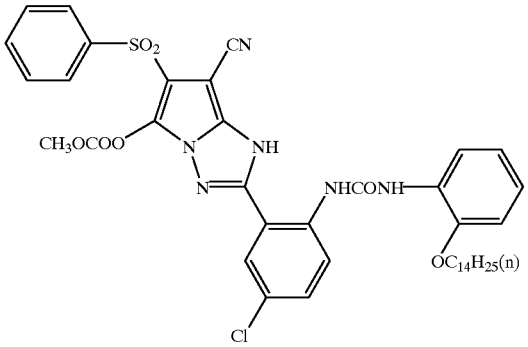
(C-48)
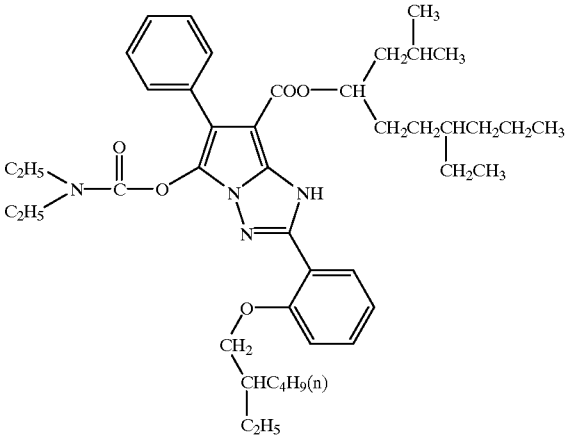
(C-49)
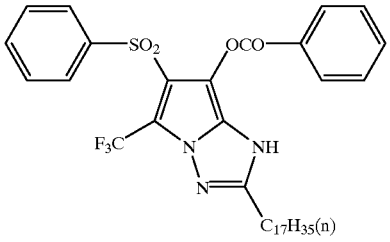
(C-50)
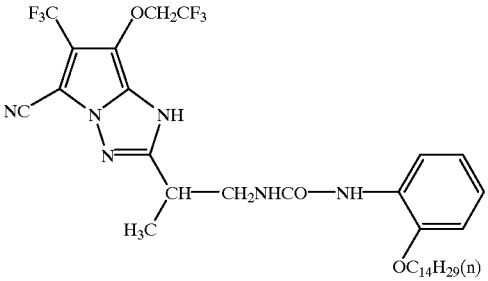
(C-51)
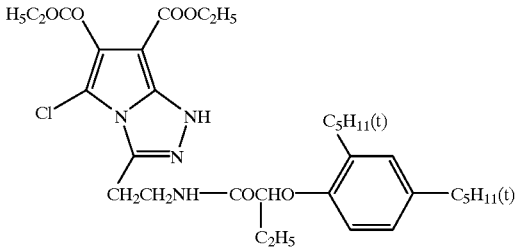
(C-52)
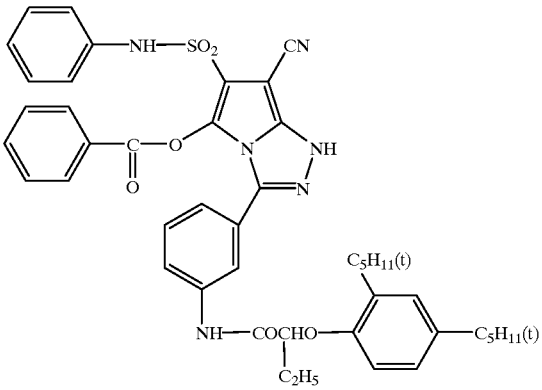

-continued
(C-53)
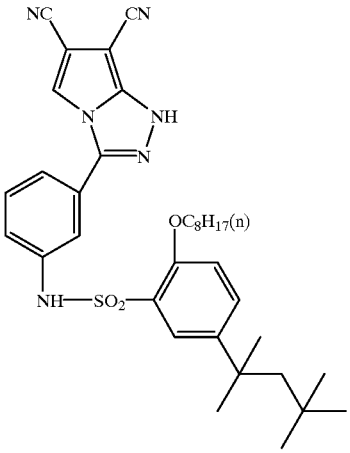
(C-54)
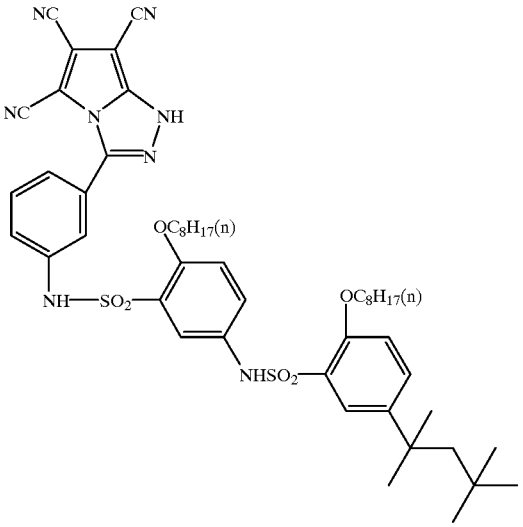
(C-55)
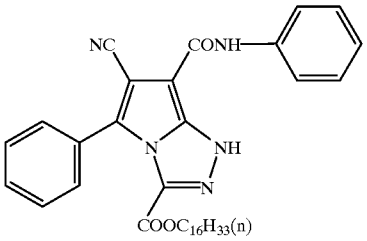
(C-56)
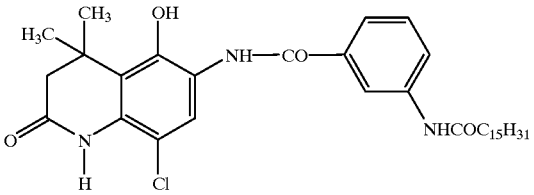
(C-57)
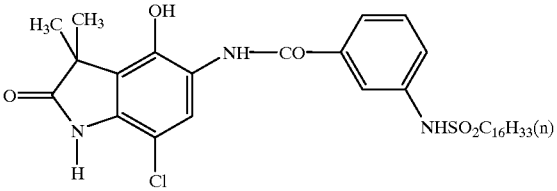
(C-58)
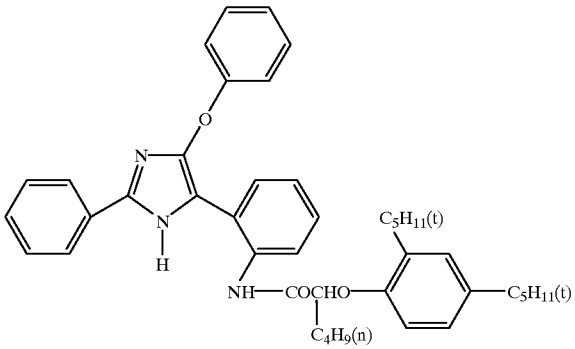

-continued
(C-59)
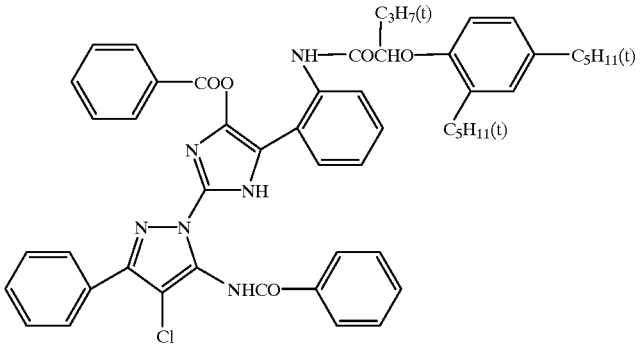
(C-60)
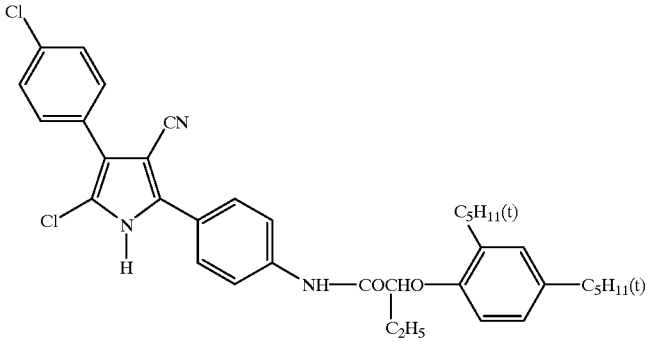
(C-61)
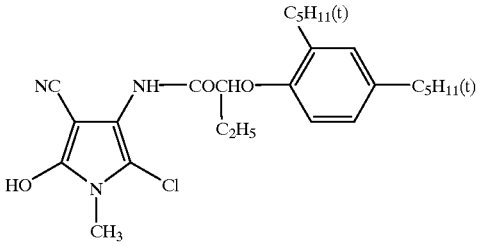
(C-62)
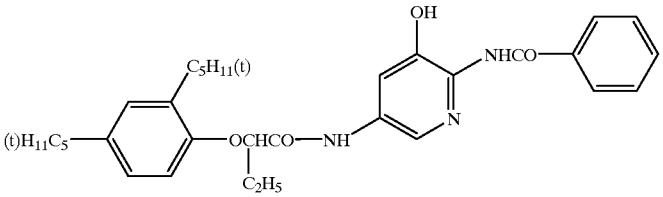
(C-63)
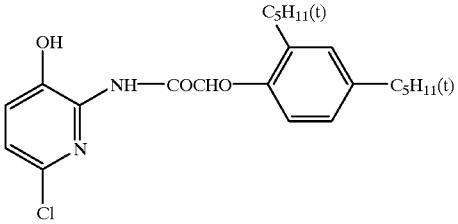
(C-64)
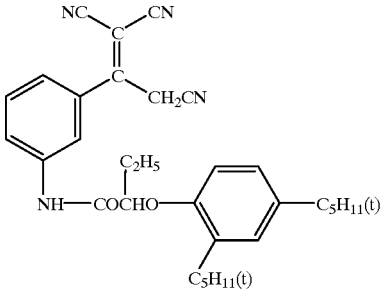

-continued
(C-65)
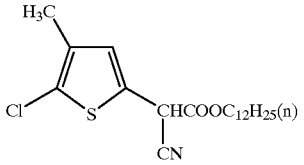
(C-66)
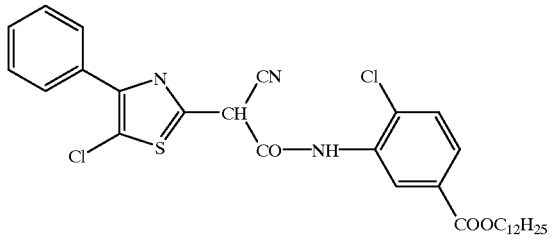
(C-67)
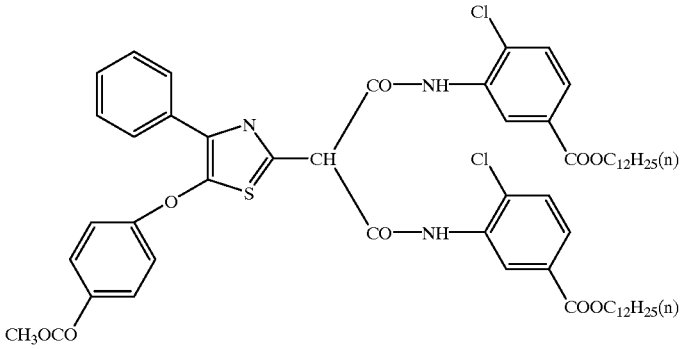
(C-68)
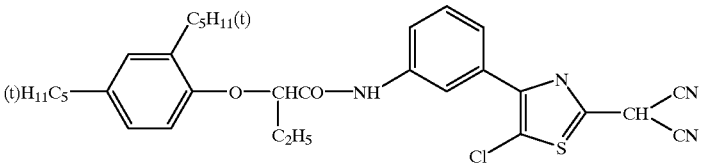
(C-69)
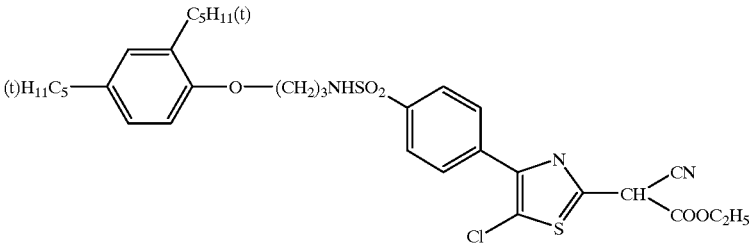

-continued
(C-70)
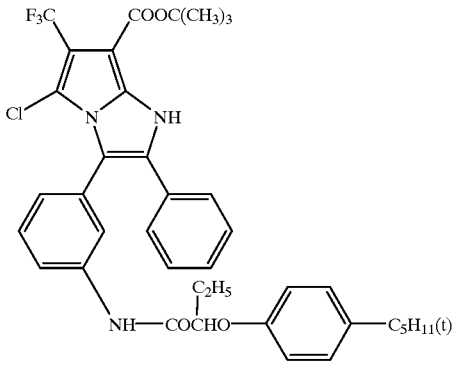
(C-71)
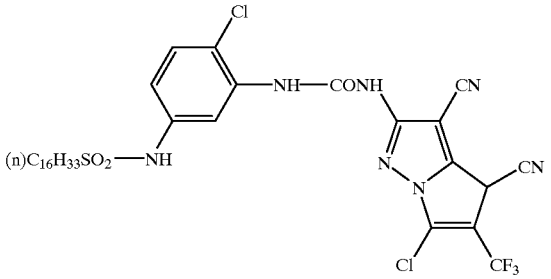
(C-72)
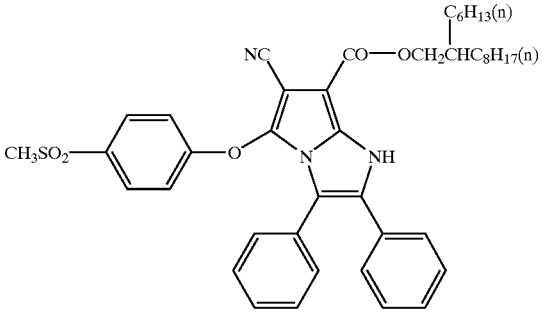
(C-73)
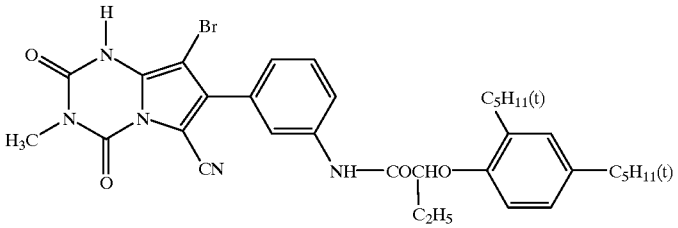
(C-74)
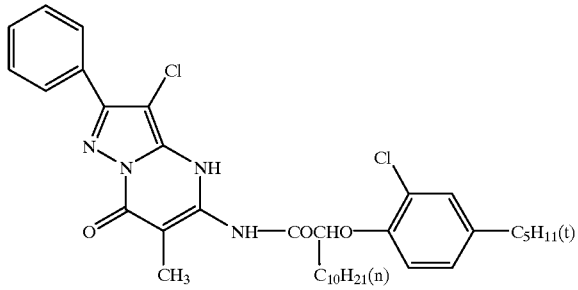
(C-75)
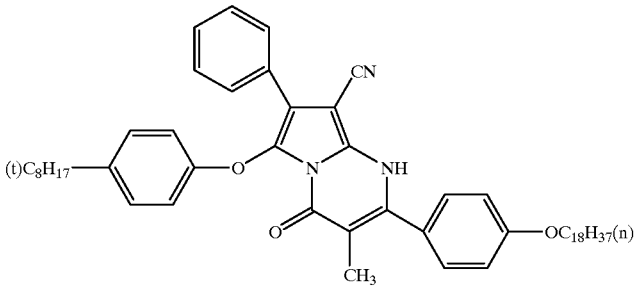

-continued
(C-76)
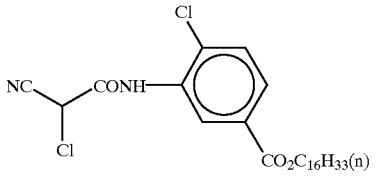
(C-77)
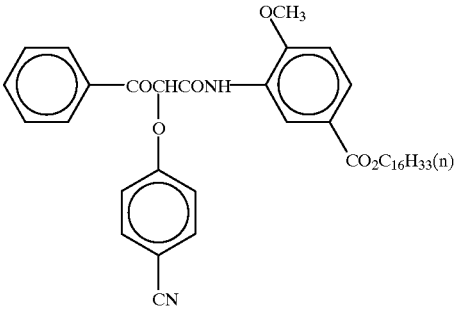
(C-78)
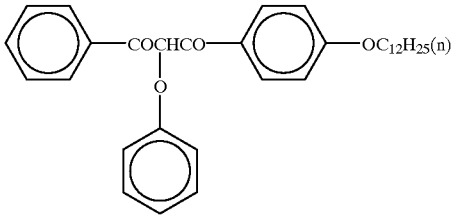
(C-79)
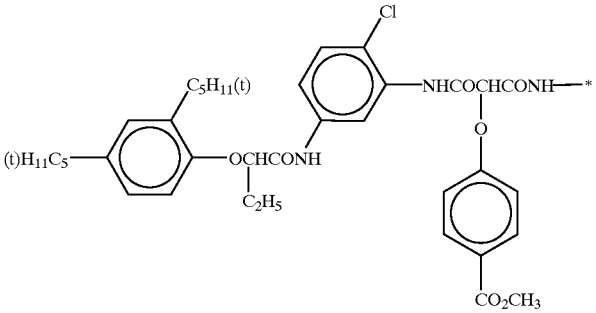
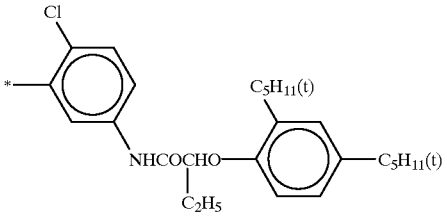
(C-80)
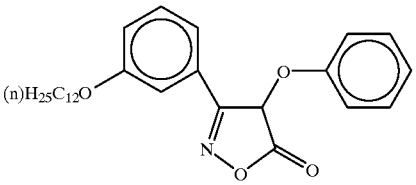
(C-81)
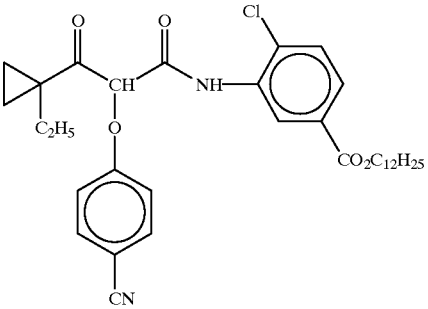

-continued
(C-82)
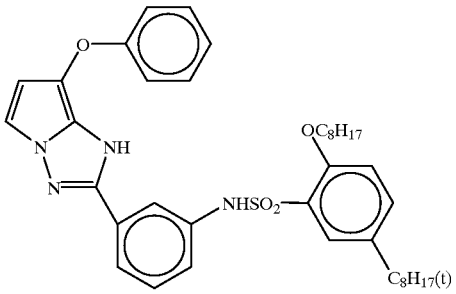
(C-83)
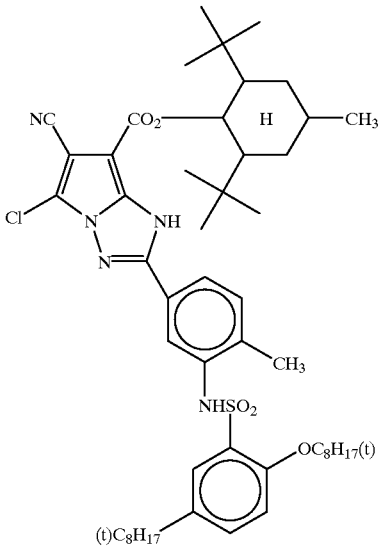
(C-84)
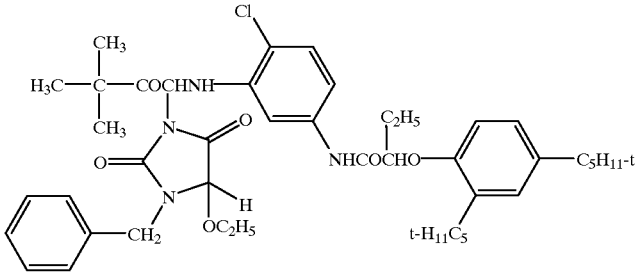
(C-85)
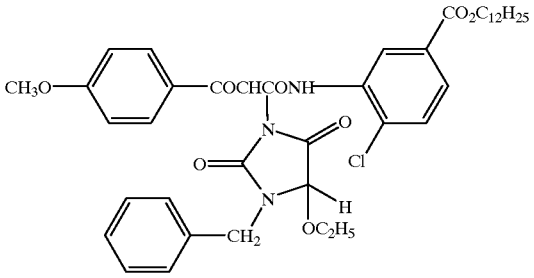
(C-86)
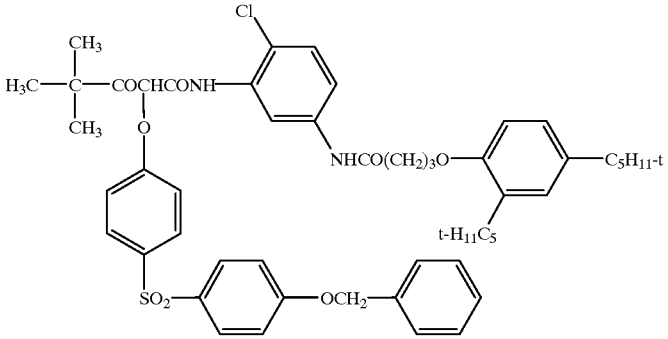

-continued
(C-87)
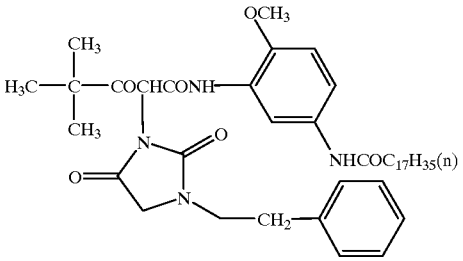
(C-88)
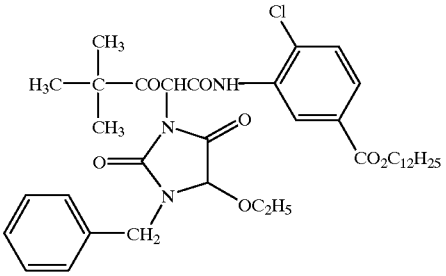
(C-89)
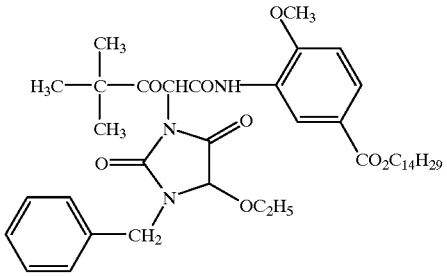
(C-90)
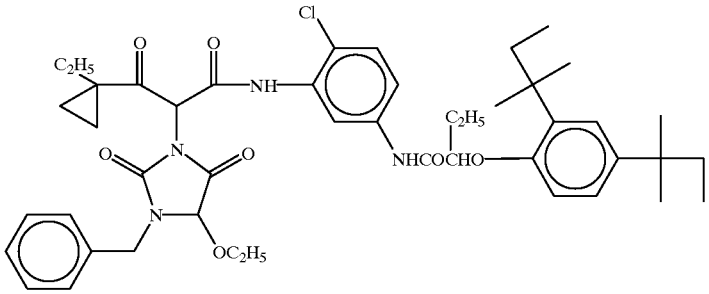
(C-91)
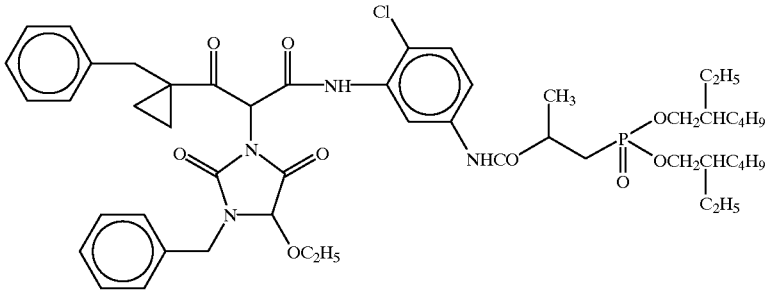
(C-92)
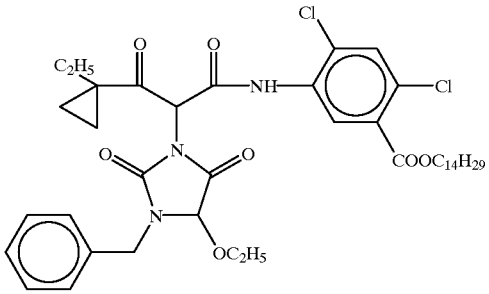
(C-93)
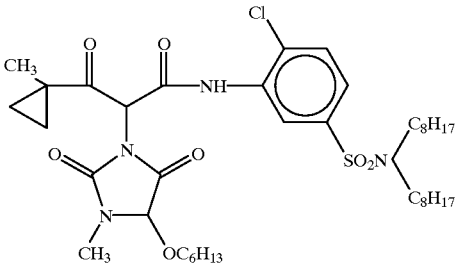

-continued
(C-94)
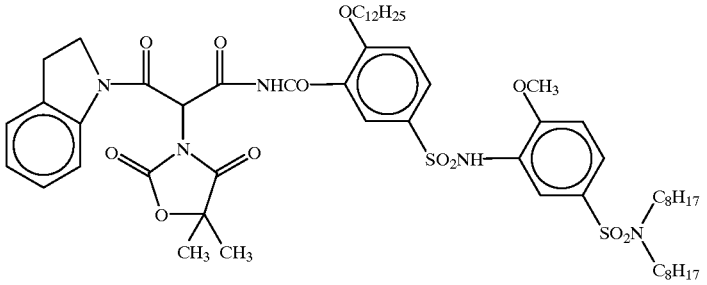
(C-95)
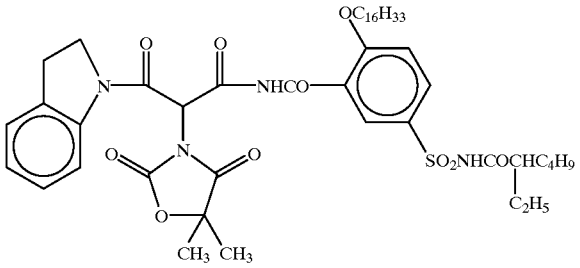
(C-96)
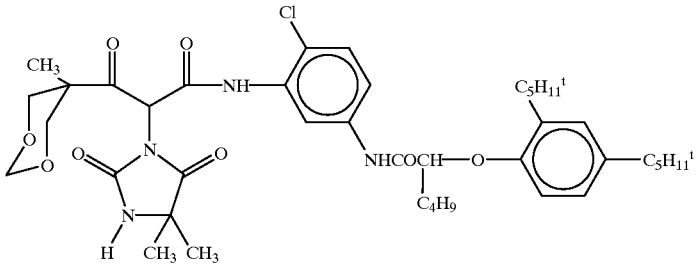
(C-97)
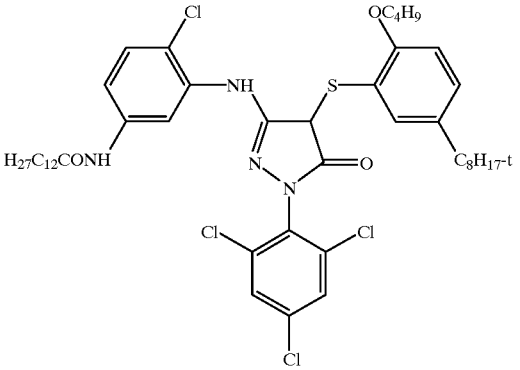
(C-98)
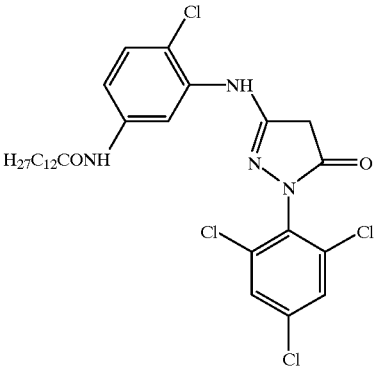
(C-99)
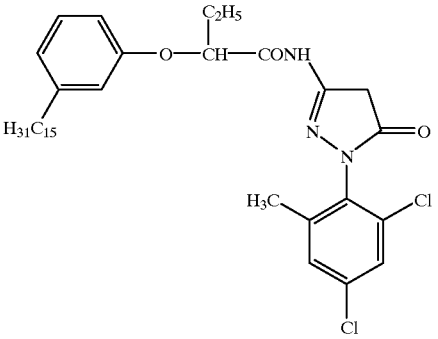

-continued
(C-100)
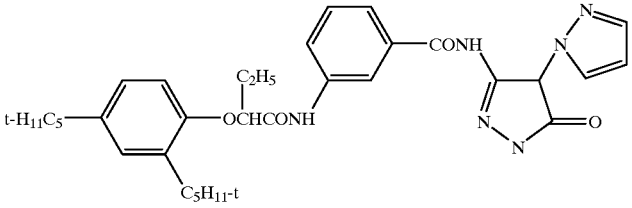
(C-101)
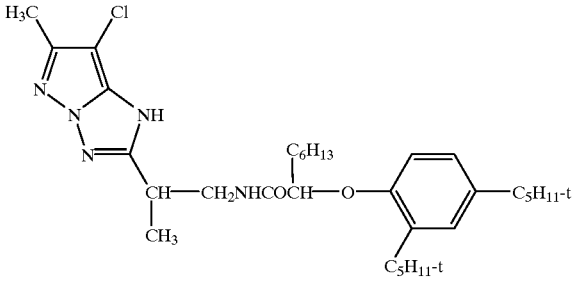
(C-102)
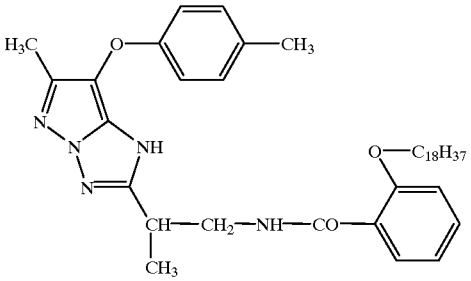
(C-103)
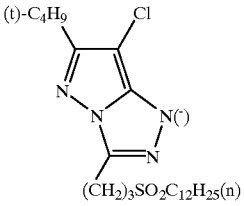
(C-104)
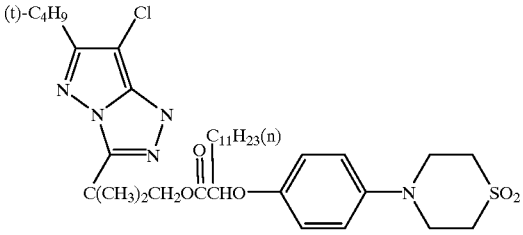
(C-105)
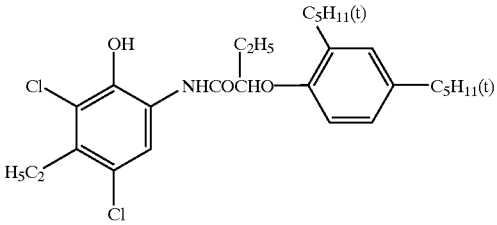
(C-106)
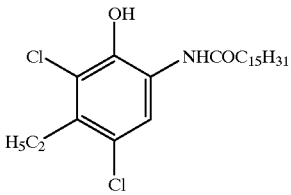
(C-107)
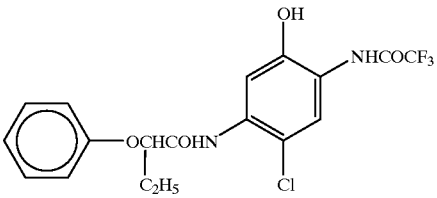
(C-108)
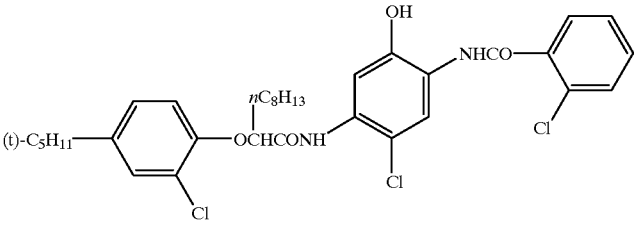

-continued (C-109)

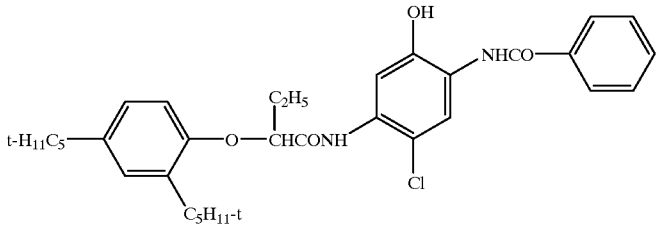

(C-110)

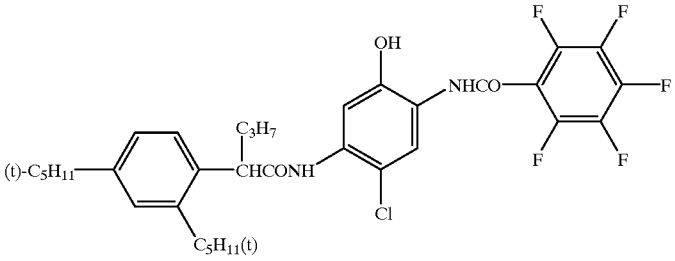

(C-111)

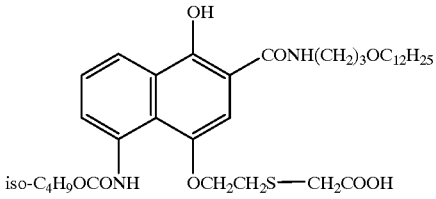

(C-112)

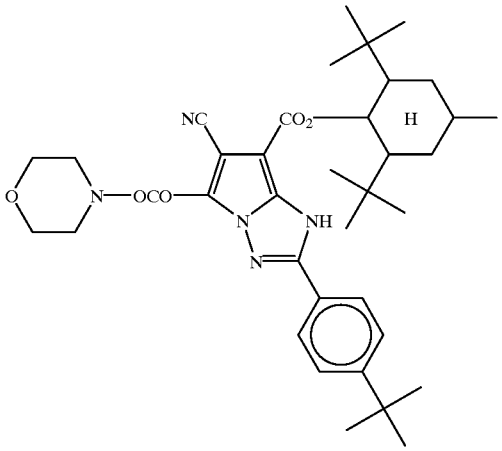

(C-113)

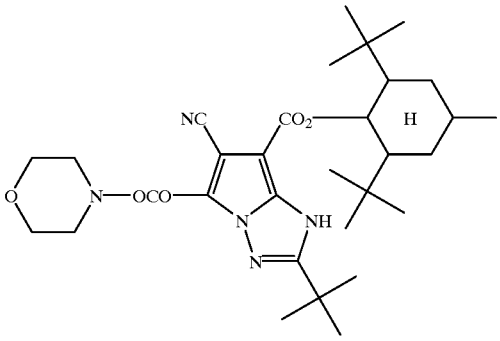

In the present invention, the color-developing compound is preferably used in an amount of 0.01 mmol/$m^2$ to 10 mmol/$m^2$ per one color-forming layer, in order to obtain satisfactory color density. More preferably the amount to be used is 0.05 mmol/$m^2$ to 5 mmol/$m^2$, and particularly preferably 0.1 mmol/$m^2$ to 1 mmol/$m^2$. The amount in these ranges are preferable in the point satisfactory color density can be obtained.

A preferable amount of the coupler to be used in the color-forming layer in which the color-developing compound according to the present invention is used, is 0.05 to 20 times, more preferably 0.1 to 10 times, and particularly preferably 0.2 to 5 times, the amount of the color-developing compound in terms of mol. The amount in these ranges are preferable in the point satisfactory color density can be obtained.

The color light-sensitive material for use in the present invention basically comprises photographic constitutional layers including at least one hydrophilic colloidal layer coated on a support; and a light-sensitive silver halide, a dye-forming coupler, and a color-developing compound are contained in one or more photographic constitutional layers.

The dye-forming coupler and the color-developing compound are added to an identical layer, in the most typical embodiment, but they can be added divisionally into separate layers, as long as they can react with each other. These ingredients are preferably added to a silver halide emulsion layer or a layer adjacent therewith in the light-sensitive material, and particularly preferably they are added together to an identical silver halide emulsion layer.

The total of all coating amounts of silver in the coating layers of the silver halide color photographic light-sensitive material to be processed according to the present invention, is preferably from 0.003 to 0.3 g/m$^2$ in terms of silver, and the coating silver amount of each light-sensitive layer is preferably from 0.001 to 0.1 g/m$^2$. The total coating silver amount is preferably from 0.01 to 0.1 g/m$^2$, and more preferably from 0.015 to 0.05 g/m$^2$.

In the present invention, the smaller the coating silver amount is the more preferable it is, because the bleach-fixing step can be omitted with such a small coating silver amount, so that color stain or the like of the color image can be reduced as much as possible. However, if the coating silver amount of each light-sensitive layer is below 0.001 g/m$^2$, dissolution of a silver salt is accelerated, so that a sufficient coloring density is hardly obtained, in some cases. On the other hand, if the coating silver amount is above 0.1 g/m$^2$, processing stain tends to increase and bubbles are easily generated in the intensification processing, in some cases.

The color-developing compounds and the couplers for use in the present invention may be introduced into a light-sensitive material according to various known dispersion methods. Preferred, of these methods, is an oil-droplets-in-water-type dispersion method, in which lipophilic compounds are dissolved in a high-boiling organic solvent (if necessary, together with a low-boiling organic solvent), and the resultant solution is emulsified and dispersed into a gelatin aqueous solution, and then the thus-obtained emulsified dispersion is added to a silver halide emulsion. A high-boiling organic solvent that can be used in the present invention is preferably a water-immiscible compound having a melting point of not more than 100° C. and a boiling point of not less than 140° C., and it is a good solvent for both the color-developing compound and the coupler. The melting point of the high-boiling organic solvent is preferably not more than 80° C. The boiling point of the high-boiling organic solvent is preferably not less than 160° C., and more preferably not less than 170° C. The details of these high-boiling organic solvents are described in a published specification of JP-A-62-215272, the right lower column of page 137 to the right upper column of page 144. As a high-boiling organic solvent for use in the present invention, it is preferred to use a high-boiling organic solvent having an electron-donating parameter ΔV of at least 80, as described in JP-A-8-320542, from the viewpoint that a dye formed by a color-developing compound and a coupler, can be dissociated at a low pH. The amount of a high-boiling organic solvent to be used in the present invention is not limited in particular. However, the ratio by weight of a high-boiling organic solvent to a color-developing compound is preferably not more than 20, more preferably from 0.02 to 5, and especially preferably from 0.2 to 4.

Further, known polymer dispersion methods may be used in the present invention. The steps of a latex dispersion method, as one polymer dispersion method, its effects, and specific examples of the impregnation latex are described in, for example, U.S. Pat. No. 4,199,363, West German Pat. Application (OLS) Nos. 2,541,274 and 2,541,230, JP-B-53-41091, and European Patent EP 029104A. Further, a dispersion method in which a water-insoluble and organic solvent-soluble polymer is used, is described in the specification of PCT International Publication No. WO 88/00723.

The average particle size of the lipophilic fine particles containing the color-developing compound for use in the present invention is not particularly limited, but, in view of the color-forming property, the average particle size is preferably 0.05 to 0.3 μm, and more preferably 0.05 to 0.2 μm.

To make the average particle size of lipophilic fine particles small is generally accomplished, for example, by choosing a type of surface-active agent, by increasing the amount of the surface-active agent to be used, by elevating the viscosity of the hydrophilic colloid solution, by lowering the viscosity of the lipophilic organic layer, through use of an additional low-boiling organic solvent, by increasing the rotational frequency of the stirring blades of an emulsifying apparatus, to increase the shearing force, or by prolonging the emulsifying time.

The particle size of lipophilic fine particles can be measured by an apparatus, such as a Nanosizer (trade name, manufactured by British Coulter Co.).

In the present invention, when the dye that is produced from the color-developing compound and the dye-forming coupler is a diffusible dye, preferably a mordant is added to the light-sensitive material. If the present invention is applied to such a mode, it is not required to dip the material in an alkali to form color, and therefore image stability after processing is remarkably improved. Although the mordant for the use in the present invention can be used in any layer, if the mordant is added to a layer containing the color-developing compound for use in the present invention, the stability of the color-developing compound may be deteriorated. Therefore preferably the mordant is used in a layer that does not contain the color-developing compound. Further, the dye that is produced from a color-developing compound and a coupler diffuses into the gelatin film that has been swelled during the processing, to dye the mordant. Therefore, in order to obtain good sharpness, the shorter the diffusion distance is, the more preferred it is. Accordingly, the layer to which the mordant is added is preferably a layer adjacent to the layer containing the color-developing compound.

Further, in this case, since the dye that is produced from the color-developing compound and the coupler for use in the present invention is a water-soluble dye, there is a possibility that the dye may flow out into the processing solution. Therefore, to prevent this, preferably the layer to which the mordant is added, is situated on the same side on the base and opposite to (more remote from the base than) the layer containing the color-developing compound. However, when a barrier layer, as described in JP-A-7-168335, is provided on the same side on the base and opposite to (more remote from the base than) a layer in which the mordant is added, also preferably the layer in which the mordant is added, is situated on the same side of the base as and nearer to the base than the layer containing the color-developing compound.

The mordant for use in the present invention may also be added to several layers, and in particular, when several layers contain the color-developing compound, also preferably the mordant is added to each layer adjacent thereto.

The coupler that forms a diffusible dye may be any coupler that results in a diffusible dye formed by coupling with the color-developing compound for use in the present invention, the resultant diffusible dye being capable of reaching the mordant. Preferably the coupler is a coupler that results in a diffusible dye having one or more dissociable groups with a pKa (an acid dissociation constant) of 12 or less, more preferably 8 or less, and particularly preferably 6 or less. Preferably the molecular weight of the diffusible dye that will be formed is 200 or more but 2,000 or less. Further, preferably the ratio (the molecular weight of the dye that will be formed/the number of dissociable groups with a pKa of 12 or less) is 100 or more but 2,000 or less, and more preferably 100 or more but 1,000 or less. Herein the value of pKa is the value measured by using, as a solvent, dimethylformamide/water (1:1).

The coupler that forms a diffusible dye is preferably one that results in a diffusible dye formed by coupling with the color-developing compound for use in the present invention, the resultant diffusible dye being dissolvable in an alkali solution having a pH of 11 in an amount of $1\times10^{-6}$ mol/liter or more, more preferably $1\times10^{-5}$ mol/liter or more, and particularly preferably $1\times10^{-4}$ mol/liter or more, at 25° C. Further, the coupler that forms a diffusible dye is preferably one that results in a diffusible dye formed by coupling with the color-developing compound for use in the present invention, the resultant diffusible dye having a diffusion constant of $1\times10^{-8}$ $m^2/s^{-1}$ or more, more preferably $1\times10^{-7}$ $m^2/s^{-1}$ or more, and particularly preferably $1\times10^{-6}$ $m^2/s^{-1}$ or more, at 25° C. when dissolved in an alkali solution of pH 11, at a concentration of $10^{-4}$ mol/liter.

The mordant that can be used in the present invention can be suitably chosen from among mordants that are usually used, and among them, in particular, polymer mordants are preferable. Herein, by polymer mordant is meant polymers having a tertiary amino group, polymers having a nitrogen-containing heterocyclic moiety, polymers containing a quaternary cation group thereof, etc.

Preferable specific examples of homopolymers and copolymers containing vinyl monomer units with a tertiary imidazole group include mordants as described, for example, in U.S. Pat. Nos. 4,282,305, 4,115,124, and 3,148,061 and JP-A-60-118834, 60-122941, 62-244043, and 62-244036.

Preferable specific examples of homopolymers and copolymers containing vinyl monomer units with a quaternary imidazolium salt include mordants as described, for example, in GB-2 056 101, 2 093 041, and 1 594 961, U.S. Pat. Nos. 4,124,386, 4,115,124, and 4,450,224, and JP-A-48-28325.

Further, preferable specific examples of homopolymers and copolymers having vinyl monomer units with a quaternary ammonium salt include mordants as described, for example, in U.S. Pat. Nos. 3,709,690, 3,898,088, and 3,958,995, and JP-A-60-57836, 60-60643, 60-122940, 60-122942, and 60-235134.

Further, in addition to the above mordants, vinylpyridine polymers and vinylpyridinium cation polymers, as disclosed, for example, in U.S. Pat. Nos. 2,548,564, 2,484,430, 3,148,161, and 3,756,814; polymer mordants capable of being crosslinked to gelatin or the like, as disclosed, for example, in U.S. Pat. Nos. 3,625,694, 3,859,096, and 4,128,538, and GB-1 277 453; aqueous sol-type mordants, as disclosed, for example, in U.S. Pat. Nos. 3,958,995, 2,721,852, and 2,798,063, and JP-A-54-115228, 54-145529, and 54-26027; water-insoluble mordants, as disclosed in U.S. Pat. No. 3,898,088; reactive mordants capable of covalent bonding to dyes, as disclosed in U.S. Pat. No. 4,168,976 (JP-A-54-137333); and mordants disclosed in U.S. Pat. Nos. 3,709,690, 3,788,855, 3,642,482, 3,488,706, 3,557,066, and 3,271,147, and JP-A-50-71332, 53-30328, 52-155528, 53-125, and 53-1024, can all be mentioned.

Still further, mordants described in U.S. Pat. Nos. 2,675,316 and 2,882,156 can be mentioned.

The molecular weight of the polymer mordants for use in the present invention is suitably generally 1,000 to 1,000,000, and particularly preferably 10,000 to 200,000.

The above polymer mordants are used generally by mixing them with a hydrophilic colloid. As the hydrophilic colloid, a hydrophilic colloid and/or a highly hygroscopic polymer can be used, and gelatin is most typically used. The mixing ratio of the polymer mordant to the hydrophilic colloid, and the coating amount of the polymer mordant, can be determined easily by those skilled in the art in accordance with the amount of the dye to be mordanted, the type and composition of the polymer mordant, and the image formation process to be used. Suitably the mordant/hydrophilic colloid ratio is generally from 20/80 to 80/20 (by weight), and the coating amount of the mordant is suitably generally 0.2 to 15 $g/m^2$, and preferably 0.5 to 8 $g/m^2$, for use.

In the present invention, preferably an auxiliary developing agent and/or a precursor thereof can be used in the light-sensitive material. These compounds are explained below.

The auxiliary developing agent used in the present invention is a compound that has an action to accelerate electric transfer from the color-developing compound to silver halides in the development step of silver halide grains. Preferably the auxiliary developing agent is a compound that can cause development of silver halide grains exposed to light, and the oxidization product of the compound can oxidize a color-developing compound (hereinafter referred to as cross oxidation).

As the auxiliary developing agent for use in the present invention, pyrazolidones, dihydroxybenzenes, reductones, or aminophenols can be used preferably, with pyrazolidones being used particularly preferably. Preferably that the diffusibility of these compounds in a hydrophilic colloidal layer is low, and, for example, the solubility to water (25° C.) is preferably 0.1% or below, more preferably 0.05% or below, and particularly preferably 0.01% or below.

The precursor of the auxiliary developing agent used in the present invention is a compound that is present stably in the light-sensitive material, but it rapidly releases the auxiliary developing agent after it has been processed by a processing solution. Also in a case of using that compound, preferably the diffusibility in the hydrophilic colloidal layer is low. For example, the solubility to water (25° C.) is preferably 0.1% or below, more preferably 0.05% or below, and particularly preferably 0.01% or below. There is no particular restriction on the solubility of the auxiliary developing agent released from the precursor, but preferably the solubility of the auxiliary developing agent itself is low.

The auxiliary developing agent precursor for use in the present invention is preferably represented by formula (A).

$$A—(L)_n—PUG \qquad \text{formula (A)}$$

A represents a blocking group whose bond to $(L)_n$—PUG will be split off at the time of development processing; L represents a linking group whose bond between L and PUG in the above formula (A) will be split off after the bond between A and L is split off; n is an integer of 0 to 3; and PUG represents a group to give an auxiliary developing agent.

As the auxiliary developing agent, an electron-releasing compound that follows the Kendall-Pelz rule, other than the compounds of p-phenylenediamines, is used, and preferably the above pyrazolidones are used.

As the blocking group represented by A, the following already known groups can be used: blocking groups described, for example, in U.S. Pat. No. 3,311,476, such as an acyl group and a sulfonyl group; blocking groups that use the reverse Michael reaction, as described, for example, in JP-A-59-105642; blocking groups that use the formation of quinone methide, or a compound similar to quinone methide, by intramolecular electron transfer, as described, for example, in JP-A-2-280140; blocking groups that use intramolecular nucleophilic substitution reaction, as described, for example, in JP-A-63-318555 (EP-A-0295729); blocking groups that use the addition reaction of a nucleophilic reagent to a conjugated unsaturated bond, as described, for example, in JP-A-4-186344; blocking groups that use the β-elimination reaction, as described, for example, in JP-A-62-163051; blocking groups that use the nucleophilic substitution reaction of diarylmethanes, as described in JP-A-61-188540; blocking groups that uses the Lossen rearrangement reaction, as described in JP-A-62-187850; blocking groups that use the reaction between the N-acylated product of thiazolidin-2-thion and an amine, as described in JP-A-62-147457; and blocking groups that have two electrophilic groups to react with a di-nucleophilic agent, as described in WO-A-93/03419.

The group represented by L is a linking group that can be split off from the group represented by A, at the time of development processing, and that then can split $(L)_{n-1}$—PUG. There is no particular restriction on the group of L, if the group has the above function.

Specific examples of the auxiliary developing agent or its precursor are shown below, but the compound that can be used in the present invention is not limited to them.

(ETA-1)

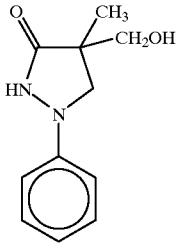

(ETA-2)

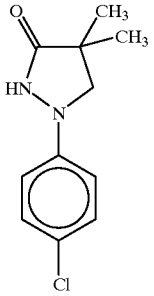

(ETA-3)

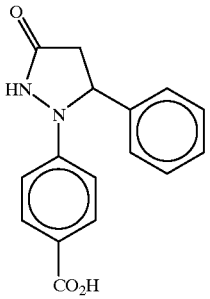

-continued (ETA-4)

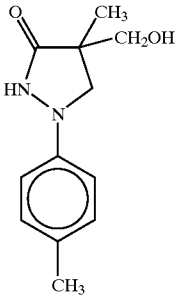

(ETA-5)

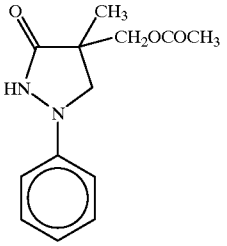

(ETA-6)

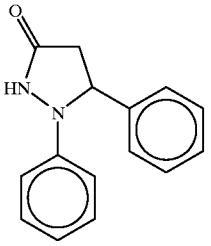

(ETA-7)

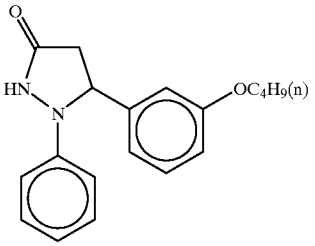

(ETA-8)

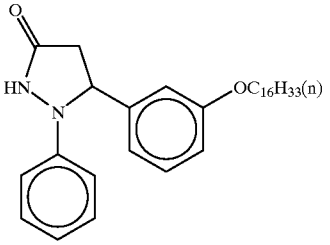

-continued
(ETA-9)
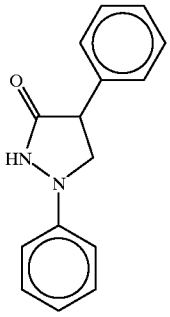
(ETA-10)
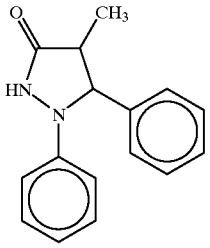
(ETA-11)
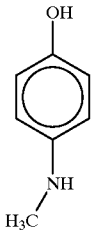
(ETA-12)
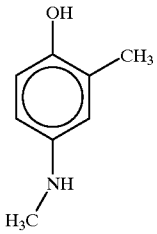
(ETA-13)
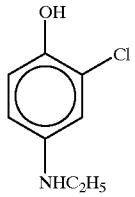
(ETA-14)
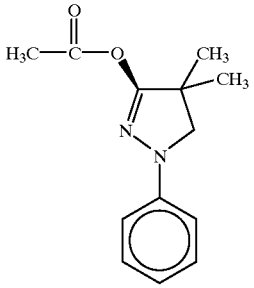
-continued
(ETA-15)
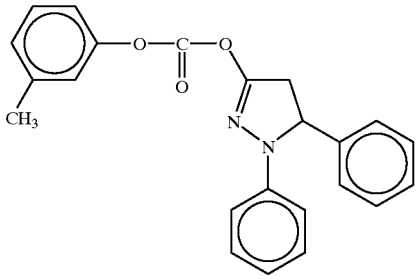
(ETA-16)
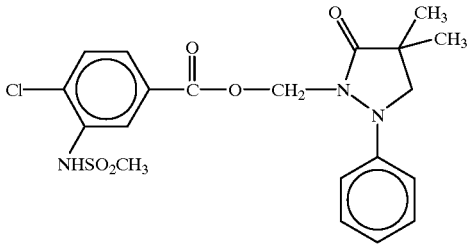
(ETA-17)
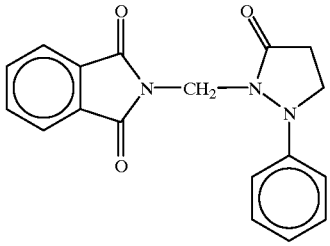
(ETA-18)
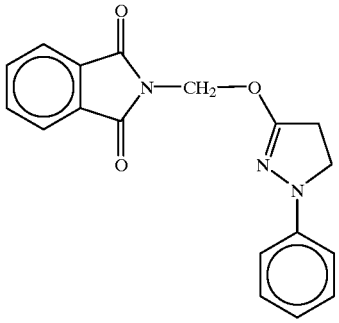
(ETA-19)
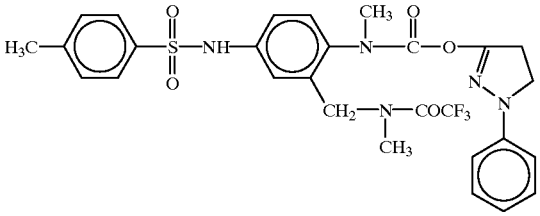

-continued (ETA-20)

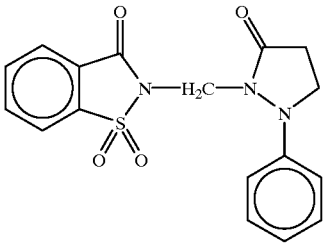

The above compound may be added to any of the light-sensitive layer, an intermediate layer, an undercoat layer, and a protective layer of a light-sensitive material, and preferably it is added to and used in a non-light-sensitive layer, when the auxiliary developing agent is contained in the light-sensitive material.

The methods of incorporating the compound into the light-sensitive material include, for example, a method of dissolving the compound in a water-miscible organic solvent, such as methanol, and directly adding this to a hydrophilic colloidal layer; a method of forming an aqueous solution or a colloidal dispersion of the compound, with a surface-active agent also contained, and adding the same; a method of dissolving the compound into a solvent or oil substantially immiscible with water, and then dispersing the solution into water or a hydrophilic colloid, and then adding the same; or a method of adding the compound, in a state of a dispersion of fine solid particles. The known methods may be applied singly or in combination. A method of preparing a dispersion of solid fine particles is described in detail on page 20 in JP-A-2-235044.

The amount of the compound to be added in a light sensitive material is generally 1 mol % to 200 mol %, preferably 5 mol % to 100 mol %, and more preferably 10 mol % to 50 mol %, to the color-developing compound.

As the support (base) to be used in the present invention, any support can be used if it is a transmissible support or reflective support, on which a photographic emulsion layer can be coated, such as glass, paper, and plastic film. As the plastic film to be used in the present invention, for example, polyester films made, for example, of polyethylene terephthalates, polyethylene naphthalates, cellulose triacetate, or cellulose nitrate; polyamide films, polycarbonate films, and polystyrene films can be used.

"The reflective support" that can be used in the present invention refers to a support that increases the reflecting properties to make bright the dye image formed in the silver halide emulsion layer. Such a reflective support includes a support coated with a hydrophobic resin containing a light-reflecting substance, such as titanium oxide, zinc oxide, calcium oxide, and calcium sulfate, dispersed therein, or a support made of a hydrophobic resin itself containing a dispersed light-reflecting substance. Examples are a polyethylene-coated paper, a polyester-coated paper, a polypropylene-series synthetic paper, a support having a reflective layer or using a reflecting substance, such as a glass sheet; a polyester film made, for example, of a polyethylene terephthalate, cellulose triacetate, or cellulose nitrate; a polyamide film, a polycarbonate film, a polystyrene film, and a vinyl chloride resin. As the polyester-coated paper, particularly a polyester-coated paper whose major component is a polyethylene terephthalate, as described in EP-0 507 489, is preferably used.

The reflective support to be used in the present invention is preferably a paper support, both surfaces of which are coated with a water-resistant resin layer, and at least one of the water-resistant resin layers contains fine particles of a white pigment. Preferably the particles of a white pigment are contained in a density of 12% by weight or more, and more preferably 14% by weight or more. Preferably the light-reflecting white pigment is kneaded well in the presence of a surface-active agent, and the surface of the pigment particles is preferably treated with a dihydric to tetrehydric alcohol.

In the present invention, a support having the second kind diffuse reflective surface can also be used, preferably. "The second kind diffuse reflectivity" means diffuse reflectivity obtained by making a specular surface uneven, to form finely divided specular surfaces facing different directions. The unevenness of the second kind diffuse reflective surface has a three-dimensional average coarseness of generally 0.1 to 2 $\mu$m, and preferably 0.1 to 1.2 $\mu$m, for the center surface. Details about such a support are described in JP-A-2-239244.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of three layers of a green-sensitive layer, a red-sensitive layer, and an infrared-sensitive layer, and the like can be coated on the above support. The photosensitive layers can be arranged in various orders known generally for color light-sensitive materials. Further, each of these light-sensitive layers can be divided into two or more layers if necessary.

In the light-sensitive material, photographic constitutional layers comprising the above photosensitive layers and various non-photosensitive layers, such as a protective layer, an underlayer, an intermediate layer, an antihalation layer, and a backing layer, can be provided. Further, in order to improve the color separation, various filter dyes can be added to the photographic constitutional layer.

As a binder or a protective colloid that can be used in the light-sensitive material according to the present invention, a gelatin is advantageously used, and other hydrophilic colloids can be used alone or in combination with a gelatin. The calcium content of gelatin is preferably 800 ppm or less, and more preferably 200 ppm or less. The iron content of gelatin is preferably 5 ppm or less, and more preferably 3 ppm or less. Further, in order to prevent the proliferation of various molds and bacteria that will proliferate in a hydrophilic colloid layer to deteriorate an image, preferably mildew-proofing agents, as described in JP-A-63-271247, are added.

The total amount of gelatin of the light-sensitive material for use in the present invention is generally 1.0 to 30 g, and preferably 2.0 to 20 g, per $m^2$. In the swelling of the light-sensitive material in an alkali solution having a pH of 12, the time for the swelled film thickness to reach ½ of its saturated swelled film thickness (90% of the maximum swelled thickness) is preferably 15 sec or less, and more preferably 10 sec or less. Further, the swelling rate [(maximum swelled film thickness—film thickness)/film thickness×100] is preferably 50 to 300%, and particularly preferably 100 to 200%.

When the light-sensitive material for use in the present invention is subjected to printer exposure, it is preferable to use a band stop filter described in U.S. Pat. No. 4,880,726, by which light-color-mixing can be removed, to noticeably improve color reproduction.

The light-sensitive material for use in the present invention is used in a usual printing system, in which a negative printer is used, and it is also suitable for a scanning exposure system, in which a cathode ray (CRT) is used.

In comparison with apparatuses using lasers, cathode ray tube exposure apparatuses are simple and compact and make the cost low. Further, the adjustment of optical axes and colors is easy.

For the cathode ray tubes used for image exposure, use is made of various emitters that emit light in spectral regions as required. For example, any one of, or a mixture of two or more of, a red-color emitter, a green-color emitter, and a blue-color emitter may be used. The spectral region is not limited to the above red, green, and blue, and a phosphor that emits a color in the yellow, orange, purple, or infrared region may also be used. In particular, a cathode ray tube that emits white light by mixing these emitters is often used.

When the light-sensitive material has plural light-sensitive layers different in spectral sensitivity distributions, and the cathode ray tube has phosphors that show light emission in plural spectral regions, plural colors may be exposed at a time; namely, image signals of plural colors are inputted into the cathode ray tube, to emit lights from the tube surface. A method in which exposure is made in such a manner that image signals for respective colors are inputted successively, to emit the respective colors successively, and they are passed through filters (films) for cutting out other colors (surface-successive exposure), may be employed, and generally the surface-successive exposure is preferred to make image quality high, since a high-resolution cathode ray tube can be used.

The light-sensitive material for use in the present invention is preferably used for digital scanning exposure system that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and desired is the use of a semiconductor laser in at least one exposure light sourse.

If such a scanning exposure light source is used, the spectral sensitivity maximum of the light-sensitive material for use in the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three regions, the blue region, the green region and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III-V group semiconductor laser is present now only in from the red region to the infrared region. However, on the laboratory level, the oscillation of a II-VI group semiconductor laser in the green or blue region is confirmed and it is highly expected that these semiconductor lasers can be used inexpensively and stably if production technique for the semiconductor lasers be developed. In that event, the necessity that each of at least two layers has a spectral sensitivity maximum at 670 nm or over becomes lower.

In such scanning exposure, the time for which the silver halide in the light-sensitive material is exposed to light is the time for which a certain very small area is required to be exposed to light. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is generally from 50 to 2,000 dpi. If the exposure time is defined as the time for which a picture element size is exposed to light with the density of the picture element being 400 dpi, preferably the exposure time is $10^{-4}$ sec or less, more preferably $10^{-6}$ sec or less. The lower limit of the exposure time is nor particularly limited, but it is preferably $10^{-8}$ sec or more.

The silver halide grains used in the present invention are made of silver bromide, silver chloride, silver iodide, silver chlorobromide, silver chloroiodide, silver iodobromide, or silver chloroiodobromide. Other silver salts, such as silver rhodanate, silver sulfide, silver selenide, silver carbonate, silver phosphate, or a silver salt of an organic acid, may be contained in the form of independent grains or as part of silver halide grains. If it is desired to make the development/desilvering (bleaching, fixing, and bleach-fix) step rapid, a so-called high-silver-chloride grains having the silver chloride content of 90 mol % or more are desirable. Further, if the development is to be restrained moderately, it is preferable to contain silver iodide. The preferable silver iodide content varies depending on the intended light-sensitive material.

In the high-silver-chloride emulsion used in the present invention, preferably there is provided a silver bromide localized phase having a layered structure or a non-layered structure in each silver halide grain and/or on each silver halide grain surface. The halogen composition of the localized phase has a silver bromide content of preferably at least 10 mol %, and more preferably over 20 mol %. Silver bromide contents of the silver bromide localized phase can be analyzed by using a method such as X-ray diffraction (described in such books as "Shin-jikken Kagaku-koza 6/Kozo Kaiseki", edited by Nohonkagakukai, Maruzen). Further, these localized phase can be formed in the grain, at the edges, corners, or planes of surface of grain, as one of preferable examples, a phase which is formed by epitaxial growth on a corner of grain can be mentioned.

Further, for the purpose of lowering the replenishing rate of the development processing solution, it is also effective to further increase the silver chloride content of the silver halide emulsion. In such a case, an emulsion of almost pure silver chloride, having a silver halide content, for example, of 98 to 100 mol %, is also preferably used.

The value obtained by dividing the diameter of the projected area, which is assumed to be a circle, by the thickness of the grain, is called an aspect ratio, which defines the shape of tabular grains. Tabular grains having an aspect ratio grater than 1 can be used in the present invention. The average aspect ratio of 80% or more of all the projected areas of grains is desirably 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,797,354, is a preferable mode.

As the emulsion used in the present invention, an emulsion having a wide grain size distribution, that is, a so-called polydisperse emulsion, or an emulsion having a narrow grain size distribution, that is, a so-called monodisperse emulsion, can be chosen and used in accordance with the purpose. As the scale for representing the size distribution, the diameter of the projected area of the grain equivalent to a circle, or the deviation coefficient of the diameter of the grain volume equivalent is to a sphere, may be used. If a monodisperse emulsion is used, it is suitable to use an emulsion having such a size distribution that the deviation coefficient is generally 25% or below, more preferably 20% or below, and further more preferably 15% or below.

To the photographic material for use in the present invention, may be added the above-mentioned various additives, and also other various additives in accordance with the purpose.

These additives are described in more detail in Research Disclosure, Item 17643 (December 1978); Research Disclosure, Item 18176 (November 1979); and Research Disclosure, Item 307105 (November 1989), and the particular parts are given below in a table.

| Additive | RD 17643 | RD 18716 | RD 307105 |
|---|---|---|---|
| 1 Chemical sensitizers | p.23 | p.648 (right column) | p.996 |
| 2 Sensitivity-enhancing agents | — | p.648 (right column) | — |
| 3 Spectral sensitizers and Supersensitizers | pp.23–24 | pp.648 (right column)–649 (right column) | pp.996 (right column)–998 (right column) |
| 4 Brightening agents | p.24 | — | p.998 (right column) |
| 5 Antifogging agents and Stabilizers | pp.24–25 | p.649 (right column) | pp.998 (right column)–1000 (right column) |
| 6 Light absorbers, Filter dyes, and UV Absorbers | pp.25–26 | pp.649 (right column)–650 (left column) | p.1003 (left to right column) |
| 7 Stain-preventing agents | p.25 (right column) | p.650 (left to right column) | — |
| 8 Image dye stabilizers | p.25 | — | — |
| 9 Hardeners | p.26 | p.651 (left column) | pp.1004 (right column)–1005 (left column) |
| 10 Binders | p.26 | p.651 (left column) | pp.1003 (right column)–1004 (right column) |
| 11 Plasticizers and Lubricants | p.27 | p.650 (right column) | p.1006 (left to right column) |
| 12 Coating aids and Surfactants | pp.26–27 | p.650 (right column) | pp.1005 (left column)–1006 (left column) |
| 13 Antistatic agents | p.27 | p.650 (right column) | pp.1006 (right column)–1007 (left column) |

In the present invention, the processing solution is coated on the surface of a light-sensitive material by means of a coating apparatus for use in the present invention. Accordingly, the light-sensitive material is necessary to easily become wet with the processing solution. In the present invention, a surface-active agent is preferably coated on the furthest layer from a support, among hydrophilic colloid layers of the light-sensitive material, in order to improve the wetting property of the surface of the light-sensitive material. of the surface-active agents, betain-series surface-active agents, fluorine atom-containing surface-active agents, and the like are preferred. Further, from the viewpoint that the wetting property is improved by easy permeation of a processing solution into a light-sensitive material, a hydrophilic polymer or the like is also preferably incorporated in the furthest layer from a support, among hydrophilic colloid layers of the light-sensitive material. Preferable examples of the hydrophilic polymer include acrylic acid-series polymers, polyvinyl alcohols, and copolymers of acrylic acid and vinyl alcohol.

A processing method for use in the present invention is explained below.

In the present invention, the processing steps are composed of the coating step of an alkaline processing solution, the coating step of a peroxide-containing solution, the development intensification step, and the washing step, and in addition thereto the stabilization step, depending on the case.

Each of the steps is explained below in detail.

The alkaline processing solution to be used in the alkaline processing solution-cating step is explained. It is one of characteristics of the present invention that the alkaline processing solution for use in the present invention is substantially free from any of the above color-developing compounds including p-phenylenediamine-series color-developing agents and peroxides, and the alkaline processing solution may contain another component (e.g. an alkali, a halogen, and a chelating agent). Further, in some cases, in order to keep processing stability, preferably the alkaline processing solution does not contain any reducing agent, and in that case, preferably the alkaline processing solution is substantially free from any of auxiliary developing agents, hydroxylamines, sulfites, and the like. Herein, the term "substantially free from" means that in each case the content is preferably 0.5 mmol/liter or less, more preferably 0.1 mmol/liter or less, and particularly preferably zero (not contained at all).

The pH of the alkaline processing solution for use in the present invention is preferably 9 to 14, and particularly preferably 10 to 14.

In the first embodiment of the present invention, an alkaline processing solution is coated on the surface of a light-sensitive material. In this case, the coated alkaline processing solution is required to be spread thoroughly on the surface of a light-sensitive material, and for this purpose, the surface tension is preferably not more than 60 dyn/cm, and more preferably not more than 45 dyn/cm. In order to adjust the surface tension within the above-mentioned range, a water-soluble stilbene compound and/or a fluorosurface-active agent having a polyoxyalkylene group, as described in Japanese Pat. Application No. 44586/1998, is preferably added.

In the second embodiment of the present invention, an alkaline processing solution is applied onto the light-sensitive material, by a method of dipping a light-sensitive material in an alkaline processing solution, or by a method of contacting a light-sensitive material with a coating part of a coating apparatus of an alkaline processing solution, to apply the alkaline processing solution onto the light-sensitive material (a method of contact-coating). Any known method can be used, if the method is to realize either of the above concept. Examples of the method for dipping a light-sensitive material in an alkaline processing solution include a tank processing method in a usual processing tank, a method for passing a light-sensitive material through a thin slit, and a dip coating. Further, examples of the method for applying an alkaline processing solution on a light-sensitive material by contacting the light-sensitive material and a coating part of the alkaline processing solution-coating device, include methods for coating an alkaline processing solution contained in a material that absorbs the same, such as a roller coater, a rod coater, a squeeze coater, a felt cloth, and a sponge coater. Details on these methods are described in, for example, by Yuji Harazaki, *Kotingu Gaku (Coating Studies)* (pp. 253 to 255 in particular), Asakurashoten (1981), and *Kami Kako Benran (Paper Processing Handbook),* edited by Shigyo Taimusu Co. (Paper Industry Times Company), pp. 129 to 138 (1973).

In the third embodiment of the present invention, an alkaline processing solution may be applied onto the light-sensitive material by any method for applying the same. Examples of the method for dipping a light-sensitive material in an alkaline processing solution include a tank processing method, in which an ordinary tank is used; a method for passing a light-sensitive material through a thin slit, as described in Japanese Registered Pat. No. 2612205; and a dip coating. Further, examples of the method for applying an alkaline processing solution on a light-sensitive material by contacting the light-sensitive material and a coating part of the alkaline processing solution-coating device, include methods for coating an alkaline processing solution contained in a material that absorbs the same, such as a roller coater, a rod coater, a squeeze coater, a felt cloth, and a sponge coater, as described in, for example, by Yuji Harazaki, *Kotingu Gaku (Coating Studies)* (pp. 253 to 255 in particular), Asakurashoten (1981), and *Kami Kako Benran (Paper Processing Handbook)*, edited by Shigyo Taimusu Co. (Paper Industry Times Company), pp. 129 to 138 (1973). Examples of the method for applying an alkaline processing solution on a light-sensitive material without contact with a coating device, include methods for spraying a processing solution injected from a narrow nozzle, as described in JP-A-6-324455 and JP-A-9-179272.

A coating processing is preferred from the viewpoint that a processing device of small size can be made, and a waste amount is small, when "full use of the processing solution" processing is practiced. Of the coating processings, "non-contact" coating processing is preferred from the viewpoint that a coating part of the coating device can be prevented from contamination with an effluence from a coated portion of the light-sensitive material. A coating method using the processing solution-coating device described in JP-A-9-17927 hereinafter referred to, is further preferred from the viewpoint that a small amount of a solution can be coated uniformly.

Further, in the present invention, a method for repeatedly and multiply coating a developing solution can also be used. Further, it is also possible to remove an alkaline processing solution in excess amount of swelling by squeezing the coated processing solution.

In the third embodiment of the present invention, an alkaline processing solution can be coated on the surface of a light-sensitive material. In this case, the coated alkaline processing solution is required to be spread thoroughly on the surface of a light-sensitive material, and for this purpose, the surface tension is preferably not more than 60 dyn/cm, and more preferably not more than 45 dyn/cm.

The surface tension of the alkaline processing solution may be reduced by any method for doing so. To reduce the surface tension, it is conceivable to add thereto a surface-active agent. Further, it is usually conceivable to add thereto a water-soluble alcoholic organic solvent, such as methanol, ethanol, isopropyl alcohol, and glycol.

However, the use of the former method is not preferred, in that, because pressure and reduced pressure are repeatedly applied in a coating device, bubbles easily form, and because the generated bubbles attach to the surface of a nozzle, a portion of the nozzle from which an alkaline processing solution cannot be sprayed is produced by them; as a result, white spots arise in the processed light-sensitive material. On the other hand, the case wherein a water-soluble alcoholic organic solvent is added is not preferred, in that a large amount of the alcoholic organic solvent must be added in order to reduce the surface tension, and when a large amount of the alcoholic organic solvent is added, the osmotic speed of a processing solution to the light-sensitive material becomes slow, which results in a delay of the development progress.

In contrast to the above-described compounds, a water-soluble stilbene compound is preferred, in that few bubbles form, and the surface tension can be reduced by adding a small amount of the compound. Of these stilbene compounds, diaminostilbenes represented by formula (X) are effective, in that the compound is able to reduce the surface tension, even in a small amount thereof. The diaminostilbene compounds represented by formula (X) are also preferred, in that the degree at which the compound reduces the contact angle with a metal is low, even when added to a processing solution.

formula (X)

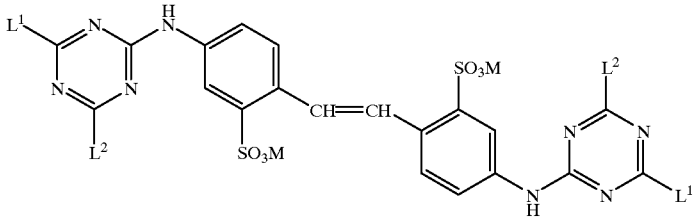

In formula (X), $L^1$ and $L^2$, which are the same or different, each represent —$OR^1$ or —N—$R^2(R^3)$, and four substituents $L^1$ and $L^2$ in formula (X) have at least two substituents in the group of formula (XI) in total, in which $R^1$ and $R^2$ each represent a hydrogen atom, an alkyl group, an aryl group, or an alkyl or aryl group that has a substituent in the following formula (XI) group; and $R^3$ represents an alkyl group, an aryl group, or an alkyl or aryl group that has a substituent in the following formula (XI) group.

—$SO_3M$, —$OS_3M$, —COOM, —$NR_3X$ formula (XI)

In formula (XI), X represents a halogen atom, R represents an alkyl group, and M in formulae (X) and (XI) represents a hydrogen atom, an alkali metal, a tetraalkylammonium group, or a pyridinium group.

Of the diaminostilbene compounds for use in the present invention, compounds that each have a —$SO_3M$ group in the group of groups represented by formula (XI) are preferred. In addition, those in which $L^1$ and $L^2$ are —N—$R^2$($R^3$) and $R^2$ is a hydrogen atom, are more preferred. Further, compounds that each have at least four —$SO_3M$ groups are still more preferred.

The amount of the diaminostilbene compound to be added for use in the present invention is preferably from 0.1 to 10 mmol/L, and more preferably from 0.5 to 6 mmol/L. Outside of the above-described range is not preferred, because the surface tension cannot be reduced sufficiently with an amount below the range, whereas both deposition and reduction in the contact angle with a nozzle arise with an amount above the range.

Preferable specific examples of the diaminostilbene compound are illustrated in Table 1, which, however, are not intended to restrict the scope of the invention.

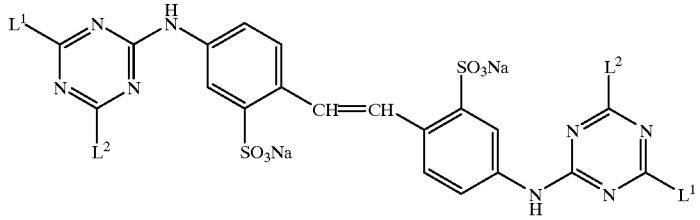

TABLE 1

| Compound No. | $L^1$ | $L^2$ |
|---|---|---|
| SR-1 | —$OC_2H_4SO_3Na$ | —$OC_2H_4SO_3Na$ |
| SR-2 | —$OC_2H_4OSO_3Na$ | —$OC_2H_4OSO_3Na$ |
| SR-3 | —N($C_2H_4OSO_3Na$)($C_2H_4OSO_3Na$) | —N($C_2H_4OSO_3Na$)($C_2H_4OSO_3Na$) |
| SR-4 | —$OC_2H_4SO_3H$ | —$OC_2H_4SO_3H$ |
| SR-5 | —$NHC_2H_4SO_3H$ | —$NHC_2H_4SO_3H$ |
| SR-6 | —$NHC_2H_4SO_3(NH_4)$ | —$NHC_2H_4SO_3(NH_4)$ |
| SR-7 | —$NHC_2H_4COOH$ | —$NHC_2H_4COOH$ |
| SR-8 | " | —$NHC_2H_4SO_3Na$ |
| SR-9 | —$NHC_2H_4COONa$ | —$NHC_2H_4COONa$ |
| SR-10 | " | —$NHC_2H_4SO_3Na$ |
| SR-11 | —$N(CH_3)_3Cl$ | —$N(CH_3)_3Cl$ |
| SR-12 | —$OC_2H_4OSO_3Na$ | —$OC_2H_4OSO_3Na$ |
| SR-13 | —$NHC_2H_4SO_3Na$ | —$NHC_2H_4SO_3Na$ |
| SR-14 | —N($CH_3$)($C_2H_4SO_3Na$) | —N($CH_3$)($C_2H_4SO_3Na$) |
| SR-15 | —N($C_2H_5$)($C_2H_4SO_3Na$) | —N($C_2H_5$)($C_2H_4SO_3Na$) |
| SR-16 | —N($C_2H_4SO_3Na$)($C_2H_4SO_3Na$) | —N($C_2H_4SO_3Na$)($C_2H_4SO_3Na$) |
| SR-17 | —N($C_2H_4SO_3Na$)($C_2H_4SO_3Na$) | —$OCH_3$ |
| SR-18 | " | —$OC_2H_5$ |
| SR-19 | " | —$OC_2H_4OH$ |

TABLE 1-continued

| Compound No. | $L^1$ | $L^2$ |
|---|---|---|
| SR-20 | " | 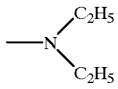 |
| SR-21 | " | $—NHC_2H_4OH$ |
| SR-22 | " | $—OC_2H_4NH_2$ |
| SR-23 | " | 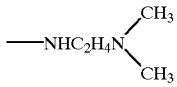 |
| SR-24 | $—NHC_2H_4SO_3Na$ | $—OC_2H_4SO_3Na$ |
| SR-25 | " | 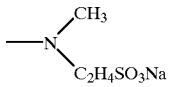 |
| SR-26 | " | 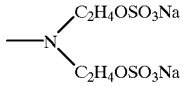 |
| SR-27 | " | $—NHC_2H_4COONa$ |
| SR-28 | $—NHCH_2CH_2SO_3Na$ | 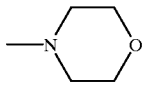 |
| SR-29 | $—NHCO_2CH_2COONa$ | 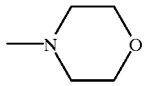 |
| SR-30 | 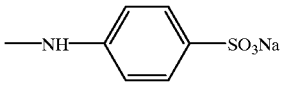 | 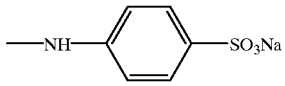 |
| SR-31 | 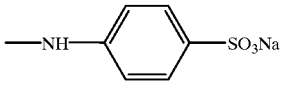 | 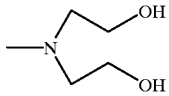 |
| SR-32 | 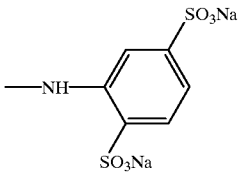 | 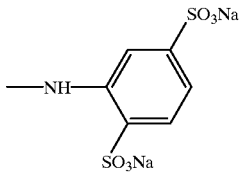 |
| SR-33 | 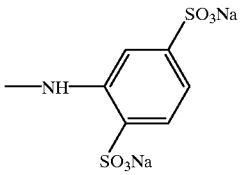 | 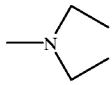 |

Further, of the surface-active agents, a fluorosurface-active agent having a polyoxyalkylene group is also preferably added, to achieve the objects of the present invention, in that the surface tension can be reduced by a small amount of the compound, and in addition, few bubbles form.

In the above-described formula:

$$Rf—(A)_m—X$$

X is especially preferably a substituted or unsubstituted polyoxyethylene group, wherein the number of the oxyethylene group is preferably from 5 to 30, in the present invention.

Further, Rf is preferably a fluoroalkyl, fluoroalkenyl, or fluoroaryl group, each having at least 4 carbon atoms, and more preferably a perfluoroalkyl, perfluoroalkenyl, or perfluoroaryl group, each having 6 to 14 carbon atoms. A represents preferably an alkylene group (which includes a substituted one, e.g. ethylene, trimethylene, oxyalkylene), an arylene group (which includes a substituted one, e.g. phenylene, oxyphenylene), an alkylarylene group (which includes a substituted one, e.g. propylphenylene), or an arylalkylene group (which includes a substituted one, e.g. phenylethylene, phenyloxyethylene). These groups may include divalent linking groups that are intercepted by a hetero atom, or a hetero group, such as an oxygen atom, an ester group, an amide group, a sulfonamide group, a sulfonyl group, and a sulfur atom. The case in which m is 0 is more preferred. When m is 1, A is preferably an alkylene group.

The amount of the fluorosurface-active agent having a polyoxyalkylene group to be added for use in the present invention is preferably from 0.1 to 5 mmol/L, and more preferably from 0.5 to 1 mmol/L. Outside of the above-described range is not preferable, because the surface tension cannot be reduced sufficiently with an amount below the range, whereas both deposition and reduction in contact angle with a nozzle arise with an amount above the range.

Further, a preferable measure is to coat the surface of a nozzle with a fluororesin, to prevent a reduction in the contact angle with the nozzle.

Preferable specific examples of the fluorosurface-active agents having a polyoxyalkylene group for use in the present invention are shown below, which, however, are not intended to restrict the scope of the invention.

F-1

$C_7F_{15}COO-(CH_2CH_2)_{10}-H$

F-2

$C_{10}F_{21}COO-(CH_2CH_2)_{10.5}-H$

F-3

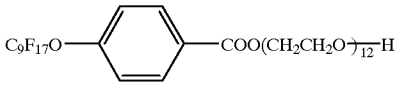

F-4

$C_8F_{17}SO_2N(CH_3)-(CH_2CH_2O)_9H$

F-5

$C_8F_{17}SO_2N(C_{10}H_{21})-(CH_2CH_2O)_{11.5}-H$

F-6

$C_6F_{13}SO_2N\langle(CH_2CH_2O)_n-H,\ (CH_2CH_2O)_m-H\rangle$ n + m = 11.5

F-7

$C_8F_{17}SO_2N(C_3H_7)-(CH_2CH_2O)_{15}-H$

-continued

F-8

$C_8F_{17}SO_2N(C_2H_5)-(CH(CH_3)-CH_2-O)_3-(CH_2CH_2O)_{13.5}-H$

F-9

$C_8F_{17}CH_2CH_2O-(CH_2CH_2O)_{12.5}-H$

F-10

$C_8F_{17}SO_2N(C_3H_7)-CH_2COO-(CH_2CH_2O)_{9.5}-H$

F-11

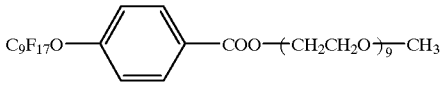

F-12

$C_9F_{19}O-(CH_2CH_2O)_9-CH_3$

F-13

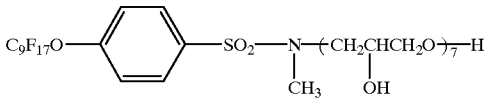

F-14

$C_7F_{15}COO-(CH_2CH(CH_3)-O)_4-(CH_2CH_2O)_{20}-H$

F-15

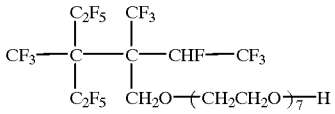

F-16

$H(CF_2)_5-CH_2O-CH_2CH(O-(CH_2CH_2O)_8-H)CH_2O-CH_2CF_2CF_2H$

F-17

$C_8F_{17}SO_2N(C_3H_7)-(CH_2CH(OH)-CH_2-O)_2-(CH_2CH_2O)_{10}-H$

As mentioned above, it is possible to maintain the stability of a processing solution for use in the intensification processing, and in addition, to carry out the processing with a small amount of a processing solution, by separately applying an alkaline solution and a peroxide-containing solution to a light-sensitive material having incorporated therein a color-developing compound, and by applying the peroxide-containing solution with a coating method in which use is made of a processing solution-coating apparatus, as described in JP-A-9-179272. However, when the peroxide-containing solution is coated onto the area where an alkaline solution has been coated by means of the processing solution-coating apparatus, a problem may arise in that sufficient color-formation does not occur, especially at the end portion where the solution is coated. The third embodiment of the present invention can solve this problem.

In the first and third embodiments of the present invention, a processing solution-coating apparatus described in JP-A-9-179272 is preferably used to coat an alkaline processing solution on a light-sensitive material.

This coating apparatus is now explained in detail.

FIG. 1 is a schematic structural view of the entire structure of a processing solution-coating apparatus for use in practice of the present invention. The apparatus for use in the first embodiment of the present invention has coating devices for an alkaline processing solution and for a peroxide-containing solution, respectively, as shown in the figure.

In the meantime, the apparatus used in the second embodiment of the present invention has the coating device, as shown in the figure, for a peroxide-containing solution.

Further, the apparatus used in the third embodiment of the present invention has the coating device, as shown in the figure, for a peroxide-containing solution, and the apparatus may further have the device for an alkaline processing solution, if necessary.

As illustrated in FIG. 1, a spray tank 312, which composes a part of the coating apparatus 310, is disposed at a position intersecting a conveying path A of a light-sensitive material 16, carrying thereon a processing solution-coating section 50. 32 indicates conveying rollers for the light-sensitive material 16. 34 indicates winding rollers of the processed light-sensitive material.

As illustrated in FIG. 1, at the left side below the spray tank 312, a processing solution bottle 332, for accumulating a processing solution supplied to the spray tank 312, is disposed, and above the processing solution bottle 332, a filter 334, for filtering a processing solution, is disposed. Further, a water pipe 342, on the route of which a pump 336 is disposed, connects the processing solution bottle 332 and the filter 334.

Further, to the right of the spray tank 312, a sub-tank 338, in which a processing solution sent (supplied) from the processing solution bottle 332 is accumulated, is disposed, and the water pipe 344 extends from the filter 334 up to the sub-tank 338.

Accordingly, when the pump 336 works, a processing solution is sent from the processing solution bottle 332 toward the filter 334 side, and further water, which is filtered through the filter 334, is sent to the sub-tank 338, so that the processing solution is once accumulated into the sub-tank 338.

Further, a water pipe 346, connecting the-sub tank 338 and the spray tank 312, is disposed between them, and the processing solution, sent by the pump 336 from the processing solution bottle 332 through the filter 334, sub-tank 338, water pipe 346, or the like, is filled in the spray tank 312.

A tray 340, connected by a circulation pipe 348 to the processing solution bottle 332, is disposed beneath the spray tank 312, so that the tray 340 can collect a processing solution (water) overflowed from the spray tank 312, and the overflowed processing solution is returned to the processing solution bottle 332 through the circulation pipe 348. Further, the circulation pipe 348 is arranged to connect to the sub-tank 338, in a state in which the same extends prominently up to the interior of the sub-tank 338, so that an excessive amount of water accumulated in the sub-tank 338 can be returned to the processing solution bottle 332.

Further, next to the spray tank in FIG. 1, generally there are steps of keeping warm on a heat panel, desilvering, washing, and drying, each of which is not illustrated in the figure. The heat panel is set in such a manner that it is positioned, throughout far from the side of the conveying rollers (from the left end of the figure in FIG. 1) to before the desilvering step. Generally, a light-sensitive material is placed on the panel and conveyed.

Next, the construction of the spray tank 312 and its function will be explained in detail, with reference to FIG. 2 to FIG. 5.

Figure 2:
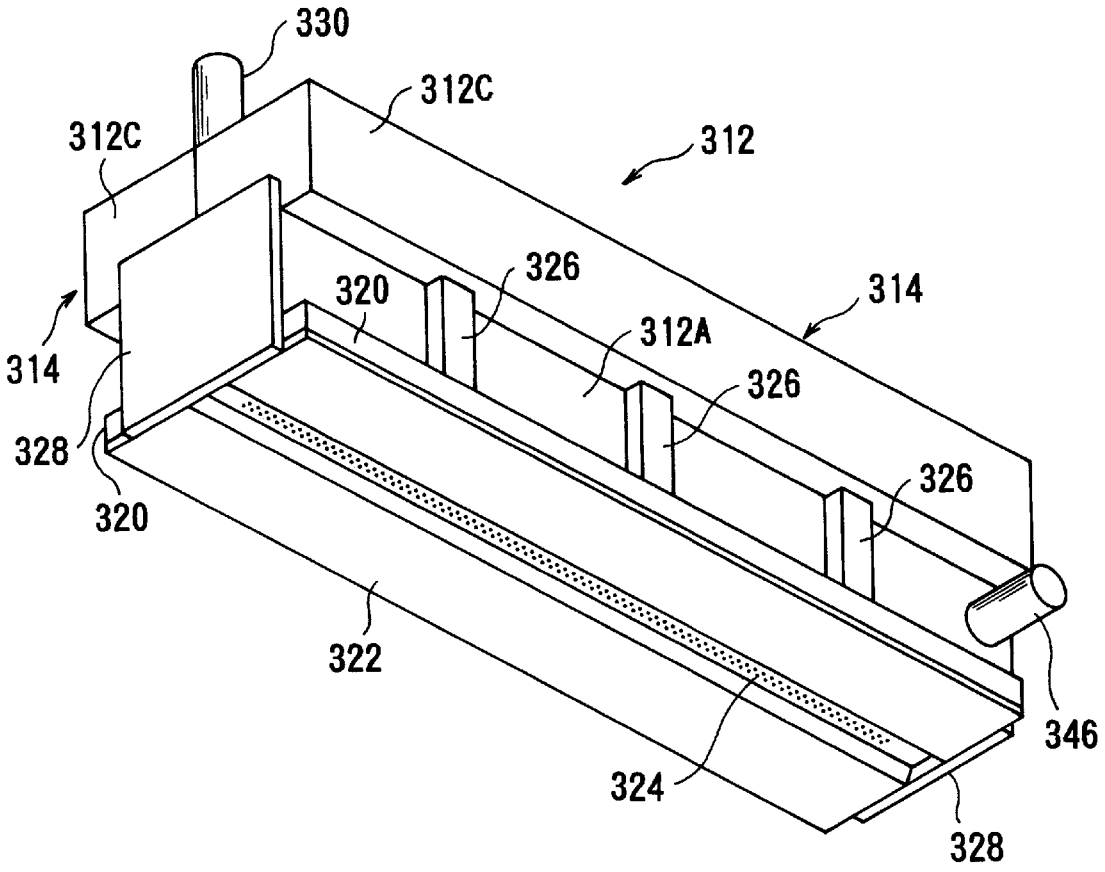
FIG. 2 is an enlarged perspective view of a spray tank used in practice of the present invention.
Figure 3:
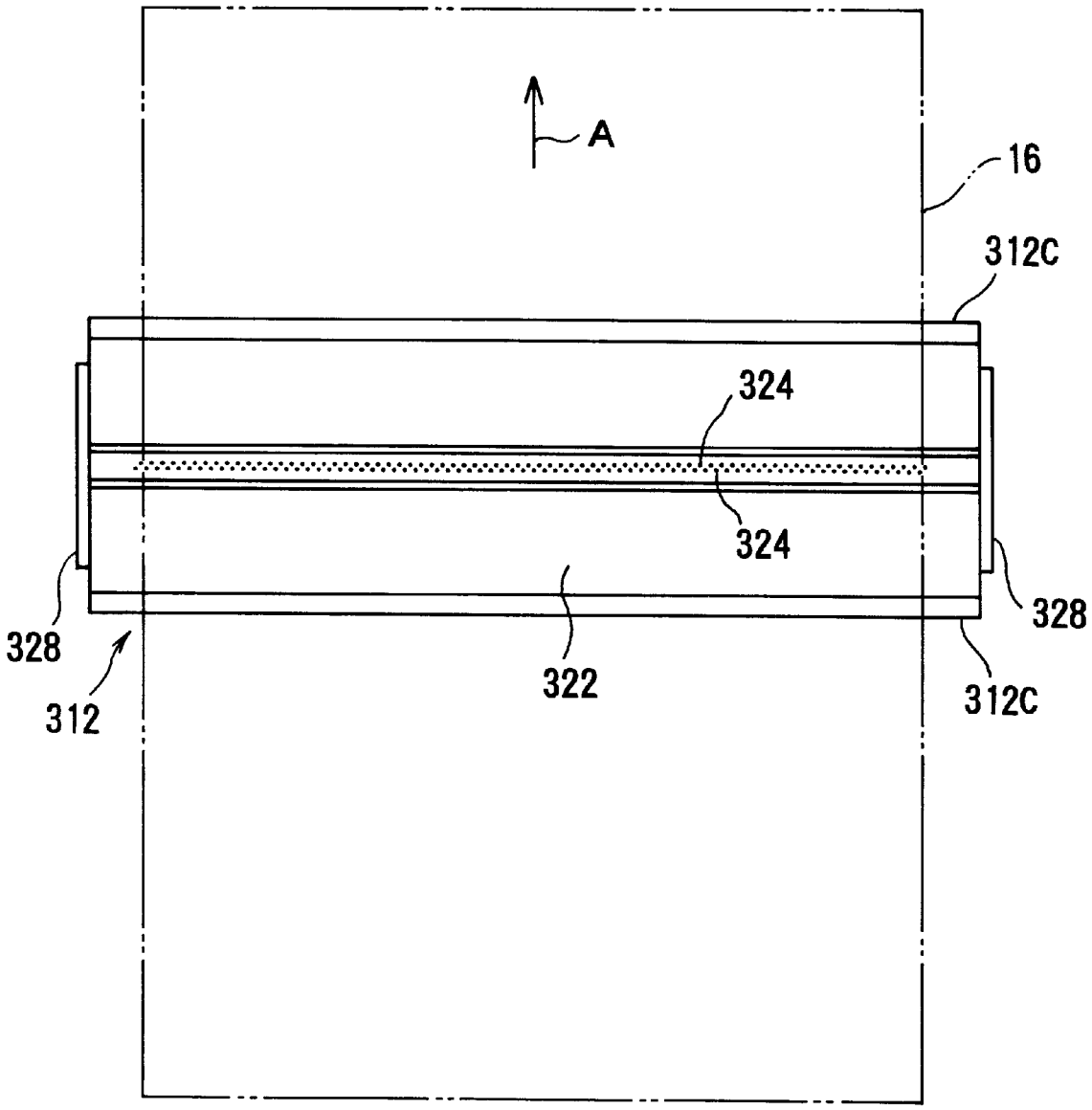
FIG. 3 is a bottom view showing a state in which a light-sensitive material is conveyed under a spray tank used in practice of the present invention.
Figure 4:
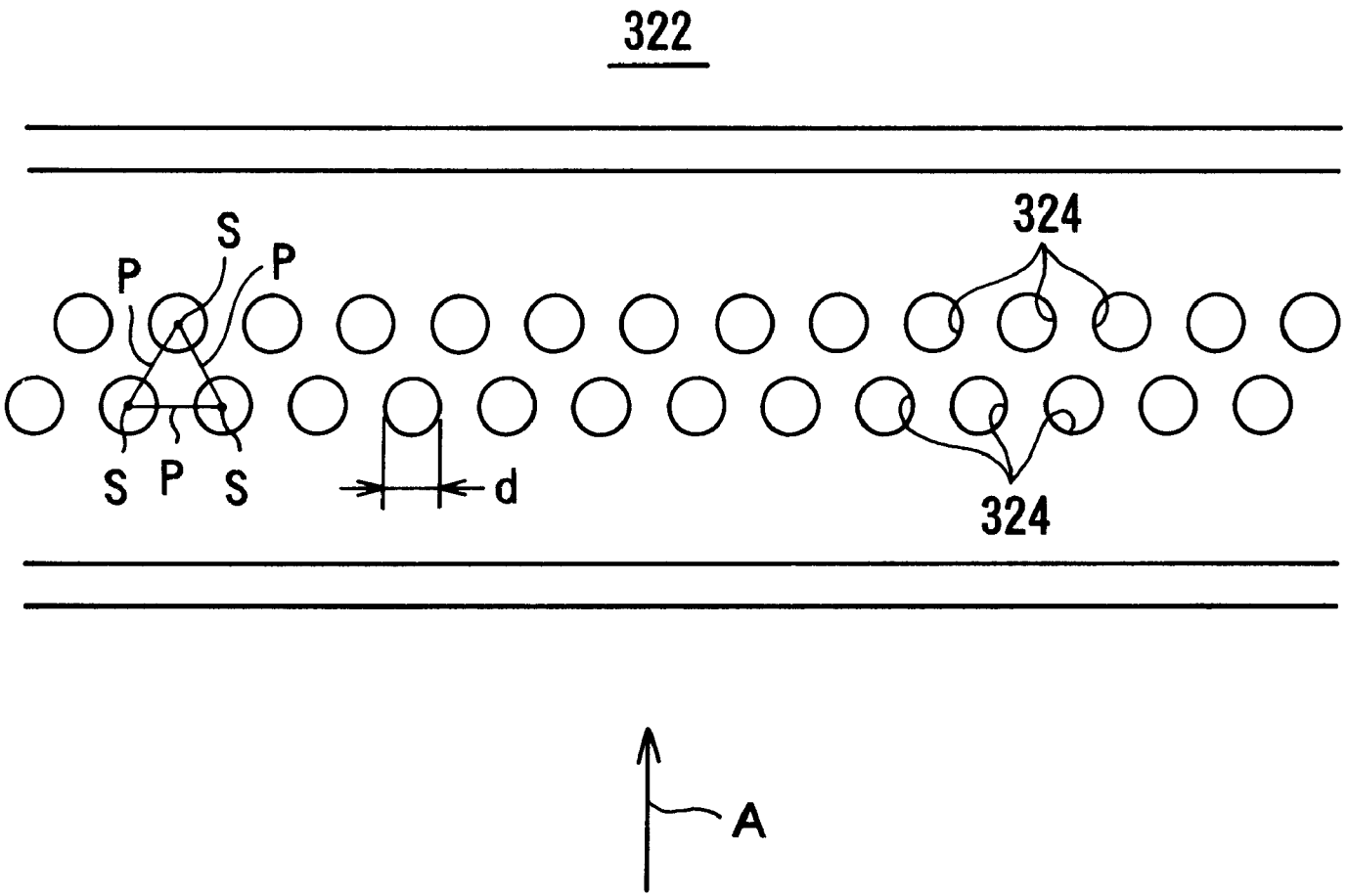
FIG. 4 is an enlarged view of the principal part shown in FIG. 3.
Figure 5:
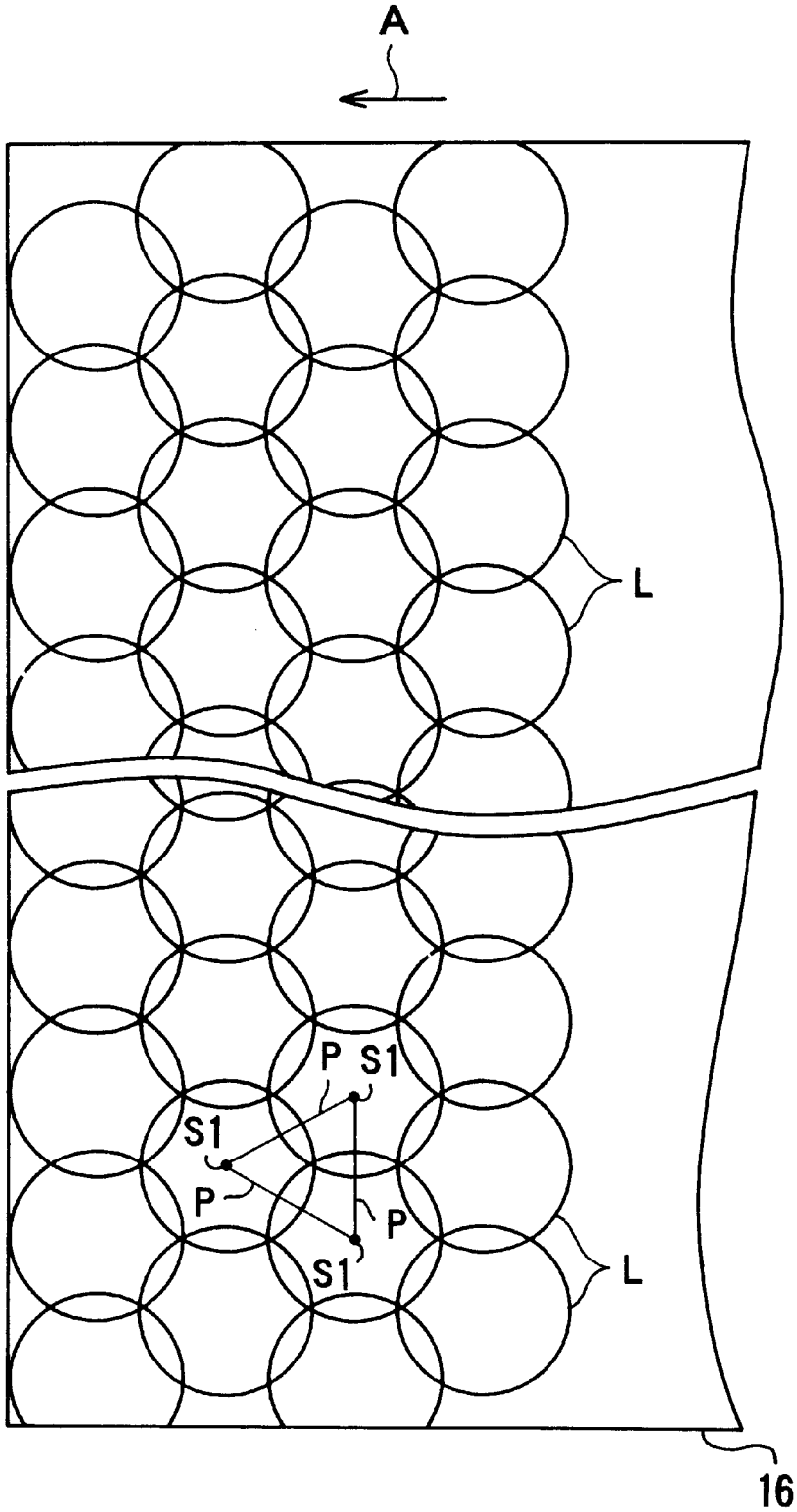
FIG. 5 is a plane view of a light-sensitive material showing a state in which liquid droplets of a processing solution are sprayed from nozzle holes of the spray tank, and they are coated on the light-sensitive material for use in the present invention.

FIG. 2 is an enlarged diagonal structural view of the spray tank, FIG. 3 is a bottom view of the spray tank showing a state in which a light-sensitive material is conveyed under the spray tank, FIG. 4 is an enlarged view of the principal part shown in FIG. 3, and FIG. 5 is a plane view of a light-sensitive material showing a state in which liquid droplets of a processing solution are sprayed from nozzle holes of the spray tank, and they are coated on the light-sensitive material.

As illustrated in FIG. 3, at a portion of the wall surface of the spray tank 312 where the wall surface opposes the conveying path A of the light-sensitive material 16, a nozzle plate 322, which is formed by bending an elastically deformable rectangular thin plate, is disposed.

Further, as illustrated in FIG. 2 to FIG. 4, a plurality of nozzle holes 324 (respectively having a diameter of, for example, several tens of $\mu$m), for spraying the processing solution filled in the spray tank 312, are arranged at the nozzle plate 322, so as to be aligned linearly at given intervals along a direction intersecting the conveying direction A of the light-sensitive material 16, and they are disposed cross-stitch-wise in at least two rows along the whole transverse direction of the light-sensitive material 16. Therefore, the processing solution within the spray tank 312 can be discharged from the respective nozzle holes 324 to the side of the light-sensitive material 16. One of the characteristics of the present invention is to simultaneously coat a processing solution from a plurality of jetting nozzle holes along the whole transverse direction of the light-sensitive material.

Further, as is illustrated in FIG. 4, the respective nozzle holes 324 are made circular, so as to mutually have the same inner diameter d, so that water droplets L having almost the same value can be sprayed from the respective nozzle holes 324. Further, each three nozzle holes 324, which are adjacent each other, are disposed on the nozzle plate 322, so that each of the centers S of the three nozzle holes 324 becomes a summit of an equilateral triangle.

On the other hand, as illustrated in FIG. 1 and FIG. 2, an exhaust pipe 330 extends from the upper portion of the spray tank 312, and the exhaust pipe 330 makes it possible to communicate the interior and exterior of the spray tank 312. Further, a valve (not illustrated), which opens and closes the exhaust pipe 330, is provided on the route of the exhaust pipe 330. By the opening/closing operation of the value, the interior of the spray tank 312 can be communicated with or closed off from the outside air.

As illustrated in FIG. 5, in the present invention, three droplets L are sprayed from the above-described nozzle holes 324 and attached on the light-sensitive material 16 in contact with each other, so as to become adjacent to each other with no interval between them. The pitch, which is a distance between the centers S1 of the droplets L, is the same as the pitch P, which is a distance between the centers S of the nozzle holes 324 adjacent to each other (see FIG. 4). Therefore, if the pitch P is adjusted so as to be the value obtained by the following equation, the three droplets L are attached onto the light-sensitive material 16 with no interval between them.

$$P \leqq \frac{\sqrt{3}}{2} \cdot D$$

By repeatedly spraying droplets L in good timing that coincides with the conveying speed of the light-sensitive material 16, the droplets L are attached on the surface of the light-sensitive material 16 in such an arrangement that the lines connecting the respective centers S1 form an equilateral triangle, as illustrated in FIG. 5.

However, in practice, if respective droplets L, having been attached on the light-sensitive material 16 by atomizing, contact and interfere with each other on the surface thereof, mutually overlapped droplets L easily aggregate to unite in a body as a whole, because they have a property to aggregate, to reduce a surface energy.

By coating the processing solution on the light-sensitive material 16, so that a respective center S1 of a thus-attached droplet L becomes a summit of the equilateral triangle, and further the center of gravity of the equilateral triangle is completely covered with the three droplets L, aggregation of all droplets is made possible with the smallest amount of the solution.

In accordance with the above-described operation, a uniform coating membrane can be formed on the light-sensitive material 16, with neither deterioration of the image quality, nor deterioration of the image-recording device by itself due to contamination of the processing solution.

Next, the coating step of a peroxide-containing solution for use in the present invention is explained below.

First, the peroxide-containing solution for use in the present invention is explained.

In order to maintain the stability of a development intensifier in the present invention, the above-described color-developing compound including a p-phenylenediamine-series color-developing agent is incorporated in a light-sensitive material, and the light-sensitive material is contacted with the development intensifier, by a method in which an alkaline processing solution and a peroxide-containing solution, having been kept separated from each other, are mixed on the light-sensitive material. Accordingly, it is necessary for the peroxide-containing solution to contain substantially no color-developing agent. Further, from the viewpoint of the stability of the peroxide, it is necessary for the pH of the peroxide-containing solution to be generally not more than 9, preferably not more than 8, and especially preferably not more than 7. Further, the development intensification progresses in the state of a mixture of the alkaline processing solution and the peroxide-containing solution. Consequently, it is necessary for the pH to not be more than 9, for the progress of the intensification reaction. In order not to excessively lower the pH of the mixture, it is necessary for the pH of the peroxide-containing solution to be generally not less than 2, preferably not less than 3, more preferably not less than 4, and especially preferably not less than 5.

Of the peroxide that is incorporated in a peroxide-containing solution for use in the intensification processing, hydrogen peroxide and a hydrogen peroxide-releasing compound are preferred. As the hydrogen peroxide-releasing compound, perboric acid and percarbonic acid are preferred. Of these compounds, hydrogen peroxide is especially preferred.

The amount of these compounds to be added is preferably from 0.005 mol/l to 2 mol/l, more preferably 0.01 mol/l to 1.0 mol/l, and furthermore preferably from 0.02 mol/l to 0.5 mol/l.

When a precursor of a color-developing agent that releases an aromatic primary amine upon a rearrangement reaction of the peroxide (e.g. the peroxide represented by formula (X)) is used in the present invention, a peroxide-containing solution is also used to release the aromatic primary amine. Of the peroxides for the release, hydrogen peroxide and one of the peroxide represented by the following formula are preferably used.

ROOH

RCOOOH wherein R represents a hydrogen atom, a substituted or unsubstituted alkyl group or aryl group.

Specific examples of the compound represented by the above-described formula, and of other peroxides preferable for releasing a color-developing agent from a precursor of the color-developing agent, are shown below.

HOOH t-BuOOH

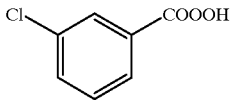

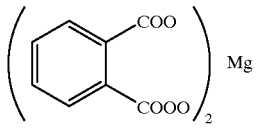

$K_2CO_4$ $Na_2CO_4$ $KBO_3 \cdot 1/2H_2O$ $NaBO_3 \cdot 4H_2O$

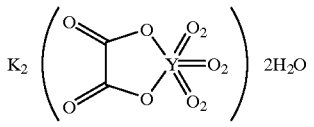

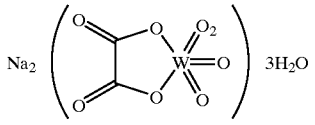

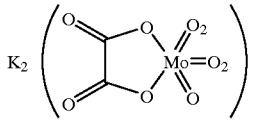

The amount of the peroxide to be added to release a color-developing agent from a precursor of the color-developing agent is preferably from 0.1 mmol/l to 1 mol/l, and more preferably from 0.2 mmol/l to 0.5 mol/l.

In the present invention, at least two kinds of peroxides may be used in combination. For example, it is also a preferable embodiment to use a peroxide suitable for the above-described intensification processing, in combination with a peroxide suitable for releasing a color-developing agent from a precursor of the color-developing agent.

Preferably, the peroxide-containing solution is coated on the light-sensitive material, by means of the above-described processing solution-coating apparatus described in JP-A-9-179272.

In the third embodiment of the present invention, especially from the viewpoint that color-forming property can be improved up to the side (edge) portion where a solution is coated, it is necessary for the difference in the surface tension between the peroxide-containing solution for use in the present invention and the alkaline processing solution to not be more than 10 dyn/cm, preferably not more than 8 dyn/cm, and more preferably not more than 5 dyn/cm. As the surface tension of the alkaline processing solution is preferably not more than 60 dyn/cm, that of the peroxide-containing solution is preferably not more than 70 dyn/cm. Further, as the surface tension of the alkaline processing solution is more preferably not more than 45 dyn/cm, that of the peroxide-containing solution is more preferably not more than 55 dyn/cm, especially preferably not more than 53 dyn/cm, and most preferably not more than 50 dyn/cm. As a matter of course, since a similar phenomenon also occurs when the surface tension of the peroxide-containing solution is lower than that of the alkaline processing solution, a reduction in color density also occurs at the edge portion of the area where a processing solution is coated, when the surface tension of the peroxide-containing solution is lower by at least 10 dyn/cm than that of the alkaline processing solution. It is preferred to add a water-soluble stilbene compound or a fluorosurface-active agent having a polyoxyalkylene group that is preferably used so as to adjust the surface tension of the alkaline processing solution, so that the surface tension of the peroxide-containing solution falls within the above-described range. Further, in order to further improve color-forming property up to the edge portion of the area where a processing solution is coated, it is preferred to adjust the composition of the peroxide-containing solution to that of the alkaline processing solution. For example, it is a preferable embodiment of the peroxide-containing solution that is provided by adjusting the components in the peroxide-containing solution to those of the alkaline processing solution, for example, by including a cation, an anion, a surface tension-reducing agent, an antifoggant, and a chelating agent; by adjusting the pH with an acid, such as sulfuric acid and nitric acid, and further by adding thereto hydrogen peroxide.

The amount of the alkaline processing solution to be coated is preferably from 5 $\mu$m to 95 $\mu$m, in terms of the thickness of a liquid membrane of the coating solution. The amount of the peroxide-containing solution to be coated is also preferably from 5 $\mu$m to 95 $\mu$m. Further, the total coating amount of the alkaline processing solution and the peroxide-containing solution is preferably from 10 $\mu$m to 100 $\mu$m, in terms of the thickness of a liquid membrane.

The amount of the alkaline processing solution to be coated is preferably from 5 ml/m$^2$ to 95 ml/m$^2$, in terms of a liquid amount of the coating solution. The amount of the peroxide-containing solution to be coated is also preferably from 5 ml/m$^2$ to 95 ml/m$^2$. With respect to both the alkaline processing solution and the peroxide-containing solution, the coated liquid amount is more preferably 10 ml/m$^2$ to 50 ml/m$^2$, in each case. Further, the total coated liquid amount of the alkaline processing solution and the peroxide-containing solution is preferably from 10 ml/m$^2$ to 100 ml/m$^2$.

The pH of a mixture composed of the alkaline processing solution mixed with the peroxide-containing solution (e.g. a hydrogen peroxide-containing solution) on a light-sensitive material, is preferably from 9 to 13, and more preferably from 10 to 12.5.

The interval between the coating of the alkaline processing solution and the coating of the peroxide-containing solution (e.g. a hydrogen peroxide-containing solution) subsequent thereto, is preferably not more than 10 sec., more preferably not more than 5 sec., and especially preferably not more than 1 sec.

In the present invention, coatings of the alkaline processing solution and the peroxide-containing solution are carried out almost instantaneously, respectively. Accordingly, a substantial processing time means a time spend for the development intensification step and other steps subsequent thereto.

The development intensification step is explained below.

The development intensification step is a step at which development intensification is performed by a coated alkaline processing solution and a coated peroxide-containing solution. In the present invention, a mixture of an alkaline processing solution and a peroxide-containing solution, by which development intensification is performed, is used in the state that the same is coated on a light-sensitive material. Accordingly, during the processing, the mixture must be present on the light-sensitive material, and preferably the light-sensitive material is horizontally set during development intensification. Further, it is also a preferable embodiment that the light-sensitive material is horizontally conveyed, while carrying thereon a mixed solution of an alkaline processing solution and a peroxide-containing solution, so that this step is completed during the time the light-sensitive material is conveyed from the peroxide-containing solution-coating step to subsequent steps, such as a washing step or a stabilization step.

It is also preferable in the present invention to keep the temperature constant, so that a change due to processing is minimized. A preferable processing temperature is from 20° C. to 80° C., more preferably from 25° C. to 60° C., and further preferably from 30° C. to 50° C. In order to keep this temperature, it is also preferable to convey a light-sensitive material in closely contact with a heat panel, or to complete this step in a thermostatic chamber in which a constant temperature is maintained, or in a thermohygrostatic chamber in which a constant temperature and humidity are maintained, or the like. It is also preferable have pre-warmed the alkaline processing solution, the peroxide-containing solution, and the light-sensitive material, in order to keep the above-described preferable temperature in the present invention constant during the time from the beginning of the processing to the completion.

Further, the time of the development intensification step is preferably from 5 sec. to 60 sec., more preferably from 10 sec. to 40 sec., and further preferably from 10 sec. to 30 sec.

The washing step and the stabilization step for use in the present invention can be carried out according to known methods.

The washing step is preferably carried out by a method as described in, for example, JP-A-9-152693. Because, in the present invention, there is little that must be washed out of the processed light-sensitive material, a simple washing method, in which a small amount of a washer is used only once and then thrown away, such as a shower washing, is also preferred.

Preferably the stabilization processing is performed using a stabilizing solution as described in, for example, JP-B-63-20330 and JP-B-63-20332. In this case, a processing is also preferably carried out by a coating method in the absence of a tank processing.

In the present invention, a bleach processing, a fix processing, or a bleach-fix processing may be carried out subsequent to the above-described processings. Examples of the bleaching agent include compounds of a multivalent metal, such as Fe(III), Co(III), Cr(IV), and Cu(II); peroxyacids, quinones, and nitro compounds. Of these bleaching agents, aminopolycarboxylic acid Fe(III) salts, such as ethylenediaminetetraacetic acid Fe(III) complex salt and 1,3-diaminopropanetetraacetic acid Fe(III) complex salt; hydrogen peroxide, and a persulfate salt are preferred, from viewpoints of rapid processing and environmental protection from pollution. Examples of the fixing agent include a thiosulfate salt, a thiocyanate salt, thioureas, a large amount of an iodide salt; and a metho-ionic compound, a thioether compound, and a nitrogen-containing heterocyclic compound, having a sulfido group, as described in JP-A-4-365037 and JP-A-5-66540.

The bleaching step, the fixing step, and the bleach-fix step are described in detail in JP-A-9-152693, and the methods described therein are preferably used. Further, in these steps, a coating process is also preferably carried out, in order to eliminate a processing tank.

The processing time in the whole processing steps, that is, the processing time from the development process to the drying process, is preferably 360 sec or below, more preferably 120 sec or below, and particularly preferably 90 to 20 sec.

Herein the processing time means the time from the coating of a processing solution to the light-sensitive material, till the emergence from the drying part of the processor in the whole processing steps.

In the processing applied to the present invention, various additives can be used, and more details are described in Research Disclosure Item 36544 (September 1994), whose related section is summarized below.

| Processing agents | Page |
|---|---|
| Antifoggants | 537 |
| Chelating agents | 537, right column |
| Buffers | 537, right column |
| Surface-active agents | 538, left column, and 539, left column |
| Bleaching agents | 538 |
| Bleach-accelerating agents | 538, right column to 539, left column |
| Chelating agents for bleaching | 539, left column |
| Rehalogenating agents | 539, left column |
| Fixing agents | 539, right column |
| Preservatives for fixing agents | 539, right column |
| Chelating agents for fixing | 540, left column |
| Surface-active agents for stabilizing | 540, left column |
| Scum-preventing agents for stabilizing | 540, right column |
| Chelating agents for stabilizing | 540, right column |
| Anti-fungus/mildew-preventing agents | 540, right column |
| Image-dye stabilizers | 540, right column |

According to the present invention, not only a color photographic image having excellent color-forming property, storage stability, dye image stability, and hue can be formed, simply and rapidly, but also both "a lowered amount of a waste solution" and "reduction in a change of the processing" can be achieved. Further according to the present invention, deterioration of a processing solution caused by a conventional development intensification processing is prevented, and there is neither reduction in the color density at the initial coating portion nor any white spot, due to unevenness (inclination) of a coated processing solution, whereby an image having a uniform, even, and high color-density can be obtained.

Further, the method for forming a color image of the present invention achieves excellent effects in that color-formation fully occurs without unevenness up to the side edge portions of the light-sensitive material whose surface has been repeatedly coated with processing solutions, so that uniform color-formation is made possible all over the whole surface of the processed light-sensitive material.

The present invention will now be described in more detail with reference to the following examples, but of course the present invention is not limited to them.

EXAMPLES

Example 1

(Preparation of Light-Sensitive Material)

A paper base both surfaces of which had been laminated with polyethylene, was subjected to surface corona discharge treatment; then it was provided with a gelatin undercoat layer containing sodium dodecylbenzensulfonate, and it was coated with various photographic constitutional layers, to prepare a multi-layer photographic color printing paper (100) having the layer constitution shown below. The coating solutions were prepared as follows.

First-Layer Coating Solution 23 g of a coupler (C-21), 16 g of a color-developing compound (I-32), and 80 g of a solvent (Solv-1), were dissolved in ethyl acetate, and the resulting solution was emulsified and dispersed in 400 g of a 16% gelatin solution containing 10% sodium dodecylbenzensulfonate and citric acid, to prepare an emulsified dispersion A. On the other hand, a silver chlorobromide emulsion A (cubes; a mixture of a large-size emulsion A having an average grain size of 0.20 $\mu$m, and a small-size emulsion A having an average grain size of 0.10 $\mu$m (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride) was prepared. To the large-size emulsion A of this emulsion, had been added $7.0\times10^{-4}$ mol, per mol of silver, of each of blue-sensitive sensitizing dyes A, B, and C shown below, and to the small-size emulsion A of this emulsion, had been added $8.5\times10^{-4}$ mol, per mol of silver, of each of blue-sensitive sensitizing dyes A, B, and C shown below. The chemical ripening of this emulsion was carried out with a sulfur sensitizer and a gold sensitizer being added. The above emulsified dispersion A and this silver chlorobromide emulsion A were mixed and dissolved, and a first-layer coating solution was prepared so that it would have the composition shown below. The coating amount of the emulsion is in terms of silver.

The coating solutions for the second layer to the seventh layer were prepared in the similar manner as that for the first-layer coating solution. As the gelatin hardener for each layer, 1-oxy-3,5-dichloro-s-triazine sodium salt was used.

Further, to each layer, were added Cpd-12, Cpd-13, Cpd-14, and Cpd-15, so that the total amounts would be 15.0 mg/m$^2$, 60.0 mg/m$^2$, 5.0 mg/m$^2$, and 10.0 mg/m$^2$ respectively.

For the silver chlorobromide emulsion of the respective photosensitive emulsion layer, the following spectral sensitizing dyes were used.

(Blue-Sensitive Emulsion Layer)

Sensitizing dye A

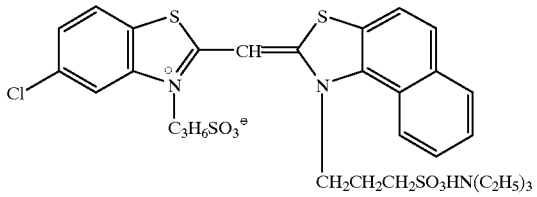

Sensitizing dye B

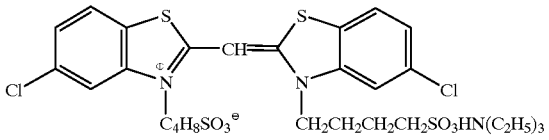

-continued

Sensitizing dye C

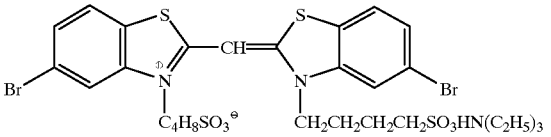

(Each was added to the large-size emulsion in an amount of $7.0\times10^{-4}$ mol, per mol of silver halide, and to the small-size emulsion in an amount of $8.5\times10^{-4}$ mol, per mol of silver halide.)

(Green-Sensitive Emulsion Layer)

Sensitizing dye D

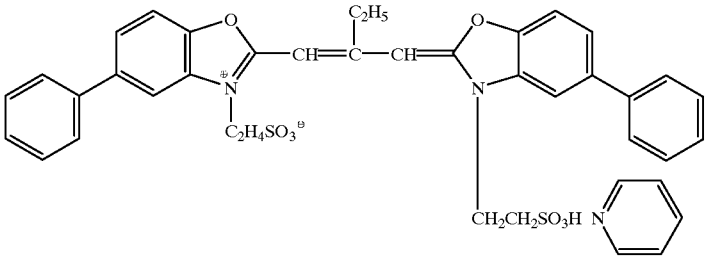

Sensitizing dye E

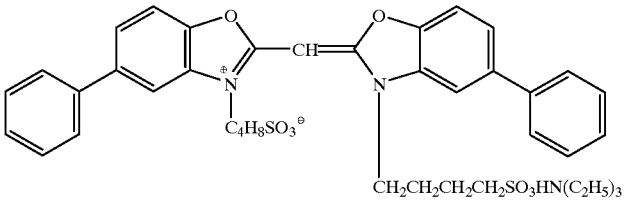

Sensitizing dye F

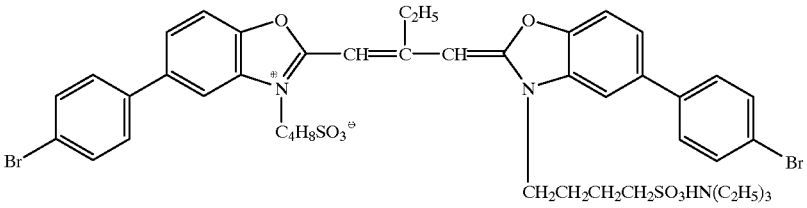

(The sensitizing dye D was added to the large-size emulsion in an amount of $1.5\times10^{-3}$ mol per mol of the silver halide, and to the small-size emulsion in an amount of $1.8\times10^{-3}$ mol per mol of the silver halide; the sensitizing dye E was added to the large-size emulsion in an amount of $2.0\times10^{-4}$ mol per mol of the silver halide, and to the small-size emulsion in an amount of $3.5\times10^{-4}$ mol per mol of the silver halide; and the sensitizing dye F was added to the large-size emulsion in an amount of $1.0\times10^{-3}$ mol per mol of the silver halide, and to the small-size emulsion in an amount of $1.4\times10^{-3}$ mol per mol of the silver halide.)

(Red-Sensitive Emulsion Layer)

Sensitizing dye G

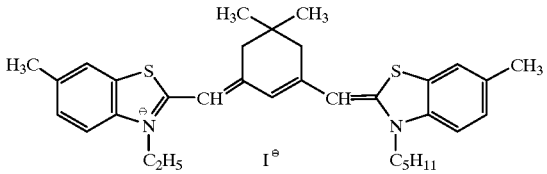

-continued

Sensitizing dye H

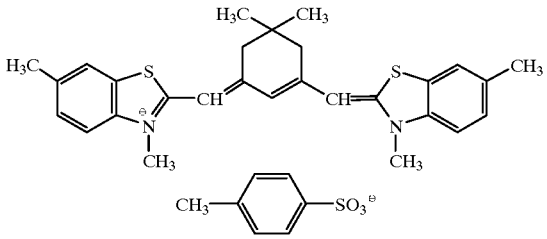

(Each was added to the large-size emulsion in an amount of $2.5\times10^{-4}$ mol per mol of the silver halide, and to the small-size emulsion in an amount of $4.0\times10^{-4}$ per mol of the silver halide.)

Further, the following compound was added to the red-sensitive emulsion layer in an amount of $2.6\times10^{-3}$ mol per mol of the silver halide.

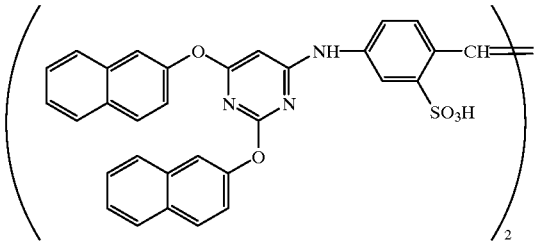

To the blue-sensitive emulsion layer, the green-sensitive emulsion layer, and the red-sensitive emulsion layer, was added 1-(5-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, to the second layer, the forth layer, the sixth layer, and the seventh layer, was added 1-(5-methylureidophenyl)-5-mercaptotetrazole in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, were added 4-hydroxy-6-methyl-1,3,3a,7-tetrazaindene in amounts of $1\times10^{-4}$mol and $2\times10^{-4}$ mol, respectively, per mol of the silver halide.

Further, to prevent irradiation, the following dyes were added to the emulsion layers (the coating amount is shown in parentheses).

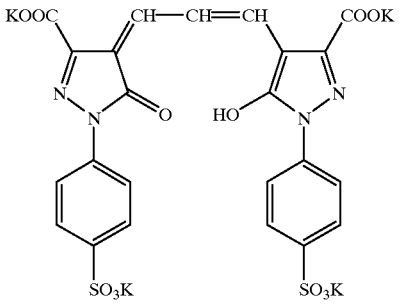

(10 mg/m$^2$)

and

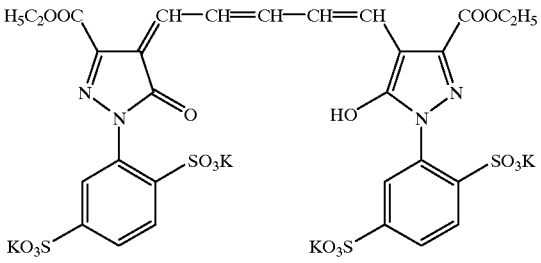

(40 mg/m$^2$)

(Layer Constitution)

The composition of each layer is shown below. The numbers show coating amounts (g/m$^2$). In the case of the silver halide emulsion, the coating amount is in terms of silver.

Base

Polyethylene-Laminated Paper

[The polyethylene on the first layer side contained a fluorescent whitening agent (I) shown below, a white pigment ($TiO_2$: 15 wt%) and a blue dye (ultramarine)]

| | |
|---|---|
| First Layer (Blue-Sensitive Emulsion Layer) | |
| The above silver chlorobromide emulsion A | 0.015 |
| Gelatin | 1.50 |
| Yellow coupler (C-21) | 0.23 |
| Color-developing compound (I-16) | 0.16 |
| Solvent (Solv-1) | 0.80 |
| Second Layer (Color-Mixing Inhibiting Layer) | |
| Gelatin | 1.09 |
| Color-mixing inhibitor (Cpd-7) | 0.11 |
| Solvent (Solv-2) | 0.19 |
| Solvent (Solv-3) | 0.07 |
| Solvent (Solv-4) | 0.25 |
| Solvent (Solv-5) | 0.09 |
| 1,5-diphenyl-3-pyrazolidone (in the state of a fine-grain solid dispersion) | 0.03 |
| Third Layer (Green-Sensitive Emulsion Layer) | |
| A silver chlorobromide emulsion B: cubes, a mixture of a large-size emulsion B having an average grain size of 0.1 μm, and a small-size emulsion B having an average grain size of 0.08 μm (1:3 in terms of mol of silver).The deviation coefficients of the grain size distributions were 0.10 and 0.08, respectively, and each emulsion had 0.8 mol % of AgBr contained locally in part of the grain surface whose substrate was made up of silver chloride. | 0.01 |
| Gelatin | 1.50 |
| Magenta coupler (C-56) | 0.24 |
| Color-developing compound (I-32) | 0.16 |
| Solvent (Solv-1) | 0.80 |
| Fourth Layer (Color-Mixing Inhibiting Layer) | |
| Gelatin | 0.77 |
| Color-mixing inhibitor (Cpd-7) | 0.08 |
| Solvent (Solv-2) | 0.14 |
| Solvent (Solv-3) | 0.05 |
| Solvent (Solv-4) | 0.14 |
| Solvent (Solv-5) | 0.06 |
| 1,5-diphenyl-3-pyrazolidone (in the state of a fine-grain solid dispersion) | 0.02 |
| Fifth Layer (Red-Sensitive Emulsion Layer) | |
| A silver chlorobromide emulsion C: cubes, a mixture of a large-size emulsion C having an average grain size of 0.1 μm, and a small-size emulsion having an average grain size of 0.08 μm (1:4 in terms of mol of silver).The deviation coefficients of the grain size distributions were 0.09 and 0.11, respectively, and each emulsion had 0.8 mol % of AgBr locally contained in part of the grain surface whose substrate was made up of silver chloride. | 0.01 |
| Gelatin | 0.15 |
| Cyan coupler (C-43) | 0.21 |
| Color-developing compound (I-16) | 0.20 |
| Solvent (Solv-1) | 0.80 |
| Sixth Layer (Ultraviolet Absorbing Layer) | |
| Gelatin | 0.64 |
| Ultraviolet absorbing agent (UV-1) | 0.39 |
| Color-image stabilizer (Cpd-7) | 0.05 |
| Solvent (Solv-6) | 0.05 |
| Seventh Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |
| Wetting-property modifier (Cpd-8) | 0.09 |
| Wetting-property modifier (Cpd-9) | 0.03 |
| Wetting-property modifier (Cpd-10) | 0.03 |

(Cpd-1) Surface-active agent
A mixture in 7:3 (weight ratio) of
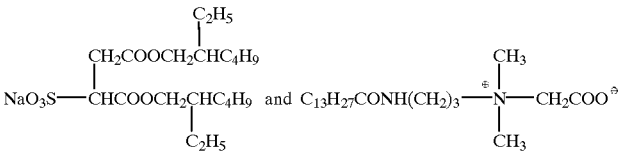
(Cpd-2) Antiseptics
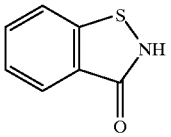
(Cpd-3) Antiseptics
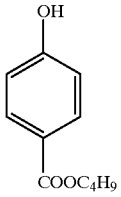
(Cpd-4) Antiseptics
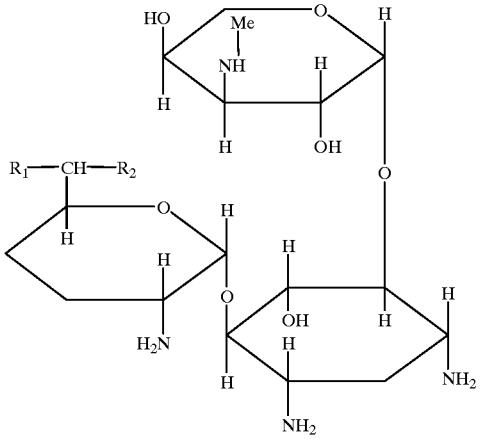
| | $R_1$ | $R_2$ |
|---|---|---|
| a | —Me | —NHMe |
| b | —Me | —$NH_2$ |
| c | —H | —$NH_2$ |
| d | —H | —NHMe |
A mixture in 1:1:1:1 of a, b, c, d
(Cpd-5) Antiseptics
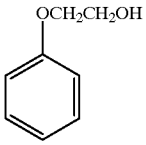
(Solv-1) Solvent
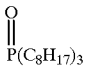
(Cpd-7) Color-image stabilizer
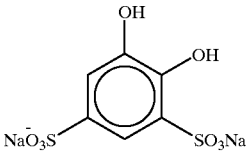
(Cpd-8) Wetting-property modifier
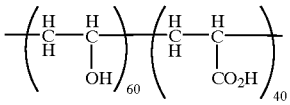
number average
molecular weight 1,000,000
(Cpd-9) Wetting-property modifier
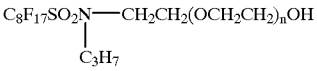
$n = 15$
(Cpd-10) Wetting-property modifier
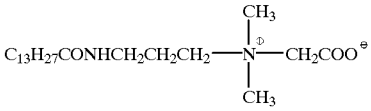

-continued
(Cpd-6) Color-mixing inhibitor
(1)
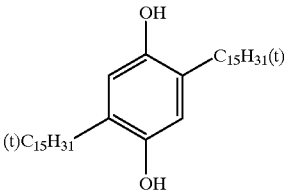
(2)
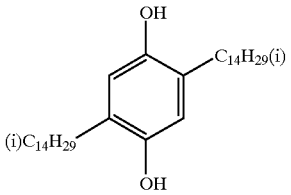
(3)
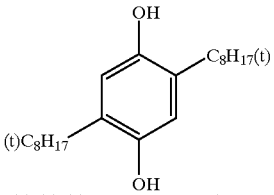
(1):(2):(3) = 1:1:1 mixture (weight ratio)
(Solv-2) Solvent
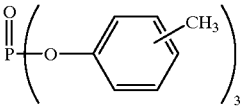
(Solv-3) Solvent
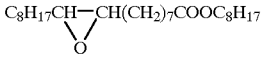
(Solv-4) Solvent
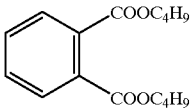
(Solv-5) Solvent
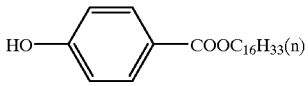
(Solv-6) Solvent
(UV-1) Ultra-violet absorbent
(1)
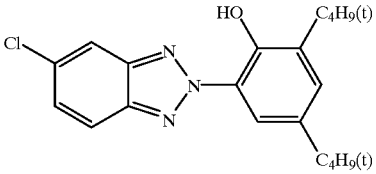
(2)
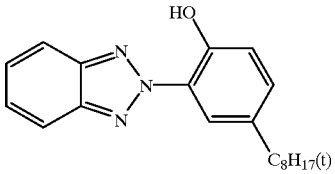
(3)
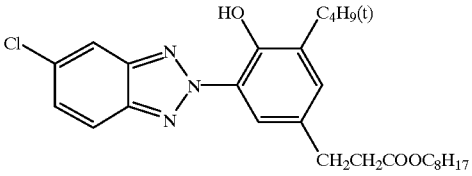
(4)
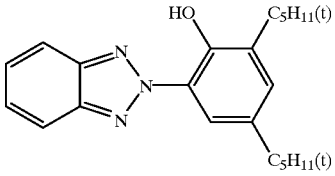
(5)
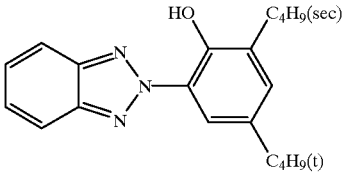
(1):(2):(3):(4):(5) = 1:2:2:3:1 mixture (weight ratio)

-continued

Fluorescent whitening agent (I)

Content 15 mg/m$^2$

Ratio of 0.05% by weight to polyethylene

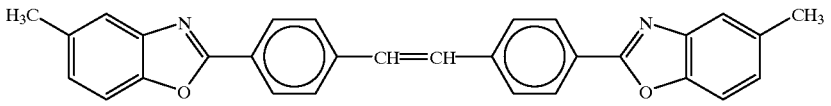

Samples (101) to (108) were prepared in the same manner as in Sample (100), except that instead of the couplers and color-developing compounds used in Sample (100), the couplers and color-developing compounds shown in Table 2 were used, in the same molar amounts.

(Preparation of Processing Solutions)

A development-intensifying solution having the following composition was prepared.

| Development-intensifying solution | |
|---|---|
| Water | 800 ml |
| Sodium 5-sulfosalicylate | 25 g |
| KCl | 1.25 g |
| Benzotriazole | 0.01 g |
| Hydroxyethylidene-1,1-diphosphonate (30% aqueous solution) | 2 ml |
| Surface-tension reducing agent (Stil-1) | 2.5 g |
| Hydrogen peroxide (30% aqueous solution) | 15 ml |
| Water to make | 1000 ml |
| pH | 12 |

(Stil-1) Surface-tension reducing agent

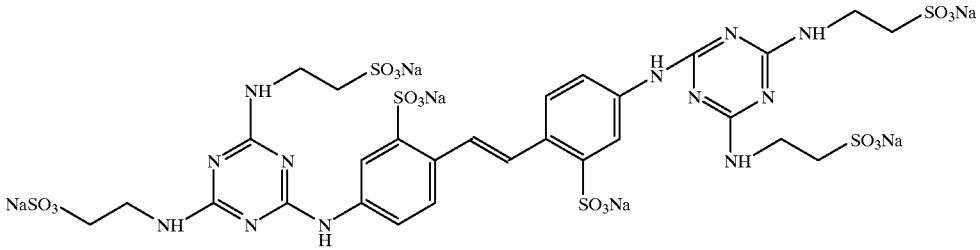

An alkaline processing solution having the following composition was prepared.

| Alkaline processing solution | |
|---|---|
| Water | 800 ml |
| Sodium 5-sulfosalicylate | 50 g |
| KCl | 2.5 g |
| Benzotriazole | 0.02 g |
| Hydroxyethylidene-1,1-diphosphonate (30% aqueous solution) | 4 ml |
| Surface-tension reducing agent (Stil-1) | 5 g |
| Water to make | 1000 ml |
| pH | 13 |

A hydrogen peroxide-containing solution having the following composition was prepared.

| Hydrogen peroxide-containing solution | |
|---|---|
| Water | 800 ml |
| Hydrogen peroxide | 30 ml |
| Water to make | 1000 ml |
| pH | 7 |
| **Stabilizing solution** | |
| Potassium carbonate | 15 g |
| Sodium 2-mercaptobenzimidazole-5-sulfonate | 1 g |
| Hydroxyethylidene-1,1-diphosphonate (30% aqueous solution) | 1 ml |
| 5-Chloro-2-methyl-4-isothiazoline-3-one | 0.02 g |
| Water to make 1 liter | pH 7.0 |
| **Rinse solution** | |
| Sodium chlorinated isocyanurate | 0.02 g |
| Deionized water (conductivity: 5 $\mu$S/cm or below) | 1000 ml |
| pH | 6.5 |

(Processing Steps)

Processing Step 1

| Processing step | Temperature | Time |
|---|---|---|
| Development-intensification | 40° C. | 30 sec |
| Stabilization | 40° C. | 15 sec |
| Rinse | 40° C. | 60 sec |
| Drying | 70° C. | 60 sec |

Processing Step 2

| Processing step | Temperature | Time |
|---|---|---|
| Coating of the development-intensifier (Coating process by the processing solution-coating apparatus described in FIGS. 2 to 13 of JP-A-9-179272), Coating amount of this processing solution: 80 ml/m$^2$, Nozzle width: 5.5 cm (The nozzle width means the width from end to end of plural nozzle holes of the spray tank, along a direction intersecting a conveying direction of the light-sensitive material.), Coating length: 12 cm (The coating length means the length when a light-sensitive material is conveyed under a nozzle, and the alkaline processing solution is coated thereon in a given length) | 40° C. | — |
| Standing ot the light-sensitive material on a heat panel | 40° C. | 30 sec. |
| Stabilization processing | 40° C. | 45 sec. |
| Washing | 30° C. | 90 sec. |
| Drying | 70° C. | 60 sec. |

Processing Step 3

| Processing Step | Temperature | Time |
|---|---|---|
| 1) Coating of the Alkaline processing solution (Coating process by the processing solution-coating apparatus described in FIGS. 2 to 13 of JP-A-9-179272), Coating amount of this processing solution: 40 ml/m$^2$, Pitch P between nozzle holes: 150 μm that was not more than (√3) · D/2, Nozzle width: 5.5 cm (The nozzle width means the width from end to end of plural nozzle holes of the spray tank, along a direction intersecting a conveying direction of the light-sensitive material.), Coating length: 12 cm (The coating length means the length when a light-sensitive material is conveyed under a nozzle, and the alkaline processing solution is coated thereon in a given length) | 40° C. | — |
| 2) Coating of the hydrogen peroxide-containing solution (Coating process by the processing solution-coating apparatus described in FIGS. 2 to 13 of JP-A-9-179272), Coating amount of the processing solution: 40 ml/m$^2$, Pitch P between nozzle holes: 150 μm that was not more than (√3) · D/2, Nozzle width: 5.5 cm (The nozzle width means the width from end to end of plural nozzle holes of the spray tank, along a direction intersecting the conveying direction of the light-sensitive material.), Coating length: 12 cm (The coating length means the length when a light-sensitive material is conveyed under a nozzle, and a hydrogen peroxide-containing solution is coated thereon in a given length) | 40° C. | — |
| Interval between the coating of the alkaline processing solution and the subsequent coating of the hydrogen peroxide-containing solution: 1 sec. | | |
| Standing of the light-sensitive material on a heat panel | 40° C. | 30 sec. |
| Stabilization processing | 40° C. | 45 sec. |
| Washing | 30° C. | 90 sec. |
| Drying | 70° C. | 60 sec. |

All of the thus-prepared samples were subjected to gradation exposure to light through three color-separation filters for sensitometry, using a FWH model sensitometer (color temperature of light sources, 3200° K.), manufactured by Fuji Photo Film Co. Ltd.

Each of the thus-exposed samples was processed according to the above-described processing step 1, 2, or 3.

Densitometric measurement was carried out using a blue light, a green light, and a red light, with respect to each of the processed samples. Densities measured using each of the colors are shown in Table 2. Further, if there was observed any white spot, or not, is also shown in Table 2.

TABLE 2

| Sample No. | Layer | Color-forming reducing agent or PPD precursor | Coupler | Processing method | Dmax | Results of white-spot observation | Remarks |
|---|---|---|---|---|---|---|---|
| (100) | Blue-photosensitive layer | I-32 | C-21 | Processing step 1 | 2.42 | none | Comparative example |
| | Green-photosensitive layer | I-32 | C-56 | | 2.56 | | |
| | Red-photosensitive layer | I-16 | C-43 | | 1.61 | | |
| (100) | Blue-photosensitive layer | I-32 | C-21 | Processing step 2 | 2.42 | Big white-spot observed | Comparative example |
| | Green-photosensitive layer | I-32 | C-56 | | 2.56 | | |
| | Red-photosensitive layer | I-16 | C-43 | | 1.61 | | |
| (100) | Blue-photosensitive layer | I-32 | C-21 | Processing | 2.55 | none | This inven- |

TABLE 2-continued

| Sample No. | Layer | Color-forming reducing agent or PPD pre-cursor | Coupler | Processing method | Dmax | Results of white-spot observation | Remarks |
|---|---|---|---|---|---|---|---|
| | Green-photosensitive layer | I-32 | C-56 | step 3 | 2.64 | | tion |
| | Red-photosensitive layer | I-16 | C-43 | | 1.68 | | |
| (101) | Blue-photosensitive layer | I-1 | C-2 | Processing | 2.02 | none | Comparative |
| | Green-photosensitive layer | I-1 | C-28 | step 1 | 2.58 | | example |
| | Red-photosensitive layer | I-1 | C-42 | | 2.09 | | |
| (101) | Blue-photosensitive layer | I-1 | C-2 | Processing | 2.02 | Big | Comparative |
| | Green-photosensitive layer | I-1 | C-28 | step 2 | 2.58 | white- | example |
| | Red-photosensitive layer | I-1 | C-42 | | 2.09 | spot observed | |
| (101) | Blue-photosensitive layer | I-1 | C-2 | Processing | 2.09 | none | This inven- |
| | Green-photosensitive layer | I-1 | C-28 | step 3 | 2.65 | | tion |
| | Red-photosensitive layer | I-1 | C-42 | | 2.16 | | |
| (102) | Blue-photosensitive layer | I-27 | C-21 | Processing | 2.51 | none | Comparative |
| | Green-photosensitive layer | I-27 | C-56 | step 1 | 2.46 | | example |
| | Red-photosensitive layer | I-16 | C-43 | | 1.61 | | |
| (102) | Blue-photosensitive layer | I-27 | C-21 | Processing | 2.51 | Big | Comparative |
| | Green-photosensitive layer | I-27 | C-56 | step 2 | 2.46 | white- | example |
| | Red-photosensitive layer | I-16 | C-43 | | 1.61 | spot observed | |
| (102) | Blue-photosensitive layer | I-27 | C-21 | Processing | 2.58 | none | This inven- |
| | Green-photosensitive layer | I-27 | C-56 | step 3 | 2.55 | | tion |
| | Red-photosensitive layer | I-16 | C-43 | | 1.68 | | |
| (103) | Blue-photosensitive layer | I-16 | C-2 | Processing | 2.11 | none | Comparative |
| | Green-photosensitive layer | I-16 | C-56 | step 1 | 2.09 | | example |
| | Red-photosensitive layer | I-16 | C-43 | | 1.61 | | |
| (103) | Blue-photosensitive layer | I-16 | C-2 | Processing | 2.11 | Big | Comparative |
| | Green-photosensitive layer | I-16 | C-56 | step 2 | 2.09 | white- | example |
| | Red-photosensitive layer | I-16 | C-43 | | 1.61 | spot observed | |
| (103) | Blue-photosensitive layer | I-16 | C-2 | Processing | 2.19 | | This inven- |
| | Green-photosensitive layer | I-16 | C-56 | step 3 | 2.14 | | tion |
| | Red-photosensitive layer | I-16 | C-43 | | 1.68 | | |
| (104) | Blue-photosensitive layer | I-61 | C-14 | Processing | 2.28 | none | Comparative |
| | Green-photosensitive layer | I-61 | C-40 | step 1 | 1.59 | | example |
| | Red-photosensitive layer | I-61 | C-44 | | 1.58 | | |
| (104) | Blue-photosensitive layer | I-61 | C-14 | Processing | 2.28 | Big | Comparative |
| | Green-photosensitive layer | I-61 | C-40 | step 2 | 1.59 | white- | example |
| | Red-photosensitive layer | I-61 | C-44 | | 1.58 | spot observed | |
| (104) | Blue-photosensitive layer | I-61 | C-14 | Processing | 2.36 | none | This inven- |
| | Green-photosensitive layer | I-61 | C-40 | step 3 | 1.63 | | tion |
| | Red-photosensitive layer | I-61 | C-44 | | 1.63 | | |
| (105) | Blue-photosensitive layer | D-19 | C-81 | Processing | 1.08 | none | Comparative |
| | Green-photosensitive layer | D-19 | C-82 | step 1 | 1.02 | | example |
| | Red-photosensitive layer | D-19 | C-83 | | 0.98 | | |
| (105) | Blue-photosensitive layer | D-19 | C-81 | Processing | 1.08 | Big | Comparative |
| | Green-photosensitive layer | D-19 | C-82 | step 2 | 1.02 | white- | example |
| | Red-photosensitive layer | D-19 | C-83 | | 0.98 | spot observed | |
| (105) | Blue-photosensitive layer | D-19 | C-81 | Processing | 1.15 | none | This inven- |
| | Green-photosensitive layer | D-19 | C-82 | step 3 | 1.07 | | tion |
| | Red-photosensitive layer | D-19 | C-83 | | 1.13 | | |
| (106) | Blue-photosensitive layer | D-20 | C-81 | Processing | 1.03 | none | Comparative |
| | Green-photosensitive layer | D-21 | C-82 | step 1 | 0.98 | | example |
| | Red-photosensitive layer | D-15 | C-83 | | 0.95 | | |
| (106) | Blue-photosensitive layer | D-20 | C-81 | Processing | 1.03 | Big | Comparative |
| | Green-photosensitive layer | D-21 | C-82 | step 2 | 0.98 | white- | example |
| | Red-photosensitive layer | D-15 | C-83 | | 0.95 | spot observed | |
| (106) | Blue-photosensitive layer | D-20 | C-81 | Processing | 1.09 | none | This inven- |
| | Green-photosensitive layer | D-21 | C-82 | step 3 | 1.08 | | tion |
| | Red-photosensitive layer | D-15 | C-83 | | 1.11 | | |
| (107) | Blue-photosensitive layer | P-2 | C-1 | Processing | 1.23 | none | Comparative |
| | Green-photosensitive layer | P-2 | C-20 | step 1 | 1.24 | | example |
| | Red-photosensitive layer | P-2 | C-24 | | 1.21 | | |
| (107) | Blue-photosensitive layer | P-2 | C-84 | Processing | 1.31 | Big | Comparative |
| | Green-photosensitive layer | P-2 | C-25 | step 2 | 1.32 | white- | example |
| | Red-photosensitive layer | P-2 | C-105 | | 1.30 | spot observed | |
| (107) | Blue-photosensitive layer | P-2 | C-84 | Processing | 1.35 | none | This inven- |
| | Green-photosensitive layer | P-2 | C-25 | step 3 | 1.36 | | tion |
| | Red-photosensitive layer | P-2 | C-105 | | 1.35 | | |
| (108) | Blue-photosensitive layer | P-11 | C-90 | Processing | 1.31 | none | Comparative |
| | Green-photosensitive layer | P-11 | C-99 | step 1 | 1.34 | | example |
| | Red-photosensitive layer | P-11 | C-112 | | 1.28 | | |
| (108) | Blue-photosensitive layer | P-11 | C-90 | Processing | 1.35 | Big | Comparative |
| | Green-photosensitive layer | P-11 | C-97 | step 2 | 1.39 | white- | example |
| | Red-photosensitive layer | P-11 | C-112 | | 1.33 | spot observed | |
| (108) | Blue-photosensitive layer | P-11 | C-90 | Processing | 1.38 | absent | This inven- |

TABLE 2-continued

| Sample No. | Layer | Color-forming reducing agent or PPD pre-cursor | Coupler | Processing method | Dmax | Results of white-spot observation | Remarks |
|---|---|---|---|---|---|---|---|
| | Green-photosensitive layer | P-11 | C-97 | step 3 | 1.42 | | tion |
| | Red-photosensitive layer | P-11 | C-112 | | 1.41 | | |

As is apparent from the results shown in Table 2, when a tank processing was carried out using a development intensifier according to the processing step 1, color-formation occurred and no white spot was observed. However, this processing not only necessitated a large processing tank, it also caused deterioration of the processing solution, due to decomposition of hydrogen peroxide. On the other hand, when a coating processing of the development intensifier was carried out by means of the apparatus described in JP-A-9-179272 according to the processing step 2, color-formation occurred and the tank could be omitted. However, bubbles, which were produced by decomposition of hydrogen peroxide, blocked nozzle holes of the coating apparatus. Consequently, a portion at which a processing solution could not be coated on the surface of the sample, was formed, which resulted in a white spot.

In contrast, when the processing method of the present invention was carried out in accordance with the processing step 3, it is found that a higher color density could be obtained than those in the processing steps 1 and 2, and no white spot was observed.

Example 2

The samples (100) to (108) in Example 1 were processed and evaluated in the same manner as in Example 1, except that the following exposure to light was carried out. In the processing of these samples, only the processing step 3 was carried out.

(Exposure to Light)

Light having a wavelength of 473 nm, taken out by wavelength conversion of a YAG solid laser (oscillation wavelength, 946 nm) by an SHG crystal of $KNbO_3$, using, as a light source, a semiconductor laser GaAlAs (oscillation wavelength, 808.5 nm) serving as an excitation light source; light having a wavelength of 532 nm, taken out by wavelength conversion of a $YVO_4$ solid laser (oscillation wavelength, 1064 nm) by an SHG crystal of KTP, using, as a light source, a semiconductor laser GaAlAs (oscillation wavelength: 808.7 nm) serving as an excitation light source; and light from AlGaInP (oscillation wavelength, about 670 nm; Type No. TOLD 9211, manufactured by Toshiba Corporation) were used. The laser beams of the apparatus could be scanned successively by a rotating polyhedron over a color print paper moved vertically to the scanning direction for exposure to light. Using this apparatus, the amount of light was varied, to find the relationship D-log E between the density (D) of the light-sensitive material and the amount of light (E). At that time, with respect to the laser beams having three wavelengths, the amounts of the lights were modulated using an external modulator, to control the exposure amounts. In this scanning exposure, the density of the picture element was 400 dpi, and the average exposure time per picture element was about $5\times10^{-8}$ sec. The temperature of the semiconductor lasers was kept constant by using Peltier elements to suppress the fluctuation of the amounts of lights due to the temperature.

As a result, even though an image was formed by a high intensity of illumination and a digital exposure system, an image having a high maximum density with no white spot could be obtained, similarly to Example 1, when the processing was carried out according to the image-forming method of the present invention.

Example 3

(Preparation of Light-Sensitive Material)

A paper base both surfaces of which had been laminated with polyethylene, was subjected to surface corona discharge treatment; then it was provided with a gelatin undercoat layer containing sodium dodecylbenzensulfonate, and it was coated with various photographic constitutional layers, to prepare a multi-layer photographic color printing paper (300) having the layer constitution shown below. The coating solutions were prepared as follows.

First-layer Coating Solution 23 g of a coupler (C-21), 16 g of a color-developing compound (I-32), and 80 g of a solvent (Solv-1), were dissolved in ethyl acetate, and the resulting solution was emulsified and dispersed in 400 g of a 16% gelatin solution containing 10% sodium dodecylbenzensulfonate and citric acid, to prepare an emulsified dispersion A. On the other hand, a silver chlorobromide emulsion A (cubes; a mixture of a large-size emulsion A having an average grain size of 0.20 $\mu$m, and a small-size emulsion A having an average grain size of 0.10 $\mu$m (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride) was prepared. To the large-size emulsion A of this emulsion, had been added $7.0\times10^{-4}$ mol, per mol of silver, of each of blue-sensitive sensitizing dyes A, B, and C shown below, and to the small-size emulsion A of this emulsion, had been added $8.5\times10^{-4}$ mol, per mol of silver, of each of blue-sensitive sensitizing dyes A, B, and C shown below. The chemical ripening of this emulsion was carried out with a sulfur sensitizer and a gold sensitizer being added. The above emulsified dispersion A and this silver chlorobromide emulsion A were mixed and dissolved, and a first-layer coating solution was prepared so that it would have the composition shown below. The coating amount of the emulsion is in terms of silver.

The coating solutions for the second layer to the seventh layer were prepared in the similar manner as that for the first-layer coating solution. As the gelatin hardener for each layer, 1-oxy-3,5-dichloro-s-triazine sodium salt was used.

Further, to each layer, were added Cpd-12, Cpd-13, Cpd-14, and Cpd-15, so that the total amounts would be 15.0 mg/m$^2$, 60.0 mg/m$^2$, 5.0 mg/m$^2$, and 10.0 mg/m$^2$, respectively.

For the silver chlorobromide emulsion of the respective photosensitive emulsion layer, the following spectral sensitizing dyes were used.

(Blue-Sensitive Emulsion Layer)

Sensitizing dye A

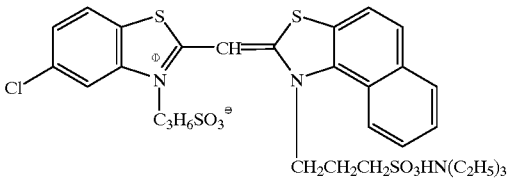

Sensitizing dye B

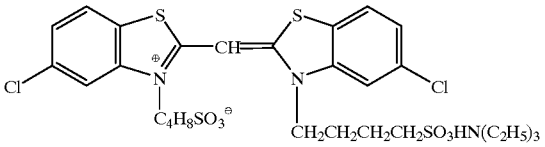

Sensitizing dye C

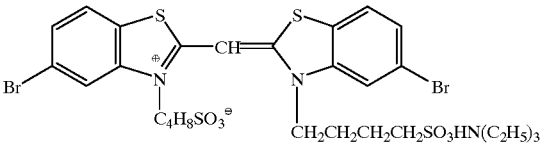

(Each was added to the large-size emulsion in an amount of $7.0\times10^{-4}$ mol, per mol of silver halide, and to the small-size emulsion in an amount of $8.5\times10^{-4}$ mol, per mol of silver halide.)

(Green-Sensitive Emulsion Layer)

Sensitizing dye D

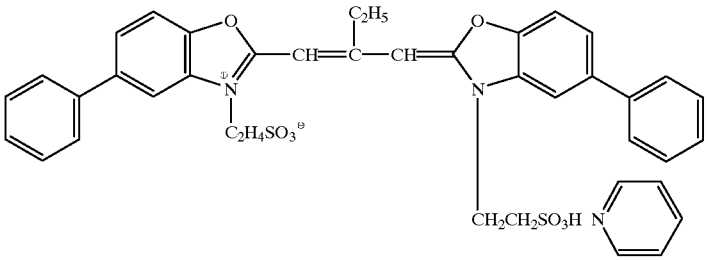

Sensitizing dye E

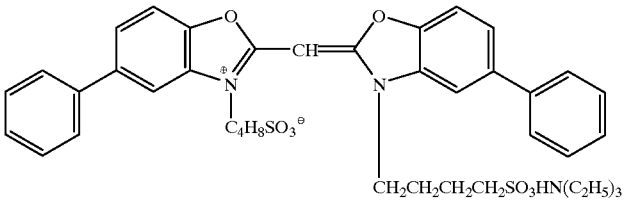

Sensitizing dye F

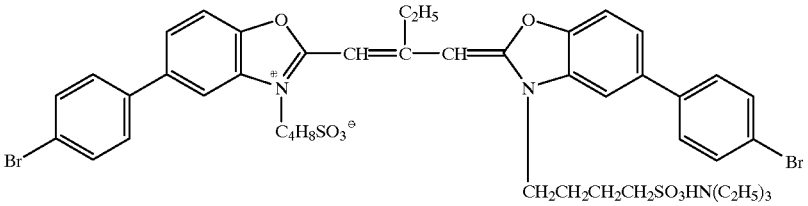

(The sensitizing dye D was added to the large-size emulsion in an amount of $1.5\times10^{-3}$ mol per mol of the silver halide, and to the small-size emulsion in an amount of $1.8\times10^{-3}$ mol per mol of the silver halide; the sensitizing dye E was added to the large-size emulsion in an amount of $2.0\times10^{-4}$ mol per mol of the silver halide, and to the small-size emulsion in an amount of $3.5\times10^{-4}$ mol per mol of the silver halide; and the sensitizing dye F was added to the large-size emulsion in an amount of $1.0\times10^{-3}$mol per mol of the silver halide, and to the small-size emulsion in an amount of $1.4\times10^{-3}$ mol per mol of the silver halide.)

(Red-Sensitive Emulsion Layer)

Sensitizing dye G

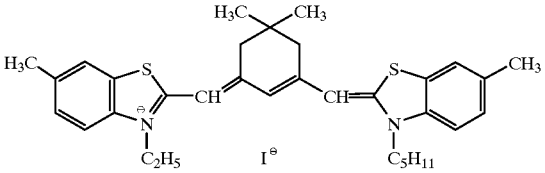

-continued

Sensitizing dye H

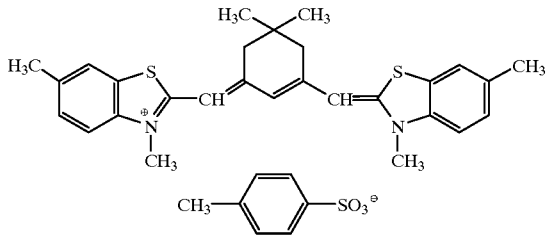

(Each was added to the large-size emulsion in an amount of $2.5\times10^{-4}$ mol per mol of the silver halide, and to the small-size emulsion in an amount of $4.0\times10^{-4}$ per mol of the silver halide.)

Further, the following compound was added to the red-photosensitive emulsion layer in an amount of $2.6\times10^{-3}$ mol per mol of the silver halide.

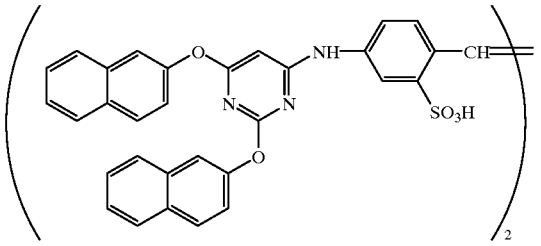

To the blue-sensitive emulsion layer, the green-sensitive emulsion layer, and the red-sensitive emulsion layer, was added 1-(5-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, to the second layer, the forth layer, the sixth layer, and the seventh layer, was added 1-(5-methylureidophenyl)-5-mercaptotetrazole in amounts of 0.2 mg/m$^2$, 0.2 mg/m$^2$, 0.6 mg/m$^2$, and 0.1 mg/m$^2$, respectively.

Further, to the blue-photosensitive emulsion layer and the green-photosensitive emulsion layer, were added 4-hydroxy-6-methyl-1,3,3a,7-tetrazaindene in amounts of $1\times10^{-4}$ mol and $2\times10^{-4}$ mol, respectively, per mol of the silver halide.

Further, to prevent irradiation, the following dyes were added to the emulsion layers (the coating amount is shown in parentheses).

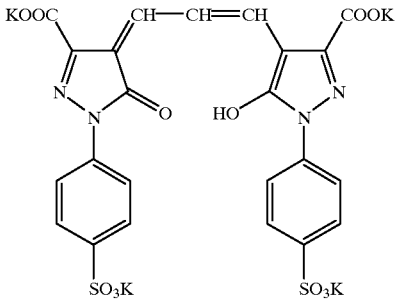

(10 mg/m$^2$)

and

-continued

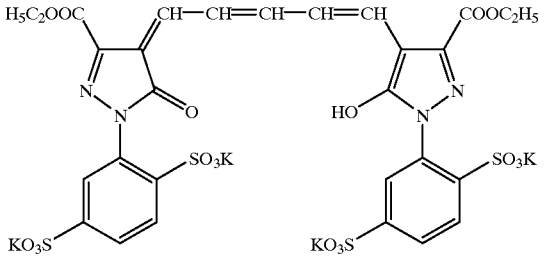

(40 mg/m$^2$)

(Layer Constitution)

The composition of each layer is shown below. The numbers show coating amounts (g/m$^2$). In the case of the silver halide emulsion, the coating amount is in terms of silver.

Base

Polyethylene-laminated Paper

[The polyethylene on the first layer side contained a fluorescent whitening agent (I) shown below, a white pigment ($TiO_2$: 15 wt %), and a blue dye (ultramarine)]

| | |
|---|---|
| First Layer (Blue-Sensitive Emulsion Layer) | |
| The above silver chlorobromide emulsion A | 0.015 |
| Gelatin | 1.50 |
| Yellow coupler (C-21) | 0.23 |
| Color-forming reducing agent (I-16) | 0.16 |
| Solvent (Solv-1) | 0.80 |
| Second Layer (Color-Mixing Inhibiting Layer) | |
| Gelatin | 1.09 |
| Color-mixing inhibitor (Cpd-7) | 0.11 |
| Solvent (Solv-2) | 0.19 |
| Solvent (Solv-3) | 0.07 |
| Solvent (Solv-4) | 0.25 |
| Solvent (Solv-5) | 0.09 |
| 1,5-diphenyl-3-pyrazolidone (in the state of a fine-grain solid dispersion) | 0.03 |
| Third Layer (Green-Sensitive Emulsion Layer) | |
| A silver chlorobromide emulsion B: cubes, a mixture of a large-size emulsion B having an average grain size of 0.1 μm, and a small-size emulsion B having an average grain size of 0.08 μm (1:3 in terms of mol of silver). The deviation coefficients of the grain size distributions were 0.10 and 0.08, respectively and each emulsion had 0.8 mol % of AgBr locally contained in part of the grain surface whose substrate was made up of silver chloride. | 0.01 |
| Gelatin | 1.50 |
| Magenta coupler (C-56) | 0.24 |
| Color-developing compound (I-32) | 0.16 |
| Solvent (Solv-1) | 0.80 |
| Fourth Layer (Color-Mixing Inhibiting Layer) | |
| Gelatin | 0.77 |
| Color-mixing inhibitor (Cpd-7) | 0.08 |
| Sovlent (Solv-2) | 0.14 |
| Solvent (Solv-3) | 0.05 |
| Solvent (Solv-4) | 0.14 |
| Solvent (Solv-5) | 0.06 |
| 1,5-diphenyl-3-pyrazolidone (in the state of a fine-grain solid dispersion) | 0.02 |
| Fifth Layer (Red-Sensitive Emulsion Layer) | |
| A silver chlorobromide emulsion C: cubes, a mixture of a large-size emulsion C having an average grain size of 0.1 μm, and a small-size emulsion having an average grain size of 0.08 μm (1:4 in terms of mol | 0.01 |

-continued

| | |
|---|---|
| of silver). The deviation coefficients of the grain size distributions were 0.09 and 0.11, respectively, and each emulsion had 0.8 mol % of AgBr locally contained in part of the grain surface whose substrate was made up of silver chloride. | |
| Gelatin | 0.15 |
| Cyan coupler (C-43) | 0.21 |
| Color-developing compound (I-16) | 0.20 |
| Solvent (Solv-1) | 0.80 |
| Sixth Layer (Ultraviolet Absorbing Layer) | |
| Gelatin | 0.64 |
| Ultraviolet absorbing agent (UV-1) | 0.39 |
| Color-image stabilizer (Cpd-7) | 0.05 |
| Solvent (Solv-6) | 0.05 |

-continued

| | |
|---|---|
| Seventh Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |
| Wetting-property modifier (Cpd-8) | 0.09 |
| Wetting-property modifier (Cpd-9) | 0.03 |
| Wetting-property modifier (Cpd-10) | 0.03 |

(Cpd-1) Surface-active agent
A mixture in 7:3 (weight ratio) of

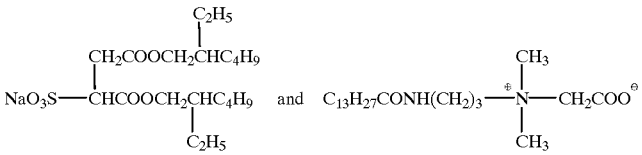

(Cpd-2) Antiseptics

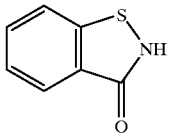

(Cpd-3) Antiseptics

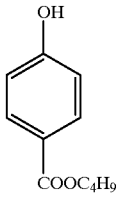

(Cpd-4) Antiseptics

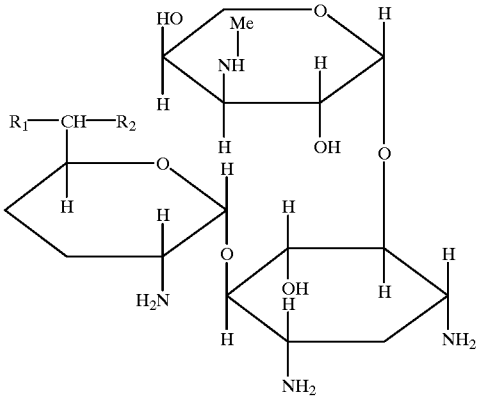

| | $R_1$ | $R_2$ |
|---|---|---|
| a | —Me | —NHMe |
| b | —Me | —$NH_2$ |
| c | —H | —$NH_2$ |
| d | —H | —NHMe |

A mixture in 1:1:1:1 of a, b, c, d (Cpd-5) Antiseptics

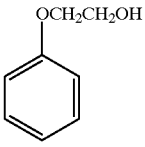

(Solv-1) Solvent

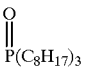

-continued
(Cpd-7) Color-image stabilizer
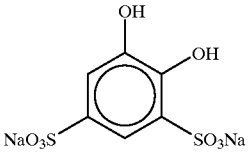
Cpd-8 Wetting-property modifier
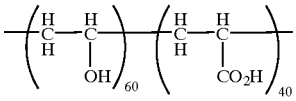
number average
molecular weight 1,000,000
(Cpd-9) Wetting-property modifier
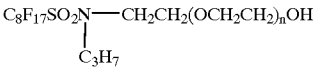
n = 15
(Cpd-10) Wetting-property modifier
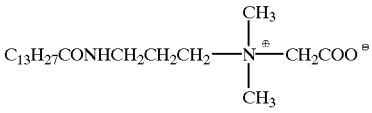
(Cpd-6) Color-mixing inhibitor
(1)
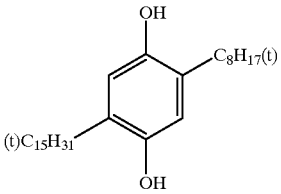
(2)
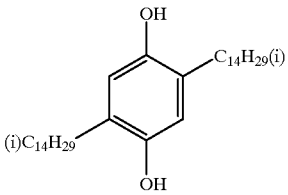
(3)
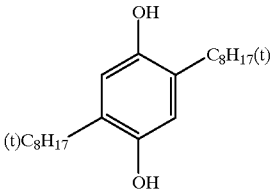
(1):(2):(3) = 1:1:1 mixture (weight ratio)
(Solv-2) Solvent
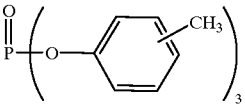
(Solv-3) Solvent
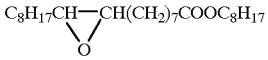
(Solv-4) Solvent
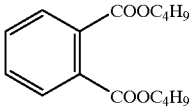
(Solv-5) Solvent
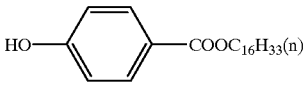
(Solv-6) Solvent
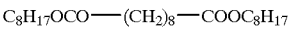
(UV-1) Ultra-violet absorbent
(1)
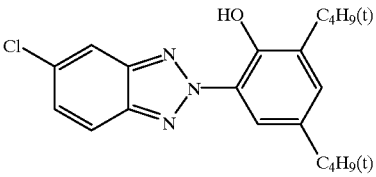
(2)
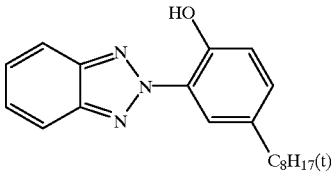

-continued (3)

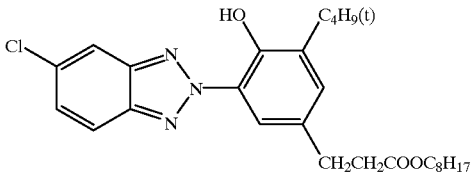

(4)

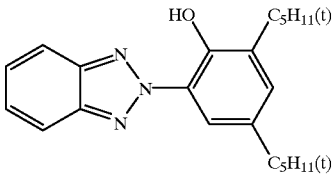

(5)

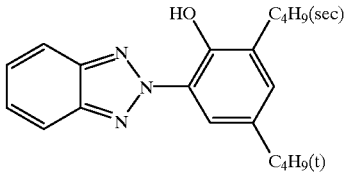

(1):(2):(3):(4):(5) = 1:2:2:3:1 mixture (weight ratio)

Fluorescent whitening agent (I)

Content 15 mg/m$^2$

Ratio of 0.05% by weight to polyethylene

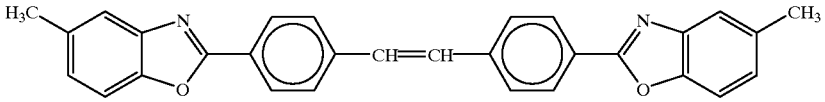

Samples (301) to (308) were prepared-in the same manner as in Sample (300), except that instead of the couplers and color-developing compounds used in Sample (300), the couplers and the color-forming reducing agents shown in Table 3 were used, in the same molar amounts.

TABLE 3

| Sample No. | Photosensitive layer | Color-forming reducing agent or color-developing agent precursor | Coupler |
|---|---|---|---|
| (300) | Blue-photosensitive layer | I-32 | C-21 |
| | Green-photosensitive layer | I-32 | C-56 |
| | Red-photosensitive layer | I-16 | C-43 |
| (301) | Blue-photosensitive layer | I-1 | C-2 |
| | Green-photosensitive layer | I-1 | C-28 |
| | Red-photosensitive layer | I-1 | C-42 |
| (302) | Blue-photosensitive layer | I-27 | C-21 |
| | Green-photosensitive layer | I-27 | C-56 |
| | Red-photosensitive layer | I-16 | C-43 |
| (303) | Blue-photosensitive layer | I-16 | C-2 |
| | Green-photosensitive layer | I-16 | C-56 |
| | Red-photosensitive layer | I-16 | C-43 |
| (304) | Blue-photosensitive layer | I-61 | C-14 |
| | Green-photosensitive layer | I-61 | C-40 |
| | Red-photosensitive layer | I-61 | C-44 |
| (305) | Blue-photosensitive layer | D-19 | C-81 |
| | Green-photosensitive layer | D-19 | C-82 |
| | Red-photosensitive layer | D-19 | C-83 |
| (306) | Blue-photosensitive layer | D-20 | C-81 |
| | Green-photosensitive layer | D-21 | C-82 |
| | Red-photosensitive layer | D-15 | C-83 |
| (307) | Blue-photosensitive layer | P-2 | C-84 |
| | Green-photosensitive layer | P-2 | C-25 |
| | Red-photosensitive layer | P-2 | C-105 |
| (308) | Blue-photosensitive layer | P-11 | C-90 |
| | Green-photosensitive layer | P-11 | C-97 |
| | Red-photosensitive layer | P-11 | C-112 |

(Preparation of Processing Solutions)

A development-intensifying solution having the following composition was prepared.

| Development-intensifying solution | |
|---|---|
| Water | 800 ml |
| Sodium 5-sulfosalicylate | 25 g |
| KCl | 1.25 g |
| Benzotriazole | 0.01 g |
| Hydroxyethylidene-1,1-diphosphonate (30% aqueous solution) | 2 ml |
| Surface-tension reducing agent (Stil-1) | 2.5 g |
| Hydrogen peroxide (30% aqueous solution) | 15 ml |
| Water to make | 1000 ml |
| pH | 12 |

(Stil-1) Surface-tension reducing agent

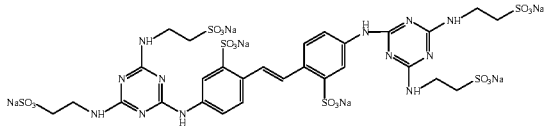

An alkaline processing solution having the following composition was prepared.

| Alkaline processing solution | |
|---|---|
| Water | 800 ml |
| Sodium 5-sulfosalicylate | 50 g |
| KCl | 2.5 g |
| Benzotriazole | 0.02 g |
| Hydroxyethylidene-1,1-diphosphonate (30% aqueous solution) | 4 ml |

-continued

| Alkaline processing solution | |
|---|---|
| Surface-tension reducing agent (Stil-1) | 5 g |
| Water to make | 1000 ml |
| pH | 13 |

A hydrogen peroxide-containing solution having the following composition was prepared.

| Hydrogen peroxide-containing solution | |
|---|---|
| Water | 800 ml |
| Hydrogen peroxide | 30 ml |
| Water to make | 1000 ml |
| pH | 7 |
| Stabilizing solution | |
| Potassium carbonate | 15 g |
| Sodium 2-mercaptobenzimidazole-5-sulfonate | 1 g |
| Hydroxyethylidene-1,1-diphosphonate (30% aqueous solution) | 4 ml |
| 5-Chloro-2-methyl-4-isothiazoline-3-one | 0.02 g |
| Water to make 1 liter | pH 7.0 |
| Rinse solution | |
| Sodium chlorinated isocyanurate | 0.02 g |
| Deionized water (conductivity: 5 $\mu$S/cm or below) | 1000 ml |
| pH | 6.5 |

(Processing Steps)

| Processing step | Temperature | Time |
|---|---|---|
| Development-intensification | 40° C. | 30 sec |
| Stabilization | 40° C. | 15 sec |

-continued

| Processing step | Temperature | Time |
|---|---|---|
| Rinse | 40° C. | 60 sec |
| Drying | 70° C. | 60 sec |

Processing Step 2

| Processing Step | Temperature | Time |
|---|---|---|
| 1) Coating of the alkaline processing solution (Coating process by the method described in Table 3: coated amount of the processing solution: 40 ml/m$^2$.) | 40° C. | — |
| 2) Coating of the hydrogen peroxide-containing solution (Coating process by the method described in Table 3: coated amount of the processing solution: 40 ml/m$^2$.) | 40° C. | — |
| Standing of the light-sensitive material on a heat panel | 40° C. | 30 sec. |
| Stabilization processing | 40° C. | 45 sec. |
| Washing | 30° C. | 90 sec. |
| Drying | 70° C. | 60 sec. |

All of the thus-prepared samples were subjected to gradation exposure to light through three-color-separation filters for sensitometry, using a FWH model sensitometer (color temperature of light sources: 3200° K.), manufactured by Fuji Photo Film Co. Ltd.

Each of the thus-exposed samples was processed by the processing step in the processing method shown in Table 4.

Densitometric measurement of each of the processed samples was carried out, through a blue light, a green light, and a red light. The densities thus measured through each of these colors are shown in Table 4. In addition, if there was observed unevenness on the processed light-sensitive material, or not, is also shown therein.

TABLE 4

| Process No. | Sample No. | Processing step | Coating method of alkaline processing solution | Coating method of hydrogen peroxide-containing solution | Dmax Blue | Dmax Green | Dmax Red | Unevenness of image after running process | Remarks |
|---|---|---|---|---|---|---|---|---|---|
| 1 | (300) | 1 | — | — | 2.42 | 2.56 | 1.61 | observed | Comparative example |
| 2 | " | 2 | 1 | 1 | 2.55 | 2.64 | 1.68 | " | " |
| 3 | " | " | 1 | 2 | 2.55 | 2.64 | 1.68 | " | " |
| 4 | " | " | 1 | 3 | 2.55 | 2.64 | 1.68 | " | " |
| 5 | " | " | 2 | 1 | 2.55 | 2.64 | 1.68 | " | " |
| 6 | " | " | 2 | 2 | 2.55 | 2.64 | 1.68 | " | " |
| 7 | " | " | 2 | 3 | 2.55 | 2.64 | 1.68 | " | " |
| 8 | " | " | 3 | 1 | 2.55 | 2.64 | 1.68 | " | " |
| 9 | " | " | 3 | 2 | 2.55 | 2.64 | 1.68 | " | " |
| 10 | " | " | 3 | 3 | 2.55 | 2.64 | 1.68 | " | " |
| 11 | " | " | 1 | 4 | 2.55 | 2.64 | 1.68 | none | This invention |
| 12 | " | " | 2 | 4 | 2.55 | 2.64 | 1.68 | " | " |
| 13 | " | " | 3 | 4 | 2.55 | 2.64 | 1.68 | " | " |
| 14 | (301) | 1 | — | — | 2.02 | 2.58 | 2.09 | observed | Comparative example |
| 15 | " | 2 | 1 | 1 | 2.09 | 2.65 | 2.16 | " | " |
| 16 | " | " | 1 | 3 | 2.09 | 2.65 | 2.16 | " | " |
| 17 | " | " | 3 | 1 | 2.09 | 2.65 | 2.16 | " | " |
| 18 | " | " | 3 | 3 | 2.09 | 2.65 | 2.16 | " | " |
| 19 | " | " | 1 | 4 | 2.09 | 2.65 | 2.16 | none | This invention |
| 20 | " | " | 2 | 4 | 2.09 | 2.65 | 2.16 | " | " |
| 21 | (301) | 2 | 3 | 4 | 2.09 | 2.65 | 2.16 | none | This invention |
| 22 | (302) | 1 | — | — | 2.51 | 2.46 | 1.61 | observed | Comparative example |

TABLE 4-continued

| Process No. | Sample No. | Processing step | Coating method of alkaline processing solution | Coating method of hydrogen peroxide-containing solution | Dmax Blue | Dmax Green | Dmax Red | Unevenness of image after running process | Remarks |
|---|---|---|---|---|---|---|---|---|---|
| 23 | " | 2 | 1 | 1 | 2.58 | 2.55 | 1.68 | " | " |
| 24 | " | " | 3 | 3 | 2.58 | 2.55 | 1.68 | " | " |
| 25 | " | " | 1 | 4 | 2.58 | 2.55 | 1.68 | none | This invention |
| 26 | " | " | 3 | 4 | 2.58 | 2.55 | 1.68 | " | " |
| 27 | (303) | 1 | — | — | 2.11 | 2.09 | 1.61 | observed | Comparative example |
| 28 | " | 2 | 2 | 2 | 2.19 | 2.14 | 1.68 | " | " |
| 29 | " | " | 2 | 4 | 2.19 | 2.14 | 1.68 | none | This invention |
| 30 | (304) | 1 | — | — | 2.28 | 1.59 | 1.58 | observed | Comparative example |
| 31 | " | 2 | 1 | 1 | 2.36 | 1.63 | 1.63 | " | " |
| 32 | " | " | 2 | 2 | 2.36 | 1.63 | 1.63 | " | " |
| 33 | " | " | 3 | 3 | 2.36 | 1.63 | 1.63 | " | " |
| 34 | " | " | 1 | 4 | 2.36 | 1.63 | 1.63 | none | This invention |
| 35 | " | " | 2 | 4 | 2.36 | 1.63 | 1.63 | " | " |
| 36 | " | " | 3 | 4 | 2.36 | 1.63 | 1.63 | " | " |
| 37 | (305) | 1 | — | — | 1.08 | 1.02 | 0.98 | observed | Comparative example |
| 38 | " | 2 | 1 | 1 | 1.15 | 1.07 | 1.13 | " | " |
| 39 | " | " | 1 | 2 | 1.15 | 1.02 | 1.13 | " | " |
| 40 | " | " | 1 | 3 | 1.15 | 1.07 | 1.13 | " | " |
| 41 | (305) | 2 | 2 | 1 | 1.15 | 1.07 | 1.13 | observed | Comparative example |
| 42 | " | " | 2 | 2 | 1.15 | 1.07 | 1.13 | " | " |
| 43 | " | " | 2 | 3 | 1.15 | 1.07 | 1.13 | " | " |
| 44 | " | " | 3 | 1 | 1.15 | 1.07 | 1.13 | " | " |
| 45 | " | " | 3 | 2 | 1.15 | 1.07 | 1.13 | " | " |
| 46 | " | " | 3 | 3 | 1.15 | 1.07 | 1.13 | " | " |
| 47 | " | " | 1 | 4 | 1.15 | 1.07 | 1.13 | none | This invention |
| 48 | " | " | 2 | 4 | 1.15 | 1.07 | 1.13 | " | " |
| 49 | " | " | 3 | 4 | 1.15 | 1.07 | 1.07 | " | " |
| 50 | (306) | 1 | — | — | 1.03 | 0.98 | 0.95 | observed | Comparative example |
| 51 | " | 2 | 1 | 1 | 1.09 | 1.08 | 1.11 | " | " |
| 52 | " | " | 1 | 4 | 1.09 | 1.08 | 1.11 | none | This invention |
| 53 | (307) | 1 | — | — | 1.23 | 1.24 | 1.21 | observed | Comparative example |
| 54 | " | 2 | 1 | 1 | 1.35 | 1.36 | 1.35 | " | " |
| 55 | " | " | 1 | 2 | 1.35 | 1.36 | 1.35 | " | " |
| 56 | " | " | 1 | 3 | 1.35 | 1.36 | 1.35 | " | " |
| 57 | " | " | 2 | 1 | 1.35 | 1.36 | 1.35 | " | " |
| 58 | " | " | 2 | 2 | 1.35 | 1.36 | 1.35 | " | " |
| 59 | " | " | 2 | 3 | 1.35 | 1.36 | 1.35 | " | " |
| 60 | " | " | 3 | 1 | 1.35 | 1.36 | 1.35 | " | " |
| 61 | (307) | 2 | 3 | 2 | 1.35 | 1.36 | 1.35 | observed | Comparative example |
| 62 | " | " | 3 | 3 | 1.35 | 1.36 | 1.35 | " | " |
| 63 | " | " | 1 | 4 | 1.35 | 1.36 | 1.35 | none | This invention |
| 64 | " | " | 2 | 4 | 1.35 | 1.36 | 1.35 | " | " |
| 65 | " | " | 3 | 4 | 1.35 | 1.36 | 1.35 | " | " |
| 66 | (308) | 1 | — | — | 1.31 | 1.34 | 1.28 | observed | Comparative example |
| 67 | " | 2 | 3 | 3 | 1.38 | 1.42 | 1.41 | " | " |
| 68 | " | " | 3 | 4 | 1.38 | 1.42 | 1.41 | none | This invention |

Coating Method 1

An alkaline processing solution or a hydrogen peroxide-containing solution is accumulated in a tank. A light-sensitive material is dipped therein.

Coating Method 2

An alkaline processing solution or a hydrogen peroxide-containing solution is penetrated into a thin slit. A light-sensitive material is passed through the slit.

Coating Method 3

A known roller coat is used (coated amount 40 ml/m$^2$, width 5.5 cm, coating length 12 cm).

Coating Method 4

A processing solution-coating device, described in JP-A-9-179272, is used. The coated amount is adjusted to 40 ml/m$^2$ (nozzle width, 5.5 cm; coating length, 12 cm; pitch P between nozzle holes, not more than $(\sqrt{3})\cdot D/2$, wherein the nozzle width is the width from end to end of a plurality of nozzle holes of the spray tank (along with the direction intersecting a conveying direction of the light-sensitive material), and the coating length means the length measured when the light-sensitive material is conveyed beneath a nozzle, and an alkaline processing solution is coated thereon at a given length.).

After an interval of 1 sec. from completion of the coating of an alkaline processing solution, the coating of a hydrogen peroxide-containing solution started.

As is apparent from Table 4, it is found that, when a tank processing was carried out with a development intensifier as in the processing step 1, color-formation occurred, but bubbles were generated, due to decomposition of hydrogen peroxide during processing, so that the processing solution was deteriorated. Further, unevenness was observed on the processed samples. On the other hand, when both an alkaline processing solution and a hydrogen peroxide-containing solution were supplied by a method in which a light-sensitive material was dipped in an alkaline processing solution, or a hydrogen peroxide-containing solution, or by a method in which a light-sensitive material contacted a coating part of the coating device for an alkaline processing solution, as in the coating methods 1 to 3, a high color density was obtained and a uniform image was formed, both at the beginning of the processing, but with the passage of time, bubbles generated in the hydrogen peroxide-containing solution, or at the coating part, so that unevenness occurred on the image formed by such a processing.

In contrast, it can be found that, when a hydrogen peroxide-containing solution was coated according to a method of the present invention, such as the coating method 4, an image having a high color-density could be obtained, and no unevenness occurred on the image, even after a continuous processing.

Example 4

The samples (300) to (308) used in Example 3 were processed and evaluated in the same manner as in Example 3, except for the exposure to light as described below. For the processing, the coating methods 1, 2, and 3 were used to coat an alkaline processing solution, while the coating method 4 was used to coat a hydrogen peroxide-containing solution.

(Exposure to Light)

Light having a wavelength of 473 nm, taken out by wavelength conversion of a YAG solid laser (oscillation wavelength, 946 nm) by an SHG crystal of $KNbO_3$, using, as a light source, a semiconductor laser GaAlAs (oscillation wavelength, 808.5 nm) serving as an excitation light source; light having a wavelength of 532 nm, taken out by wavelength conversion of a $YVO_4$ solid laser (oscillation wavelength, 1064 nm) by an SHG crystal of KTP, using, as a light source, a semiconductor laser GaAlAs (oscillation wavelength: 808.7 nm) serving as an excitation light source; and light from AlGaInP (oscillation wavelength, about 670 nm; Type No. TOLD 9211, manufactured by Toshiba Corporation) were used. The laser beams of the apparatus could be scanned successively by a rotating polyhedron over a color print paper moved vertically to the scanning direction for exposure to light. Using this apparatus, the amount of light was varied, to find the relationship D-log E between the density (D) of the light-sensitive material and the amount of light (E). At that time, with respect to the laser beams having three wavelengths, the amounts of the lights were modulated using an external modulator, to control the exposure amounts. In this scanning exposure, the density of the picture element was 400 dpi, and the average exposure time per picture element was about $5\times10^{-8}$ sec. The temperature of the semiconductor lasers was kept constant by using Peltier elements to suppress the fluctuation of the amounts of lights due to the temperature.

As a result, even when an image was formed by a digital exposure to a light having a high intensity of illumination, when the processing was carried out according to the image-forming method of the present invention, an image having a high maximum density, similarly to Example 3, could also be obtained, and moreover an image having no unevenness could be obtained, even after a continuous (running) processing.

Example 5

(Preparation of Light-Sensitive Material)

A paper base both surfaces of which had been laminated with polyethylene, was subjected to surface corona discharge treatment; then it was provided with a gelatin undercoat layer containing sodium dodecylbenzensulfonate, and it was coated with various photographic constitutional layers, to prepare a multi-layer photographic color printing paper (500) having the layer constitution shown below. The coating solutions were prepared as follows.

First-layer Coating Solution 23 g of a coupler (C-21), 16 g of a color-developing compound (I-32), and 80 g of a solvent (Solv-1), were dissolved in ethyl acetate, and the resulting solution was emulsified and dispersed in 400 g of a 16% gelatin solution containing 10% sodium dodecylbenzensulfonate and citric acid, to prepare an emulsified dispersion A. On the other hand, a silver chlorobromide emulsion A (cubes; a mixture of a large-size emulsion A having an average grain size of 0.20 $\mu$m, and a small-size emulsion A having an average grain size of 0.10 $\mu$m (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride) was prepared. To the large-size emulsion A of this emulsion, had been added $7.0\times10^{-4}$ mol, per mol of silver, of each of blue-sensitive sensitizing dyes A, B, and C shown below, and to the small-size emulsion A of this emulsion, had been added $8.5\times10^{-4}$ mol, per mol of silver, of each of blue-sensitive sensitizing dyes A, B, and C shown below. The chemical ripening of this emulsion was carried out with a sulfur sensitizer and a gold sensitizer being added. The above emulsified dispersion A and this silver chlorobromide emulsion A were mixed and dissolved, and a first-layer coating solution was prepared so that it would have the composition shown below. The coating amount of the emulsion is in terms of silver.

The coating solutions for the second layer to the seventh layer were prepared in the similar manner as that for the first-layer coating solution. As the gelatin hardener for each layer, 1-oxy-3,5-dichloro-s-triazine sodium salt was used.

Further, to each layer, were added Cpd-12, Cpd-13, Cpd-14, and Cpd-15, so that the total amounts would be 15.0 mg/m$^2$, 60.0 mg/m$^2$, 5.0 mg/m$^2$, and 10.0 mg/m$^2$, respectively.

For the silver chlorobromide emulsion of the respective photosensitive emulsion layer, the following spectral sensitizing dyes were used.

(Blue-Sensitive Emulsion Layer)

Sensitizing dye A

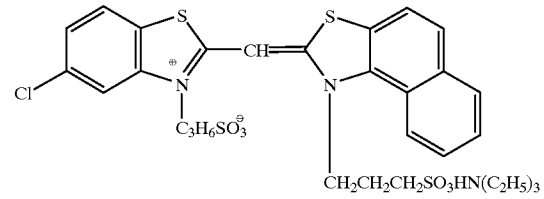

Sensitizing dye B

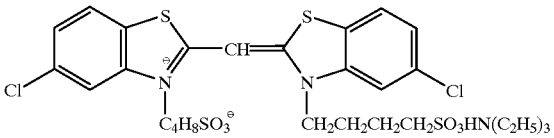

Sensitizing dye C

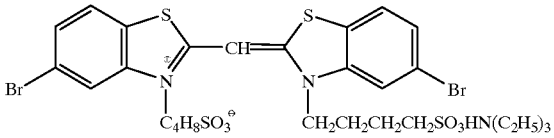

(Each was added to the large-size emulsion in an amount of $7.0\times10^{-4}$ mol, per mol of silver halide, and to the small-size emulsion in an amount of $8.5\times10^{-4}$ mol, per mol of silver halide.)

(Green-Sensitive Emulsion Layer)

Sensitizing dye D

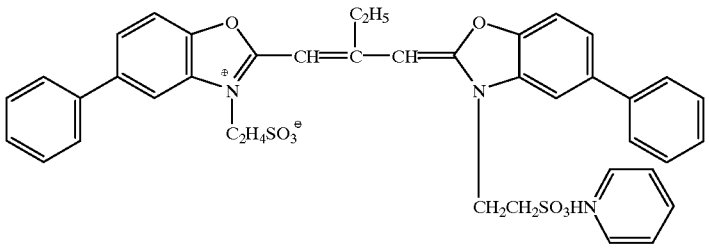

Sensitizing dye E

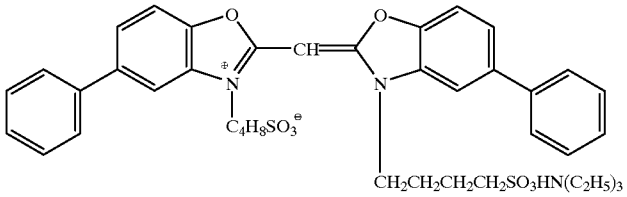

Sensitizing dye F

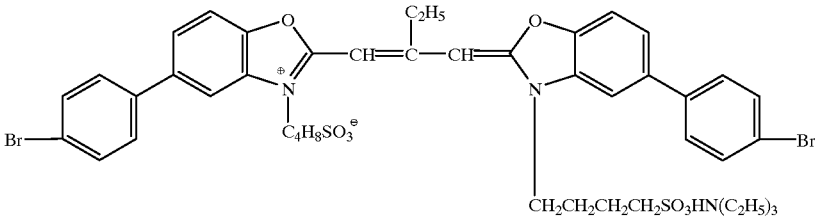

(The sensitizing dye D was added to the large-size emulsion in an amount of $1.5\times10^{-3}$ mol per mol of the silver halide, and to the small-size emulsion in an amount of $1.8\times10^{-3}$ mol per mol of the silver halide; the sensitizing dye E was added to the large-size emulsion in an amount of $2.0\times10^{-4}$ mol per mol of the silver halide, and to the small-size emulsion in an amount of $3.5\times10^{-4}$ mol per mol of the silver halide; and the sensitizing dye F was added to the large-size emulsion in an amount of $1.0\times10^{-3}$ mol per mol of the silver halide, and to the small-size emulsion in an amount of $1.4\times10^{-3}$ mol per mol of the silver halide.)

(Red-Sensitive Emulsion Layer)

Sensitizing dye G

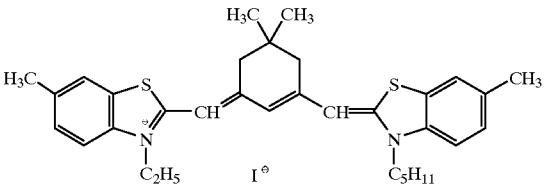

-continued

Sensitizing dye H

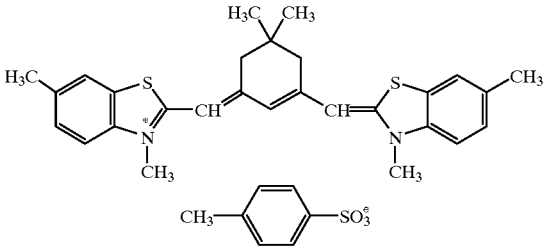

(Each was added to the large-size emulsion in an amount of $2.5\times10^{-4}$ mol per mol of the silver halide, and to the small-size emulsion in an amount of $4.0\times10^{-4}$ per mol of the silver halide.)

Further, the following compound was added to the red-photosensitive emulsion layer in an amount of $2.6\times10^{-3}$ mol per mol of the silver halide.

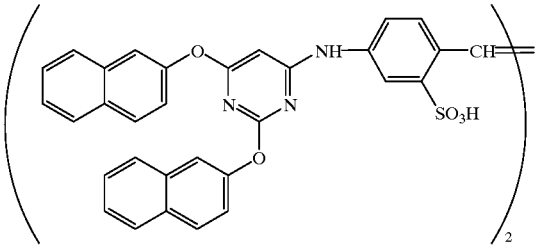

To the blue-sensitive emulsion layer, the green-sensitive emulsion layer, and the red-sensitive emulsion layer, was added 1-(5-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, to the second layer, the forth layer, the sixth layer, and the seventh layer, was added 1-(5-methylureidophenyl)-5-mercaptotetrazole in amounts of 0.2 mg/m$^2$, 0.2 mg/m$^2$, 0.6 mg/m$^2$, and 0.1 mg/m$^2$, respectively.

Further, to the blue-photosensitive emulsion layer and the green-photosensitive emulsion layer, were added 4-hydroxy-6-methyl-1,3,3a,7-tetrazaindene in amounts of $1\times10^{-4}$ mol and $2\times10^{-4}$ mol, respectively, per mol of the silver halide.

Further, to prevent irradiation, the following dyes were added to the emulsion layers (the coating amount is shown in parentheses).

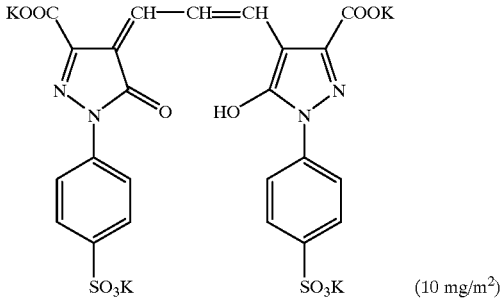

(10 mg/m$^2$)

and

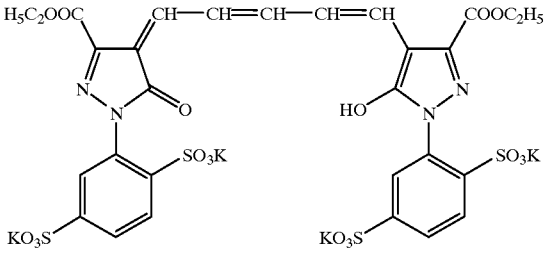

(40 mg/m$^2$)

(Layer Constitution)

The composition of each layer is shown below. The numbers show coating amounts (g/m$^2$). In the case of the silver halide emulsion, the coating amount is in terms of silver.

Base

Polyethylene-Laminated Paper

[The polyethylene on the first layer side contained a fluorescent whitening agent (I) shown below, a white pigment ($TiO_2$: 15 wt %), and a blue dye (ultramarine)]

| | |
|---|---|
| First Layer (Blue-Sensitive Emulsion Layer) | |
| The above silver chlorobromide emulsion A | 0.015 |
| Gelatin | 1.50 |
| Yellow coupler (C-21) | 0.23 |
| Color-developing compound (I-16) | 0.16 |
| Solvent (Solv-1) | 0.80 |
| Second Layer (Color-Mixing Inhibiting Layer) | |
| Gelatin | 1.09 |
| Color-mixing inhibitor (Cpd-7) | 0.11 |
| Solvent (Solv-2) | 0.19 |
| Solvent (Solv-3) | 0.07 |
| Solvent (Solv-4) | 0.25 |
| Solvent (Solv-5) | 0.09 |
| 1,5-diphenyl-3-pyrazolidone (in the state of a fine-grain solid dispersion) | 0.03 |
| Third Layer (Green-Sensitive Emulsion Layer) | |
| A silver chlorobromide emulsion B: cubes, a mixture of a large-size emulsion B having an average grain size of 0.1 μm, and a small-size emulsion B having an average grain size of 0.08 μm (1:3 in terms of mol of silver). The deviation coefficients of the grain size distributions were 0.10 and 0.08, respectively, and each emulsion had 0.8 mol % of AgBr locally contained in part of the grain surface whose substrate was made up of silver chloride. | 0.01 |
| Gelatin | 1.50 |
| Magenta coupler (C-56) | 0.24 |
| Color-developing compound (I-32) | 0.16 |
| Solvent (Solv-1) | 0.80 |
| Fourth Layer (Color-Mixing Inhibiting Layer) | |
| Gelatin | 0.77 |
| Color-mixing inhibitor (Cpd-7) | 0.08 |
| Solvent (Solv-2) | 0.14 |
| Solvent (Solv-3) | 0.05 |
| Solvent (Solv-4) | 0.14 |
| Solvent (Solv-5) | 0.06 |
| 1,5-diphenyl-3-pyrazolidone (in the state of a fine-grain solid dispersion) | 0.02 |
| Fifth Layer (Red-Sensitive Emulsion Layer) | |
| A silver chlorobromide emulsion C: cubes, a mixture of a large-size emulsion C having an average grain size of 0.1 μm, and a small-size emulsion having an average grain size of 0.08 μm (1:4 in terms of mol of silver). The deviation coefficients of the grain size distributions were 0.09 and 0.11, respectively, and each emulsion had 0.8 mol % of AgBr locally contained in part of the grain surface whose substrate was made up of silver chloride. | 0.01 |
| Gelatin | 0.15 |
| Cyan coupler (C-43) | 0.21 |
| Color-developing compound (I-16) | 0.20 |
| Solvent (Solv-1) | 0.80 |
| Sixth Layer (Ultraviolet Absorbing Layer) | |
| Gelatin | 0.64 |
| Ultraviolet absorbing agent (UV-1) | 0.39 |
| Color-image stabilizer (Cpd-7) | 0.05 |
| Solvent (Solv-6) | 0.05 |
| Seventh Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |
| Wetting-property modifier (Cpd-8) | 0.09 |
| Wetting-property modifier (Cpd-9) | 0.03 |
| Wetting-property modifier (Cpd-10) | 0.03 |

(Cpd-1) Surface-active agent
A mixture in 7:3 (weight ratio) of
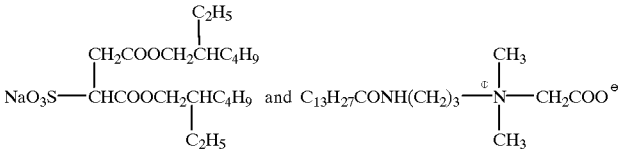
(Cpd-2) Antiseptics
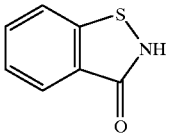
(Cpd-3) Antiseptics
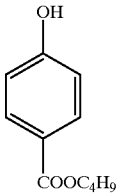
(Cpd-4) Antiseptics
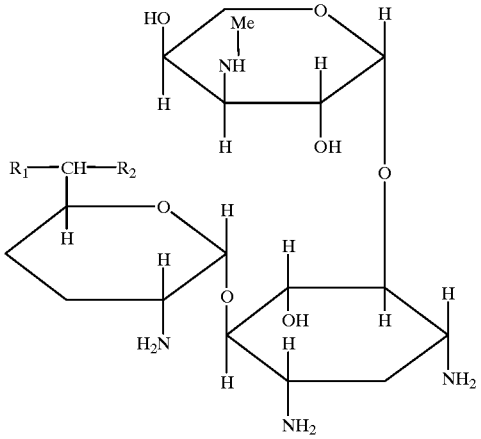
| | $R_1$ | $R_2$ |
|---|---|---|
| a | —Me | —NHMe |
| b | —Me | —$NH_2$ |
| c | —H | —$NH_2$ |
| d | —H | —NHMe |
A mixture in 1:1:1:1 of a, b, c, d
(Cpd-5) Antiseptics
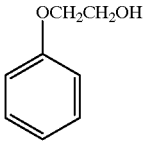
(Solv-1) Solvent
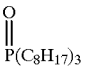
(Cpd-6) Color-mixing inhibitor
(1)
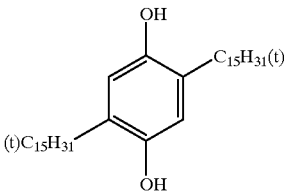
(2)
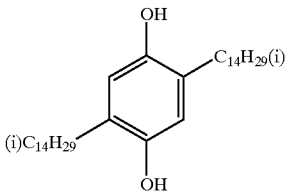
(3)
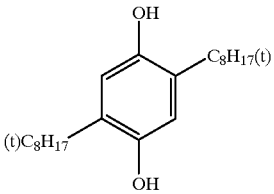
(1):(2):(3) = 1:1:1 mixture (weight ratio)

-continued
(Solv-2) Solvent
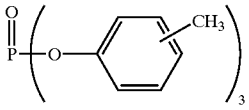
(Solv-3) Solvent
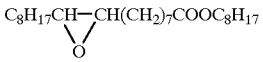
(Solv-4) Solvent
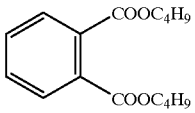
(Solv-5) Solvent
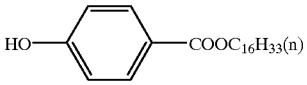
(Solv-6) Solvent
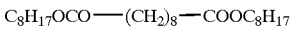
(Cpd-7) Color-image stabilizer
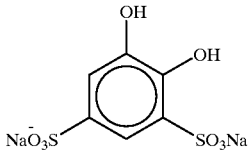
(Cpd-8) Wetting-property modifier
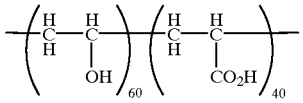
number average
molecular weight 1,000,000
(Cpd-9) Wetting-property modifier
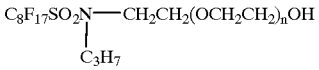
$n = 15$
(Cpd-10) Wetting-property modifier
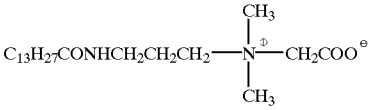
(UV-1) Ultra-violet absorbent
(1)
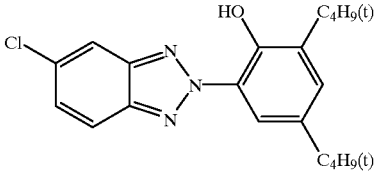
(2)
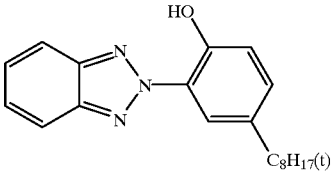
(3)
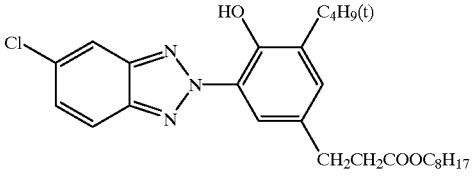
(4)
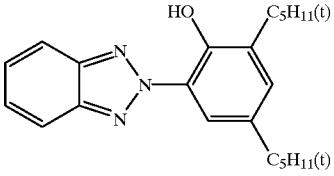
(5)
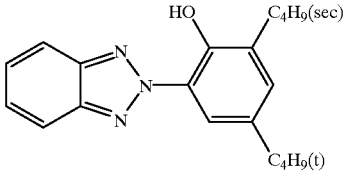
(1):(2):(3):(4):(5) = 1:2:2:3:1 mixture (weight ratio)

-continued

Flourescent whitening agent (I)
Content 15 mg/m$^2$
Ratio of 0.05% by
weight to polyethylene

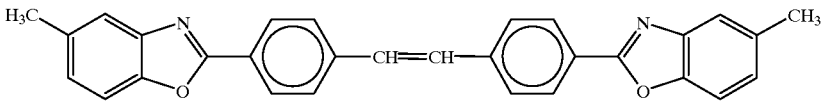

Samples (501) to (508) were prepared in the same manner as in Sample (500), except that instead of the couplers and color-developing compounds used in Sample (500), the couplers and color-developing compounds shown in Table 5 were used, in the same molar amounts.

TABLE 5

| Sample No. | Photosensitive layer | Color-forming reducing agent or color-developing agent precursor | Coupler |
|---|---|---|---|
| (500) | Blue-photosensitive layer | I-32 | C-21 |
| | Green-photosensitive layer | I-32 | C-56 |
| | Red-photosensitive layer | I-16 | C-43 |
| (501) | Blue-photosensitive layer | I-1 | C-2 |
| | Green-photosensitive layer | I-1 | C-28 |
| | Red-photosensitive layer | I-1 | C-42 |
| (502) | Blue-photosensitive layer | I-27 | C-21 |
| | Green-photosensitive layer | I-27 | C-56 |
| | Red-photosensitive layer | I-16 | C-43 |
| (503) | Blue-photosensitive layer | I-16 | C-2 |
| | Green-photosensitive layer | I-16 | C-56 |
| | Red-photosensitive layer | I-16 | C-43 |
| (504) | Blue-photosensitive layer | I-61 | C-14 |
| | Green-photosensitive layer | I-61 | C-40 |
| | Red-photosensitive layer | I-61 | C-44 |
| (505) | Blue-photosensitive layer | D-19 | C-81 |
| | Green-photosensitive layer | D-19 | C-82 |
| | Red-photosensitive layer | D-19 | C-83 |
| (506) | Blue-photosensitive layer | D-20 | C-81 |
| | Green-photosensitive layer | D-21 | C-82 |
| | Red-photosensitive layer | D-15 | C-83 |
| (507) | Blue-photosensitive layer | P-2 | C-84 |
| | Green-photosensitive layer | P-2 | C-25 |
| | Red-photosensitive layer | P-2 | C-105 |
| (508) | Blue-photosensitive layer | P-11 | C-90 |
| | Green-photosensitive layer | P-11 | C-97 |
| | Red-photosensitive layer | P-11 | C-112 |

(Preparation of Processing Solutions)

A development-intensifying solution having the following composition was prepared.

| Development-intensifying solution | |
|---|---|
| Water | 800 ml |
| Sodium 5-sulfosalicylate | 25 g |
| KCl | 1.25 g |
| Benzotriazole | 0.01 g |
| Hydroxyethylidene-1,1-diphosphonate (30% aqueous solution) | 2 ml |
| Surface-tension reducing agent (Stil-1) | 2.5 g |
| Hydrogen peroxide (30% aqueous solution) | 15 ml |
| Water to make | 1000 ml |
| pH | 12 |

-continued

Development-intensifying solution (Stil-1) Surface-tension reducing agent

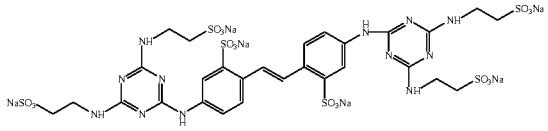

An alkaline processing solution a-1 having the following composition was prepared.

| Alkaline processing solution a-1 | |
|---|---|
| Water | 800 ml |
| Sodium 5-sulfosalicylate | 50 g |
| KCl | 2.5 g |
| Benzotriazole | 0.02 g |
| Hydroxyethylidene-1,1-diphosphonate (30% aqueous solution) | 4 ml |
| Water to make | 1000 ml |
| pH | 13 |

Alkaline processing solutions a-2 to a-10 were prepared in the same manner as the processing solution a-1, except that each of surface-tension reducing agents shown in Table 6 was added in an amount shown in Table 6.

TABLE 6

| Processing solution No. | Kind of additive | Added amount | Surface tension (dyn/cm) | Contact angle with nozzle (°) |
|---|---|---|---|---|
| a-1 | — | — | 69 | 85 |
| a-2 | SR-13 | 4.5 mmol/l | 43 | 63 |
| a-3 | SR-32 | 4.5 mmol/l | 42 | 64 |
| a-4 | SR-28 | 4.5 mmol/l | 55 | 74 |
| a-5 | SR-31 | 4.5 mmol/l | 56 | 76 |
| a-6 | F-4 | 1 mmol/l | 22 | 59 |
| a-7 | F-7 | 1 mmol/l | 22 | 54 |
| a-8 | F-9 | 1 mmol/l | 22 | 52 |
| a-9 | F-4 | 6 mmol/l | 19 | 35 |
| a-10 | F-7 | 6 mmol/l | 19 | 36 |

A hydrogen peroxide-containing solution b-1 having the following composition was prepared.

| Hydrogen peroxide-containing solution | |
|---|---|
| Water | 800 ml |
| Sodium 5-sulfosalicylate | 50 g |

-continued

| Hydrogen peroxide-containing solution | |
|---|---|
| KCl | 2.5 g |
| Benzotriazole | 0.02 g |
| Hydroxyethylidene-1,1-diphosphonate (30% aqueous solution) | 4 ml |
| Hydrogen peroxide | 30 ml |
| Water to make | 1000 ml |
| pH | 7 |

Hydrogen peroxide-containing solutions b-2 to b-10 were prepared in the same manner as the processing solution b-1, except that each of surface-tension reducing agents shown in Table 7 was added in an amount shown in Table 7.

TABLE 7

| Processing solution No. | Kind of additive | Added amount | Surface tension (dyn/cm) | Contact angle with nozzle (°) |
|---|---|---|---|---|
| b-1 | — | — | 69 | 85 |
| b-2 | SR-13 | 4.5 mmol/l | 43 | 63 |
| b-3 | SR-32 | 4.5 mmol/l | 42 | 64 |
| b-4 | SR-28 | 4.5 mmol/l | 55 | 74 |
| b-5 | SR-31 | 4.5 mmol/l | 56 | 76 |
| b-6 | F-4 | 1 mmol/l | 22 | 59 |
| b-7 | F-7 | 1 mmol/l | 22 | 54 |
| b-8 | F-9 | 1 mmol/l | 22 | 52 |
| b-9 | F-4 | 6 mmol/l | 19 | 35 |
| b-10 | F-7 | 6 mmol/l | 19 | 36 |

| Stabilizing solution | |
|---|---|
| Potassium carbonate | 15 g |
| Sodium 2-mercaptobenzimidazole-5-sulfonate | 1 g |
| Hydroxyethylidene-1,1-diphosphonate (30% aqueous solution) | 1 ml |
| 5-Chloro-2-methyl-4-isothiazoline-3-one | 0.02 g |
| Water to make | 1000 ml |
| pH | 7.0 |
| Rinse solution | |
| Sodium chlorinated isocyanurate | 0.02 g |
| Deionized water (conductivity: 5 μS/cm or below) | 1000 ml |
| pH | 6.5 |

(Processing Steps)

Processing Step 1

| Processing step | Temperature | Time |
|---|---|---|
| Development-intensifying | 40° C. | 30 sec |
| Stabilization | 40° C. | 15 sec |
| Rinse | 40° C. | 60 sec |
| Drying | 70° C. | 60 sec |

Processing Step 2

| Processing Step | Temperature | Time |
|---|---|---|
| Coating of the alkaline processing Solution (Coating process by the method described in Table 8, coated amount of the processing solution: 40 ml/m$^2$.) | 40° C. | — |
| Coating of the hydrogen peroxide-containing solution (Coating process by the method described in Table 8, coated amount of the processing solution: 40 ml/m$^2$.) | 40° C. | — |
| Standing of the light-sensitive material on a heat panel | 40° C. | 30 sec. |
| Stabilization processing | 40° C. | 45 sec. |
| Washing | 30° C. | 90 sec. |
| Drying | 70° C. | 60 sec. |

All of the thus-prepared samples were subjected to gradation exposure to light through three-color-separation filters for sensitometry, using a FWH model sensitometer (color temperature of light sources: 3200° K.), manufactured by Fuji Photo Film Co. Ltd.

Each of the thus-exposed samples was processed in the processing method shown in Table 8.

Densitometric measurement of each of the processed samples was carried out through a blue light, a green light, and a red light. The densities obtained by measurement through each of lights are shown in Table 8.

Further, an unexposed and unprocessed (unused) sample was cut to size 5 cm×10 cm, and then the whole surface of the cut sample was exposed to white light. The exposed sample was processed according to the processing method and the processing conditions shown in Table 8. At that time, a processing solution was coated, so that the side of 10 cm was horizontal to the coating direction.

Densitometric measurement was carried out with respect to the area of the processed sample, i.e. the inner part of 0.3 cm from the outer edge (outside) of the longer side of 10 cm, and of 4 cm from the 3 cm inside of the shorter side of 5 cm. The average value of the measured densities is designated as De. Further, densitometric measurement was carried out with respect to the area of the processed sample, i.e. the inner part (central part) of 5 cm from the outside of the longer side of 10 cm, and of 4 cm from the 3 cm inside of the shorter side of 5 cm. The average value of the measured densities is designated as Dc.

TABLE 8

| Process No. | Sample No. | Alkaline processing solution No. | Peroxide-containing solution No. | Processing method | Coating method of alkaline processing solution | Coating method of peroxide-containing solution | Dc Blue | Dc Green | Dc Red | De Blue | De Green | De Red |
|---|---|---|---|---|---|---|---|---|---|---|---|---|
| 101 | (500) | — | — | 1 | — | — | 2.42 | 2.56 | 1.61 | 2.42 | 2.56 | 1.61 |
| 102 | " | a-1 | b-1 | 2 | 1 | 4 | 2.55 | 2.64 | 1.68 | 2.55 | 2.64 | 1.68 |
| 103 | " | a-4 | b-1 | 2 | 1 | 4 | 2.55 | 2.64 | 1.68 | 0.82 | 0.57 | 0.51 |
| 104 | " | a-2 | b-1 | 2 | 1 | 4 | 2.55 | 2.64 | 1.68 | 0.82 | 0.57 | 0.51 |
| 105 | " | a-6 | b-1 | 2 | 1 | 4 | 2.55 | 2.64 | 1.68 | 0.82 | 0.57 | 0.51 |
| 106 | " | a-6 | b-2 | 2 | 1 | 4 | 2.55 | 2.64 | 1.68 | 0.82 | 0.57 | 0.51 |
| 107 | " | a-2 | b-2 | 2 | 1 | 4 | 2.55 | 2.64 | 1.68 | 2.55 | 2.64 | 1.68 |
| 108 | " | a-1 | b-2 | 2 | 1 | 4 | 2.55 | 2.64 | 1.68 | 2.42 | 2.51 | 1.52 |
| 109 | " | a-1 | b-1 | 2 | 2 | 4 | 2.55 | 2.64 | 1.68 | 2.55 | 2.68 | 1.68 |
| 110 | " | a-2 | b-1 | 2 | 2 | 4 | 2.55 | 2.64 | 1.68 | 0.82 | 0.57 | 0.51 |
| 111 | " | a-2 | b-2 | 2 | 2 | 4 | 2.55 | 2.64 | 1.68 | 2.55 | 2.68 | 1.68 |
| 112 | " | a-6 | b-6 | 2 | 2 | 4 | 2.55 | 2.64 | 1.68 | 2.55 | 2.68 | 1.68 |
| 113 | " | a-1 | b-1 | 2 | 3 | 4 | 2.55 | 2.64 | 1.68 | 2.55 | 2.68 | 1.68 |
| 114 | " | a-2 | b-1 | 2 | 3 | 4 | 2.55 | 2.64 | 1.68 | 0.82 | 0.57 | 0.51 |
| 115 | " | a-2 | b-2 | 2 | 3 | 4 | 2.55 | 2.64 | 1.68 | 2.55 | 2.64 | 1.68 |
| 116 | " | a-6 | b-6 | 2 | 3 | 4 | 2.55 | 2.64 | 1.68 | 2.55 | 2.64 | 1.68 |
| 117 | " | a-2 | b-1 | 2 | 4 | 4 | 2.55 | 2.64 | 1.68 | 0.82 | 0.57 | 0.51 |
| 118 | " | a-4 | b-1 | 2 | 4 | 4 | 2.55 | 2.64 | 1.68 | 0.82 | 0.57 | 0.51 |
| 119 | " | a-6 | b-1 | 2 | 4 | 4 | 2.55 | 2.64 | 1.68 | 0.82 | 0.57 | 0.51 |
| 120 | " | a-6 | b-2 | 2 | 4 | 4 | 2.55 | 2.64 | 1.68 | 0.82 | 0.57 | 0.51 |
| 121 | (500) | a-2 | b-6 | 2 | 4 | 4 | 2.55 | 2.64 | 1.68 | 2.41 | 2.50 | 1.53 |
| 122 | " | a-2 | b-2 | 2 | 4 | 4 | 2.55 | 2.64 | 1.68 | 2.55 | 2.64 | 1.68 |
| 123 | " | a-2 | b-3 | 2 | 4 | 4 | 2.55 | 2.64 | 1.68 | 2.54 | 2.62 | 1.64 |
| 124 | " | a-3 | b-2 | 2 | 4 | 4 | 2.55 | 2.64 | 1.68 | 2.54 | 2.62 | 1.64 |
| 125 | " | a-3 | b-3 | 2 | 4 | 4 | 2.55 | 2.64 | 1.68 | 2.54 | 2.62 | 1.64 |
| 126 | " | a-4 | b-4 | 2 | 4 | 4 | 2.55 | 2.64 | 1.68 | 2.54 | 2.62 | 1.64 |
| 127 | " | a-4 | b-2 | 2 | 4 | 4 | 2.55 | 2.64 | 1.68 | 2.42 | 2.51 | 1.52 |
| 128 | " | a-2 | b-4 | 2 | 4 | 4 | 2.55 | 2.64 | 1.68 | 0.82 | 0.57 | 0.51 |
| 129 | " | a-5 | b-5 | 2 | 4 | 4 | 2.55 | 2.64 | 1.68 | 2.55 | 2.64 | 1.68 |
| 130 | " | a-6 | b-6 | 2 | 4 | 4 | 2.55 | 2.64 | 1.68 | 2.55 | 2.64 | 1.68 |
| 131 | " | a-7 | b-7 | 2 | 4 | 4 | 2.55 | 2.64 | 1.68 | 2.55 | 2.64 | 1.68 |
| 132 | " | a-8 | b-8 | 2 | 4 | 4 | 2.55 | 2.64 | 1.68 | 2.55 | 2.64 | 1.68 |
| 133 | " | a-9 | b-9 | 2 | 4 | 4 | 2.55 | 2.64 | 1.68 | 2.55 | 2.64 | 1.68 |
| 134 | " | a-10 | b-10 | 2 | 4 | 4 | 2.55 | 2.64 | 1.68 | 2.55 | 2.64 | 1.68 |
| 135 | (501) | — | — | 1 | — | — | 2.02 | 2.58 | 2.09 | 2.02 | 2.58 | 2.09 |
| 136 | " | a-2 | b-1 | 2 | 4 | 4 | 2.09 | 2.58 | 2.16 | 0.79 | 0.58 | 0.71 |
| 137 | " | a-2 | b-2 | 2 | 4 | 4 | 2.09 | 2.58 | 2.16 | 2.09 | 2.58 | 2.16 |
| 138 | (502) | — | — | 1 | — | — | 2.51 | 2.46 | 1.61 | 2.51 | 2.46 | 1.61 |
| 139 | " | a-2 | b-1 | 2 | 4 | 4 | 2.58 | 2.55 | 1.68 | 0.83 | 0.56 | 0.51 |
| 140 | " | a-2 | b-2 | 2 | 4 | 4 | 2.58 | 2.55 | 1.68 | 2.58 | 2.55 | 1.68 |
| 141 | (503) | — | — | 1 | — | — | 2.11 | 2.09 | 1.61 | 2.11 | 2.09 | 1.61 |
| 142 | " | a-2 | b-1 | 2 | 4 | 4 | 2.19 | 2.14 | 1.68 | 0.79 | 0.48 | 0.50 |
| 143 | " | a-2 | B-2 | 2 | 4 | 4 | 2.19 | 2.14 | 1.68 | 2.19 | 2.14 | 1.68 |
| 144 | (504) | — | — | 1 | — | — | 2.28 | 1.59 | 1.58 | 2.28 | 1.59 | 1.58 |
| 145 | " | a-2 | b-1 | 2 | 4 | 4 | 2.36 | 1.63 | 1.63 | 0.80 | 0.50 | 0.51 |
| 146 | " | a-2 | b-2 | 2 | 4 | 4 | 2.36 | 1.63 | 1.63 | 2.36 | 1.63 | 1.63 |
| 147 | (505) | — | — | 1 | — | — | 1.08 | 1.02 | 0.98 | 1.08 | 1.02 | 0.98 |
| 148 | " | a-2 | b-1 | 2 | 4 | 4 | 1.15 | 1.07 | 1.13 | 0.41 | 0.28 | 0.25 |
| 149 | " | a-2 | b-2 | 2 | 4 | 4 | 1.15 | 1.07 | 1.13 | 1.15 | 1.07 | 1.13 |
| 150 | (506) | — | — | 1 | — | — | 1.03 | 0.98 | 0.95 | 1.03 | 0.98 | 0.95 |
| 151 | " | a-2 | b-1 | 2 | 4 | 4 | 1.09 | 1.08 | 1.11 | 0.40 | 0.28 | 0.24 |
| 152 | " | a-2 | b-2 | 2 | 4 | 4 | 1.09 | 1.08 | 1.11 | 1.09 | 1.08 | 1.11 |
| 153 | (507) | — | — | 1 | — | — | 1.23 | 1.24 | 1.21 | 1.23 | 1.24 | 1.21 |
| 154 | " | a-2 | b-1 | 2 | 4 | 4 | 1.35 | 1.36 | 1.35 | 0.61 | 0.42 | 0.41 |
| 155 | " | a-2 | b-2 | 2 | 4 | 4 | 1.35 | 1.36 | 1.35 | 1.35 | 1.36 | 1.35 |
| 156 | (508) | — | — | 1 | — | — | 1.31 | 1.34 | 1.28 | 1.31 | 1.34 | 1.28 |
| 157 | " | a-2 | b-1 | 2 | 4 | 4 | 1.38 | 1.42 | 1.41 | 0.62 | 0.54 | 0.53 |
| 158 | " | a-2 | b-2 | 2 | 4 | 4 | 1.38 | 1.42 | 1.41 | 1.38 | 1.42 | 1.41 |

Coating Method 1

A light-sensitive material is dipped in a tank in which an alkaline processing solution or a hydrogen peroxide-containing solution is accumulated.

Coating Method 2

An alkaline processing solution or a hydrogen peroxide-containing solution is penetrated into a thin slit, and then a light-sensitive material is passed through the slit.

Coating Method 3

A known roller coater is used (width, 5.5 cm; coating length, 12 cm).

Coating Method 4

The device for coating a processing solution, as described in JP-A-9-179272, is used (nozzle width, 5.5 cm; coating length, 12 cm). At this time, liquid droplets are sprayed from nozzle holes, and three liquid droplets that have been sprayed from these nozzle holes and have attached onto a light-sensitive material in contact with each other, are attached to the light-sensitive material, so that they are adjacent to each other with no interval between them.

As is apparent from Table 8, when the tank processing was carried out using a development intensifier according to the coating method 1, as in the processing No. 101, color-formation occurred but bubbles were generated, due to decomposition of hydrogen peroxide during the processing, and as a result the processing solution was deteriorated. Further, unevenness was observed on the processed samples. On the other hand, when an alkaline processing solution and a peroxide-containing solution were separately applied, as in the coating method 2, unevenness due to the generation of the bubbles was not observed on the processed samples. However, when the surface tension of the peroxide-containing solution was larger by more than 10 dyn/cm than that of the alkaline processing solution, as in the processing Nos. 103 to 106, 110, and 114, the value of De was extremely small, which indicated that a failure of the coating of the hydrogen peroxide-containing solution arose at a peripheral portion of the light-sensitive material. Different from the above, when the surface tension of the peroxide-containing solution was not larger by more than 10 dyn/cm than that of the alkaline processing solution, as in the processing Nos. 102, 107, 111 to 113, and 115, the value of De was almost the same as the value of Dc, which indicated that the peroxide-containing solution was coated fully on to the peripheral portion of the light-sensitive material.

Example 6

The samples (500) to (508) were processed using alkaline processing solutions a-1 to a-10, and b-1 to b-10, in the same manner as in Example 5, except that these samples were subjected to gradation exposure of three-color separation according to the exposure method described below. The color density of the processed light-sensitive material was measured, and the state of the formed color obtained by a uniform coating was examined.

(Exposure to Light)

Light having a wavelength of 473 nm, taken out by wavelength conversion of a YAG solid laser (oscillation wavelength, 946 nm) by an SHG crystal of $KNbO_3$, using, as a light source, a semiconductor laser GaAlAs (oscillation wavelength, 808.5 nm) serving as an excitation light source; light having a wavelength of 532 nm, taken out by wavelength conversion of a $YVO_4$ solid laser (oscillation wavelength, 1064 nm) by an SHG crystal of KTP, using, as a light source, a semiconductor laser GaAlAs (oscillation wavelength: 808.7 nm) serving as an excitation light source; and light from AlGaInP (oscillation wavelength, about 670 nm; Type No. TOLD 9211, manufactured by Toshiba Corporation) were used. The laser beams of the apparatus could be scanned successively by a rotating polyhedron over a color print paper moved vertically to the scanning direction for exposure to light. Using this apparatus, the amount of light was varied, to find the relationship D-log E between the density (D) of the light-sensitive material and the amount of light (E). At that time, with respect to the laser beams having three wavelengths, the amounts of the lights were modulated using an external modulator, to control the exposure amounts. In this scanning exposure, the density of the picture element was 400 dpi, and the average exposure time per picture element was about $5\times10^{-8}$ sec. The temperature of the semiconductor lasers was kept constant by using Peltier elements to suppress the fluctuation of the amounts of lights due to the temperature.

As a result, it was found out that, even when an image was formed by a digital exposure to light having a high intensity of illumination, when the processing was carried out according to the image-forming method of the present invention, an image having a high maximum density, similarly to Example 5, was also obtained, and moreover color formation occurred with no unevenness up to the peripheral edge portion of the light-sensitive material.

Having described our invention as related to the present embodiments, it is our intention that the invention not be limited by any of the details of the description, unless otherwise specified, but rather be construed broadly within its spirit and scope as set out in the accompanying claims.

What I claim is:

1. A method for forming a color image that comprises subjecting to color-development a silver halide color photographic light-sensitive material having at least one photographic constitutional layer on a support, with an alkaline processing solution substantially free from a color-developing agent, wherein ① the said silver halide light-sensitive material contains, in at least one of the photographic constitutional layer, at least one dye-forming coupler and at least one compound or its precursor, that is oxidized by a silver halide, to form an oxidation product thereof, that is coupled with the said coupler, to form a dye having an absorption in a visible wavelength region; ② a coating silver amount, in terms of the total amount of silver in all coating layers of the said light-sensitive material, is 0.003 to 0.3 g/m$^2$, in terms of silver; ③ application of the said alkaline processing solution onto the said light-sensitive material is performed, by a method in which droplets of the processing solution are sprayed from a plurality of nozzle holes, so as to be coated thereon, and three droplets, which have been sprayed from these nozzle holes and then have attached onto the said light-sensitive material in contact with each other, are attached to the said light-sensitive material, so that they are adjacent to each other with no interval between them; and ④ subsequent to the coating of the said alkaline processing solution, a peroxide-containing solution is applied to the said light-sensitive material in the same manner as in the said alkaline processing solution.

2. The method for forming a color image as claimed in claim 1, wherein the compound whose oxidation product, formed by oxidation due to the said silver halide, is coupled with a coupler, to form a dye having an absorption in a visible wavelength region, is represented by the following formula (I) or (II):

formula (I)

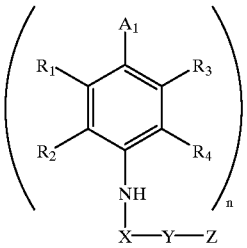

-continued formula (II)

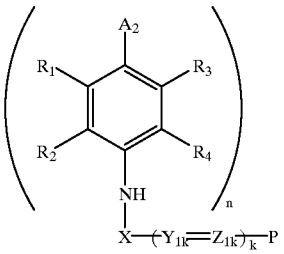

wherein $R_1$, $R_2$, $R_3$, and $R_4$ each represent a hydrogen atom, or a substituent; $A_1$ and $A_2$ each represent a hydroxyl group, or a substituted amino group; X represents a divalent or more multivalent linking group selected from —CO—, —SO—, —$SO_2$, and —PO<; $Y_{1k}$ and $Z_{1k}$ each represent a nitrogen atom, or a group represented by —$CR_5$= (in which $R_5$ represents a hydrogen atom, or a substituent); k represents 0 (zero), or a positive integer; P represents a proton-dissociating group, or a group that can be a cation, and it has a function to form a dye by breakage of an N—X bond and removal of a substituent bonded to a coupling site of a coupler, caused by transfer of an electron from P after the coupling reaction of the coupler with an oxidized product produced by a redox reaction of the above-said compound with silver halide exposed to light; Y represents a divalent linking group; Z is a nucleophilic group, and it is able to attack the X, when the above-said compound is oxidized; n is 1 or 2, when X is —PO<, or n is 1, when X is another group; $R_1$ and $R_2$, or $R_3$ and $R_4$, or at least two kinds of atoms or substituents arbitrarily selected from $Y_{1k}$, $Z_{1k}$, and P may be independently linked each other to form a ring, respectively.

3. The method for forming a color image as stated in claim 1, wherein the compound whose oxidation product, formed by oxidation due to the said silver halide, is coupled with a coupler, to form a dye having an absorption in a visible wavelength region, is represented by the following formula (III):

$R^{11}$—NHNH—$X^0$—$R^{12}$ formula (III)

wherein $R^{11}$ represents an aryl or heterocyclic group, which may be substituted with a substituent; $R^{12}$ represents an alkyl, alkenyl, alkinyl, aryl, or heterocyclic group, which may be substituted with a substituent; $X^0$ represents —$SO_2$—, —CO—, —COCO—, —CO—O—, —CONH($R^{13}$)—, —COCO—O—, —COCO—N($R^{13}$)—, or —$SO_2$—NH($R^{13}$)—, in which $R^{13}$ is a hydrogen atom, or a group mentioned for $R^{12}$.

4. The method for forming a color image as claimed in claim 3, wherein the compound represented by formula (III) is a compound represented by formula (IV) or (V):

formula (IV)

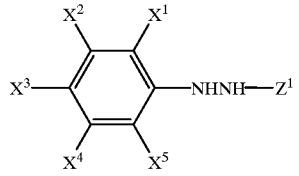

formula (V)

$R^{3a}$—NHNH—$Z^2$ wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$ each represent a hydrogen atom, or a substituent, with the proviso that the total of Hammett substituent constant σp values of $X^1$, $X^3$, and $X^5$, and Hammett substituent constant σm values of $X^2$ and $X^4$, is from 0.08 to 3.80; and $R^{3a}$ represents a heterocyclic group.

5. The method for forming a color image as claimed in claim 4, wherein the compound represented by formula (IV) or (V) is a compound represented by formula (VI) or formula (VI)

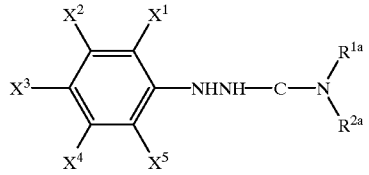

formula (VII)

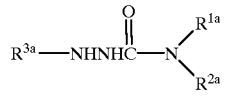

wherein $R^{1a}$ and $R^{2a}$ each represent a hydrogen atom, or a substituent; $X^1$, $X^2$, $X^3$, $X^4$, and $X^5$ each represent a hydrogen atom, or a substituent, with the proviso that the total of Hammett substituent constant σp values of $X^1$, $X^3$, and $X^5$, and Hammett substituent constant σm values of $X^2$ and $X^4$, is from 0.80 to 3.80; and $R^{3a}$ represents a heterocyclic group.

6. The method for forming a color image as claimed in claim 5, wherein the compound represented by formula (VI) or (VII) is a compound represented by formula (VIII) or (IX), respectively:

formula (VIII)

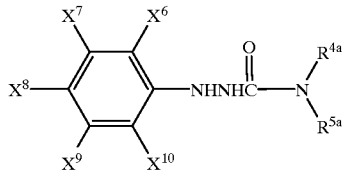

formula (IX)

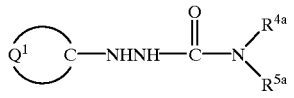

wherein $R^{4a}$ and $R^{5a}$ each represent a hydrogen atom, or a substituent, at least one of $R^{4a}$ and $R^{5a}$ being a hydrogen atom; $X^6$, $X^7$, $X^8$, $X^9$, and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, with the proviso that the total of Hammett substituent constant σp values of $X^6$, $X^8$, and $X^{10}$, and Hammett substituent constant σm values of $X^7$ and $X^9$, is from 1.20 to 3.80; and $Q^1$ represents a group of nonmetallic atoms necessary to form a nitrogen-containing five- to eight-membered heterocyclic ring together with the C.

7. The method for forming a color image as claimed in claim 1, wherein the precursor of the compound whose oxidation product, formed by oxidation due to the said silver halide, is coupled with a coupler, to form a dye having an absorption in a visible wavelength region, is represented by the following formula (X):

$$OHC—Ar—X(L)_m—PPD \qquad \text{formula (X)}$$

wherein Ar represents an aryl group, or a heterocyclic group; X represents a methylene group substituted at the position where a color-developing agent can be released subsequent to oxidization of the formyl group; L represents a linking group; m represents an integer of 0 to 3; and PPD represents a group to give a color-developing agent.

8. The method for forming a color image as claimed in claims 7, wherein the compound represented by formula (X) is a compound represented by formula (XI):

formula (XI)

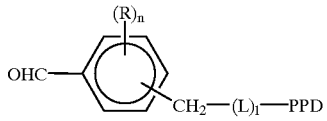

wherein R represents a hydrogen atom, a hydroxyl group, a halogen atom, an alkyl group, a cycloalkyl group, an aryl group, a heterocyclic group, an alkoxy group, an aryloxy group, an acyloxy group, an acylamino group, a sulfonylamino group, or another amino group, or Rs may be connected to each other to form a ring, depending on the case; $—CH_2—$ represents a methylene group bonded at the ortho or para position to the formyl group; L represents a linking group; PPD represents a group to give a color-developing agent; l represents an integer; and n represents an integer of 1 to 4.

9. The method for forming a color image as claimed in claim 8, wherein the compound represented by formula (XI) is a compound represented by formula (XII):

formula (XII)

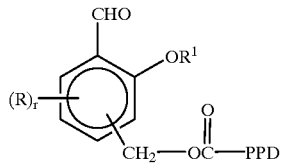

wherein $R^1$ represents a hydrogen atom, an alkyl group, an aryl group, or an acyl group; R has the same meaning as in formula (XI); $—CH_2—$ represents a methylene group bonded at the ortho or para position to the formyl group; PPD represents a group to give a color-developing agent; and r represents an integer of 0 to 3.

10. The method for forming a color image as claimed in claim 1, in which coating, onto the light-sensitive material, of both the said alkaline processing solution and the said peroxide-containing solution is carried out by spraying from a plurality of nozzle holes, wherein the volume of one droplet of the said alkaline processing solution injected from these nozzle openings is designated as V, and the contact angle of the said alkaline processing solution, when attached on the light-sensitive material, is designated as θ, and the diameter D of one droplet of the alkaline processing solution attached on the light-sensitive material is calculated according to equation:

$$D = 2 \cdot \mathrm{Sin}\theta\left(\frac{3 \cdot V}{\pi \cdot \{2^{-3} \cdot \cos\theta + (\cos\theta)^3\}}\right)^{1/3}$$

and a pitch P between the nozzle holes adjacent to each other is adjusted to the value not more than $(\sqrt{3})\cdot D/2$.

11. The method for forming a color image as claimed in claim 1, wherein the total of the thickness of a liquid membrane of both the alkaline processing solution and the peroxide-containing solution coated on the light-sensitive material, is not more than 100 μm.

12. The method for forming a color image as claimed in claim 1, wherein the interval between coatings of the said alkaline processing solution followed by the said peroxide-containing solution is not more than 10 seconds.

13. The method for forming a color image as claimed in claim 1, wherein the said peroxide-containing solution is an aqueous hydrogen peroxide solution.

14. The method for forming a color image as claimed in claim 1, which comprises exposing the light-sensitive material to light by a scanning exposure system, wherein the exposure time per picture element is $10^{-8}$ to $10^{-4}$ seconds, and there is an overlapping between rasters adjacent to each other.

* * * * *